US008602924B2

(12) United States Patent
Shindome et al.

(10) Patent No.: US 8,602,924 B2
(45) Date of Patent: Dec. 10, 2013

(54) BASEBALL OR SOFTBALL BAT

(75) Inventors: Kazuhiko Shindome, Osaka (JP); Toshiaki Kida, Osaka (JP); Yutaka Yamaguchi, Osaka (JP)

(73) Assignee: Mizuno Corporation, Osaka (JP)

( * ) Notice: Subject to any disclaimer, the term of this patent is extended or adjusted under 35 U.S.C. 154(b) by 59 days.

(21) Appl. No.: 12/796,915

(22) Filed: Jun. 9, 2010

(65) Prior Publication Data

US 2011/0281674 A1 Nov. 17, 2011

(30) Foreign Application Priority Data

May 17, 2010 (JP) ..... 2010-113204

(51) Int. Cl.
*A63B 59/06* (2006.01)

(52) U.S. Cl.
USPC ..... 473/566; 473/567

(58) Field of Classification Search
USPC ..... 473/457, 519, 520, 564–568
See application file for complete search history.

(56) References Cited

U.S. PATENT DOCUMENTS

| | | | | |
|---|---|---|---|---|
| 3,801,098 | A * | 4/1974 | Gildemeister | 473/520 |
| 4,272,971 | A | 6/1981 | Loyd et al. | |
| 5,104,123 | A | 4/1992 | Okitsu et al. | |
| 5,364,095 | A | 11/1994 | Easton et al. | |
| 5,511,777 | A * | 4/1996 | McNeely | 473/520 |
| 5,676,610 | A | 10/1997 | Bhatt et al. | |
| 6,048,283 | A * | 4/2000 | Albarelli, Jr. | 473/567 |
| 6,398,675 | B1 | 6/2002 | Eggiman et al. | |
| 6,432,007 | B1 * | 8/2002 | Filice et al. | 473/566 |
| 6,869,373 | B1 | 3/2005 | Byrne et al. | |
| 6,872,156 | B2 | 3/2005 | Ogawa et al. | |
| 6,997,826 | B2 | 2/2006 | Sutherland | |
| 7,033,291 | B1 | 4/2006 | Meeker | |
| 7,115,054 | B2 | 10/2006 | Giannetti et al. | |
| 7,361,107 | B2 * | 4/2008 | Giannetti et al. | 473/567 |
| 7,534,179 | B1 | 5/2009 | Vasek et al. | |
| 7,534,180 | B1 | 5/2009 | Vasek et al. | |
| 7,749,115 | B1 * | 7/2010 | Cruz et al. | 473/567 |

(Continued)

FOREIGN PATENT DOCUMENTS

| | | |
|---|---|---|
| JP | 6066368 | 5/1985 |
| JP | 2002-126144 | 5/2002 |

(Continued)

OTHER PUBLICATIONS

International Search Report and Written Opinion dated Apr. 25, 2012 for related PCT Patent Application No. PCT/US2012/020540.

(Continued)

*Primary Examiner* — Mark Graham
(74) *Attorney, Agent, or Firm* — Troutman Sanders LLP; James E. Schutz; Robert R. Elliott, Jr.

(57) ABSTRACT

A baseball or softball bat improved in repulsiveness while maintaining sufficient durability is obtained. The bat is a baseball or softball bat including a hitting portion, a tapered portion and a grip portion, and the hitting portion offers a hitting portion core as a core, an elastic body and an outer shell member. The elastic body is arranged on the outer periphery of the hitting portion core. The outer shell member is arranged on the outer periphery of the elastic body. The outer shell member includes outer shell member portions which are a plurality of portions elastically deformable independently of each other.

19 Claims, 43 Drawing Sheets

(56) References Cited

U.S. PATENT DOCUMENTS

| | | | | |
|---|---|---|---|---|
| 2002/0151392 | A1 | 10/2002 | Buiatti et al. | |
| 2003/0004020 | A1* | 1/2003 | Ogawa et al. | 473/564 |
| 2004/0053716 | A1* | 3/2004 | Wu | 473/564 |
| 2007/0219027 | A1* | 9/2007 | Chong | 473/564 |
| 2008/0070726 | A1* | 3/2008 | Watari et al. | 473/566 |
| 2008/0234075 | A1* | 9/2008 | Lancisi | 473/457 |
| 2009/0143176 | A1* | 6/2009 | Burger | 473/564 |
| 2009/0215560 | A1* | 8/2009 | McNamee et al. | 473/567 |
| 2009/0280934 | A1 | 11/2009 | Watari et al. | |
| 2009/0280935 | A1* | 11/2009 | Watari et al. | 473/566 |
| 2010/0087282 | A1 | 4/2010 | Smith | |
| 2011/0195808 | A1* | 8/2011 | Chauvin | 473/564 |
| 2012/0178557 | A1 | 7/2012 | Tsukamoto et al. | |
| 2012/0178558 | A1 | 7/2012 | Tsukamoto et al. | |

FOREIGN PATENT DOCUMENTS

| | | |
|---|---|---|
| JP | 2006263141 | 10/2006 |
| JP | 2007325900 | 12/2007 |
| JP | 2008029620 | 2/2008 |

OTHER PUBLICATIONS

International Search Report and Written Opinion dated May 1, 2012 for related PCT Patent Application No. PCT/US2012/020537.

Office Action issued by the Japanese Patent Office dated May 14, 2013 for related Japanese Patent Application No. 2010-113204.

* cited by examiner

BASEBALL OR SOFTBALL BAT

This nonprovisional application is based on Japanese Patent Application No. 2009-118895 filed on May 15, 2009 and No. 2010-113204 filed on May 17, 2010, with the Japan Patent Office, the entire contents of which are hereby incorporated by reference.

BACKGROUND OF THE INVENTION

1. Field of the Invention

The present invention relates to a baseball or softball bat employing an elastic body for a hitting portion, and more specifically, it relates to a baseball or softball bat employing an elastic body for a hitting portion, improved in repulsiveness while maintaining durability.

2. Description of the Background Art

A bat improved in repulsiveness by employing an elastic body for a hitting portion is known in general (refer to Japanese Patent Laying-Open No. 2002-126144 (hereinafter referred to as Patent Document 1), for example). In Patent Document 1, a hitting portion of a bat is constituted of a hitting portion core, an elastic body arranged on the outer periphery of the hitting portion core and a pipe as an outer shell member arranged on the outer periphery of the elastic body. Thus, the elastic body is compressed in batting by an impact resulting from the batting, so that a ball and the outer shell member move toward the direction of the hitting portion core. It is stated that the ball and the outer shell member thereafter move in the outer surface direction of the bat due to restoration of the elastic body, whereby the ball does not remarkably deform in the batting, and repulsiveness of the bat is improved by reducing energy loss resulting from deformation of the ball.

As a result of studying the aforementioned conventional bat, however, the inventor has found the following problem: In other words, while it is necessary to maintain a certain degree of strength in the outer shell member in the bat having the aforementioned structure, the outer shell member does not sufficiently deform or move in batting when the outer shell member of such sufficient strength is employed, and the improvement in the repulsiveness of the bat has been insufficient as a result. On the other hand, while a countermeasure of reducing rigidity of the outer shell member or employing a material softer than ever as the elastic body is conceivable in order to sufficiently deform the outer shell member or the elastic body in batting in the bat having the structure disclosed in Patent Document 1, such a new problem arises in this case that the durability of the bat lowers to deteriorate the batting feeling.

SUMMARY OF THE INVENTION

An object of the present invention is to provide a baseball or softball bat improved in repulsiveness while maintaining sufficient durability.

The baseball or softball bat according to the present invention is a baseball or softball bat including a hitting portion, a tapered portion and a grip portion, and the hitting portion offers a core, an elastic body and an outer shell member. The elastic body is arranged on the outer periphery of the core. The outer shell member is arranged on the outer periphery of the elastic body. The outer shell member includes a plurality of portions elastically deformable independently of each other.

Thus, the outer shell member is constituted of the plurality of independently deformable portions, whereby an impact from a ball is transmitted to a portion of the outer shell member with which the ball has come into contact in batting, while the impact is not directly transmitted to another portion of the outer shell member adjacent to this portion. Therefore, the portion with which the ball has come into contact and the elastic body located under the portion can be easily elastically deformed. Consequently, energy loss can be reduced by suppressing deformation of the ball in the batting, and the repulsiveness of the bat can be improved as a result.

When the outer shell member is an integral pipelike member as in the prior art, it follows that the whole of the pipelike member dispersively receives an impact load applied to the portion with which the ball has come into contact. Therefore, it becomes necessary to remarkably lower the rigidity of the pipelike member or the modulus of elasticity of the elastic body (to remarkably reduce the thickness of the pipelike member or to remarkably lower the modulus of elasticity of the elastic body, for example) in order to implement sufficient deformation of the pipelike member to a degree capable of suppressing deformation of the ball. When the outer shell member is constituted of a plurality of portions as in the bat according to the present invention, on the other hand, it follows that an individual portion with which the ball has come into contact receives the impact load from the ball in batting, whereby it becomes possible to increase the rigidity of the plurality of portions constituting the outer shell member or the modulus of elasticity of the elastic body to some extent (to increase the thicknesses of the plurality of portions to a degree capable of ensuring sufficient durability, for example). Therefore, the repulsiveness can be improved while maintaining the durability of the bat.

According to the present invention, a baseball or softball bat improved in repulsiveness while maintaining sufficient durability can be obtained.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
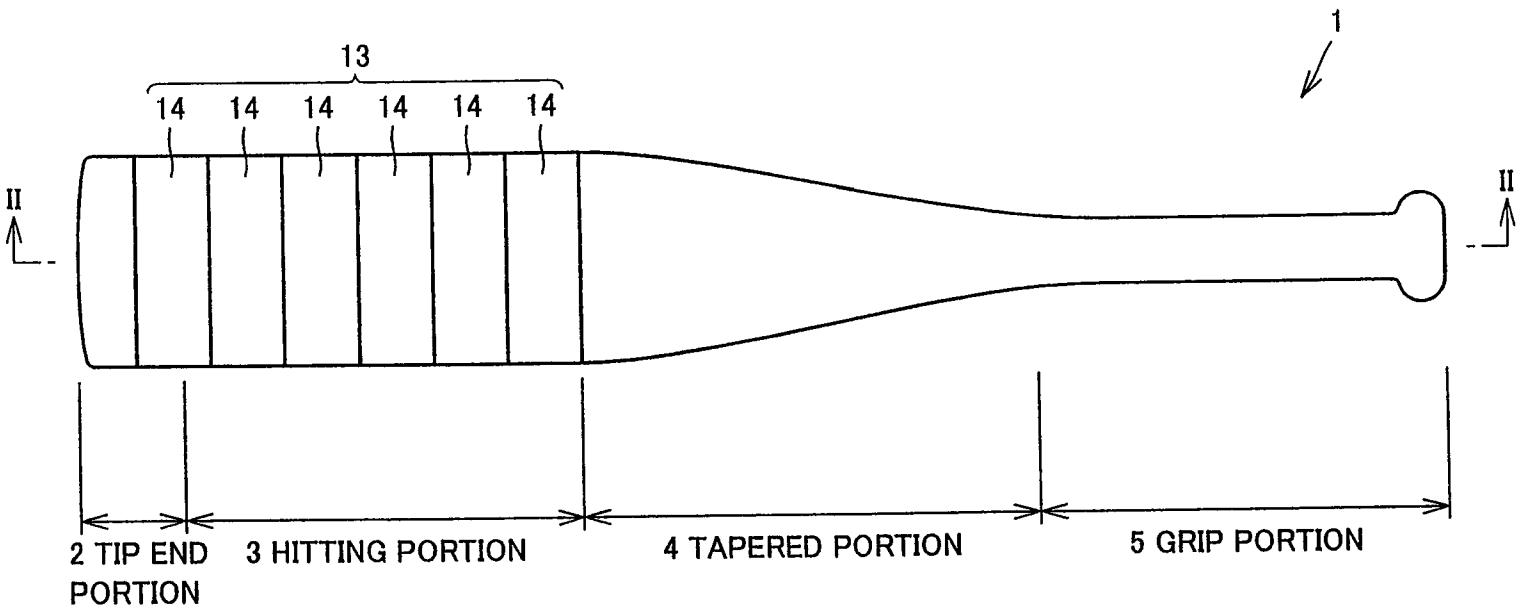
FIG. 1 is a schematic diagram showing a first embodiment of a bat according to the present invention.

Embodiments of the present invent invention are now described with reference to the drawings. In the following drawings, identical or corresponding portions are denoted by the same reference numerals, and redundant description is not repeated.

(First Embodiment)

A first embodiment of the bat according to the present invention is described with reference to FIGS. 1 to 3.

Figure 2:
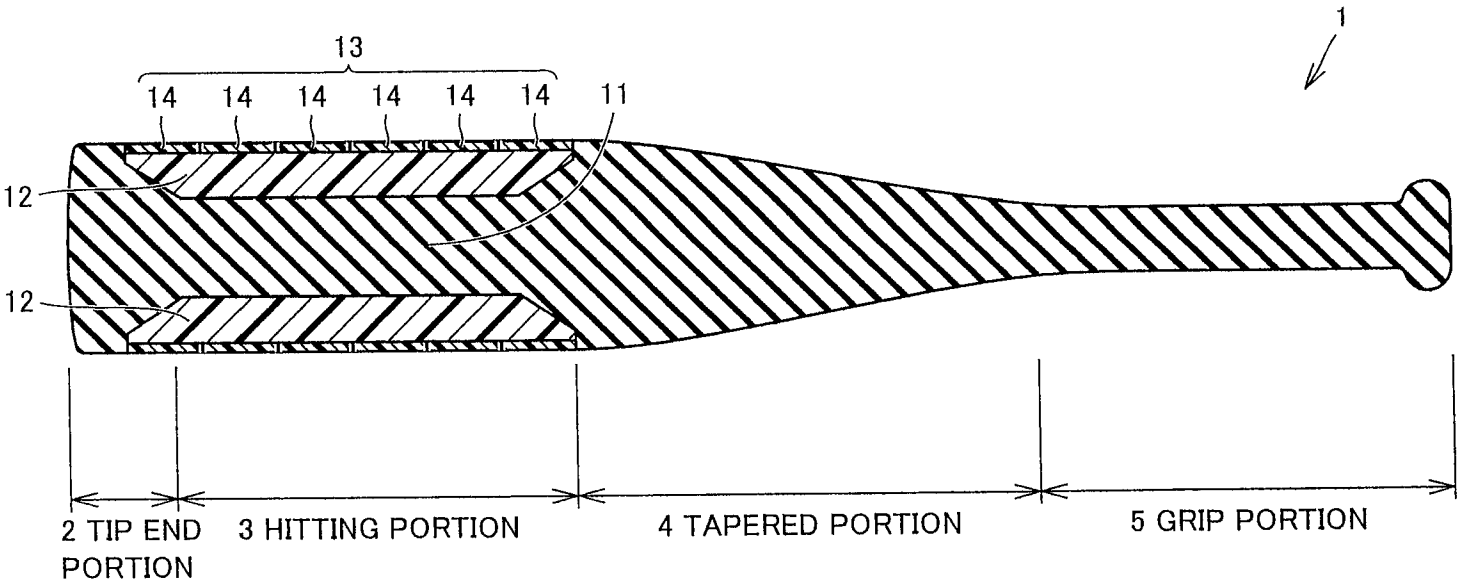
FIG. 2 is a schematic sectional view taken along the line segment II-II in FIG. 1.
Figure 3:
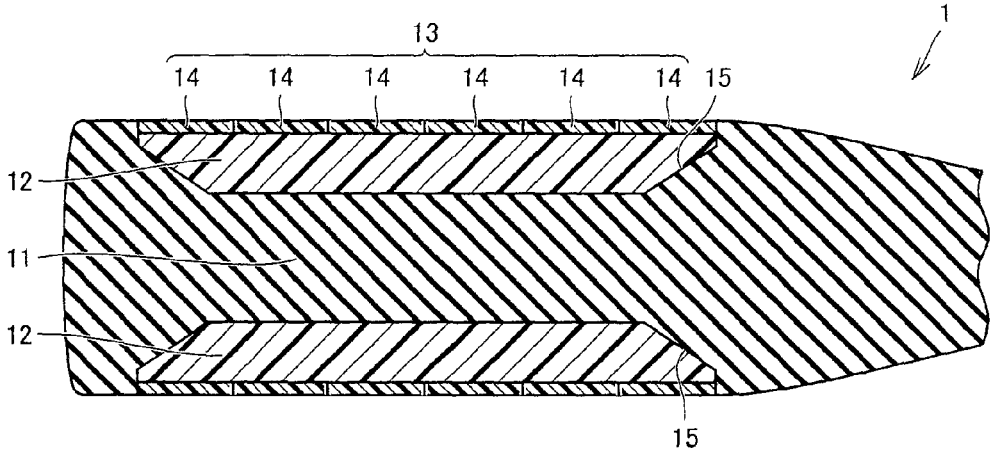
FIG. 3 is a partially fragmented schematic sectional view of the bat shown in FIG. 2.

A bat 1 shown in FIGS. 1 to 3 includes a tip end portion 2, a hitting portion 3 for hitting a ball, a tapered portion 4 whose diameter gradually narrows, and a grip portion 5 for allowing the batter to grip bat 1, from the forward end side. As shown in FIGS. 2 and 3, bat 1 has a three-layer structure in hitting portion 3 of bat 1. In other words, an elastic body 12 is arranged on the outer periphery of a hitting portion core 11 located on a central portion in the radial direction of bat 1 (a central portion in a section perpendicular to the central axis of bat 1) in hitting portion 3. Hitting portion core 11 is provided with a recess 15 for arranging elastic body 12 therein. Elastic body 12 is arranged in recess 15. In recess 15, elastic body 12 is arranged to surround hitting portion core 11. An outer shell member 13 is arranged on the outer peripheral side surface of elastic body 12. The whole of outer shell member 13 is substantially cylindrically shaped. Outer shell member 13 is constituted of a plurality of outer shell member portions 14. Outer shell member portions 14 are also cylindrical shaped (although the width in the central axis direction of bat 1 is shorter than the width of aforementioned outer shell member 13). Outer shell member portions 14 are in states completely separating from each other. While individual outer shell member portions 14 have substantially identical shapes in FIG. 1, the shapes of respective outer shell member portions 14 may be changed (the widths in the central axis direction of bat 1 may be changed, for example). Further, outer shell member portions 14 are connected/fixed to the outer peripheral surface of elastic body 12. As the connecting method for outer shell member portions 14 and elastic body 12, outer shell member portions 14 and elastic body 12 may be bonded to each other through a bonding member such as an adhesive, or outer shell member portions 14 and elastic body 12 may be directly fixed to each other. As the fixing method, an arbitrary method such as heat sealing can be employed. Elastic body 12 and hitting portion core 11 may be connected/fixed to each other by an arbitrary method.

According to bat 1 having such a structure, outer shell member portions 14 of outer shell member 13 are independently deformable respectively when hitting a ball on hitting portion 3, whereby outer shell member portions 14 and elastic body 12 under outer shell member portions 14 can sufficiently deform in response to the hitting of the ball. Consequently, repulsive force resulting from the deformation of elastic body 12 can be sufficiently transmitted to the ball. Therefore, the carry of the ball can be further elongated.

A method of manufacturing the bat shown in FIGS. 1 to 3 is now described. While a generally known arbitrary method can be employed as the method of manufacturing the bat shown in FIGS. 1 to 3, a method of setting hitting portion core 11 and outer shell member portions 14 in a molding die, injecting a liquid material for forming the elastic body into recess 15 of the core and forming elastic body 12 by solidifying the liquid material (in the formation of elastic body 12, outer shell member portions 14 and recess 15 of the core are fixed to elastic body 14 respectively) can be employed, for example.

A modification of the bat according to the present invention shown in FIGS. 1 to 3 is described with reference to FIGS. 4 and 5.

Figure 4:
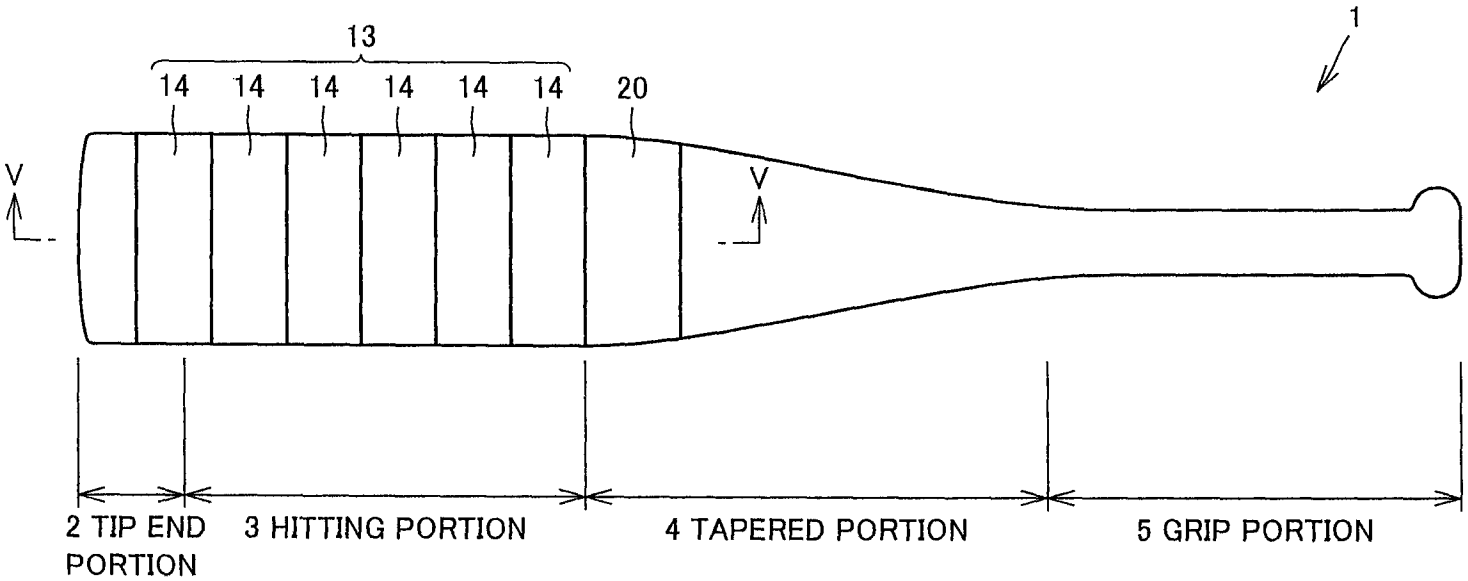
FIG. 4 is a schematic diagram showing a modification of the bat shown in FIGS. 1 to 3.
Figure 5:
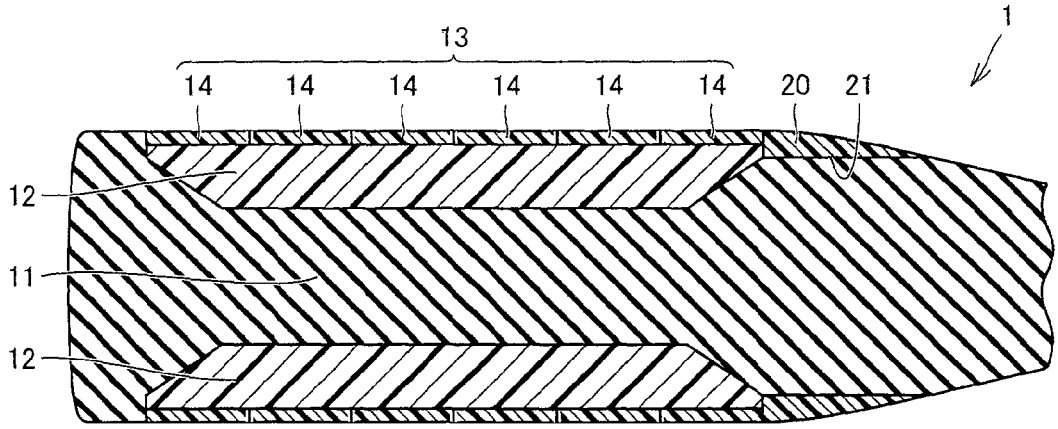
FIG. 5 is a partially fragmented schematic sectional view taken along the line segment V-V in FIG. 4.

While a bat 1 shown in FIGS. 4 and 5 basically has a structure similar to that of the bat shown in FIGS. 1 to 3, a point that a fixed member 20 is arranged on a side of an outer shell member 13 closer to a grip portion 5 is different. More specifically, a fixed member holding portion 21 for connecting/fixing fixed member 20 to a side of a recess 15 closer to the tapered portion is formed in a hitting portion core 11, as shown in FIG. 5. In fixed member holding portion 21, the diameter of hitting portion core 11 is substantially constant. The diameter of fixed member holding portion 21 is smaller than the inner diameter of an outer shell member 13. In other words, the diameter of bat 1 is smaller than the inner diameter of outer shell member 13 from fixed member holding portion 21 to a tapered portion 4. Before mounting fixed member 20, therefore, it is possible to attach or detach outer shell member 13 onto or from the outer peripheral surface of elastic body 12 in a hitting portion 3 from the grip side.

Fixed member 20 can be fixed to fixed member holding portion 21 by an arbitrary method. For example, fixed member 20 may be bonded to fixed member holding portion 21 with an adhesive or the like, or a fixing member such as a fixing pin may be separately prepared for connecting/fixing fixed member 20 to fixed member holding portion 21 with this member. Also according to such bat 1, effects similar to those of bat 1 shown in FIGS. 1 to 3 can be attained.

(Second Embodiment)

A second embodiment of the bat according to the present invention is described with reference to FIGS. 6 to 8.

Figure 6:
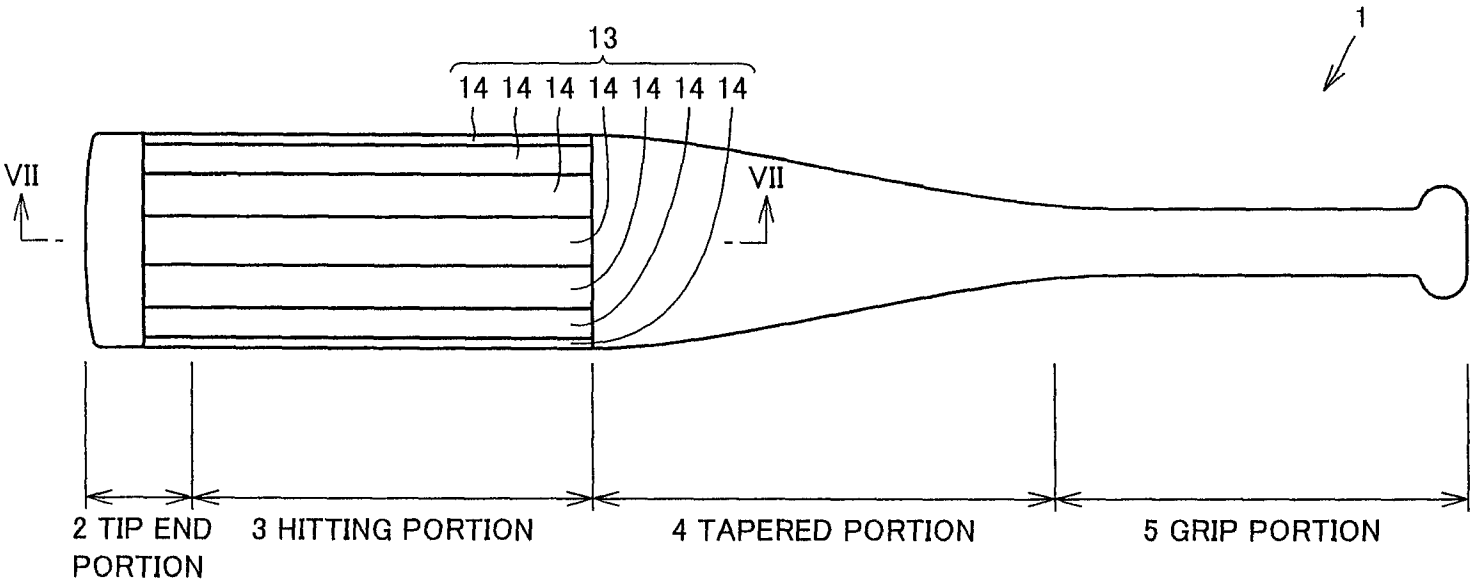
FIG. 6 is a schematic diagram showing a second embodiment of the bat according to the present invention.
Figure 7:
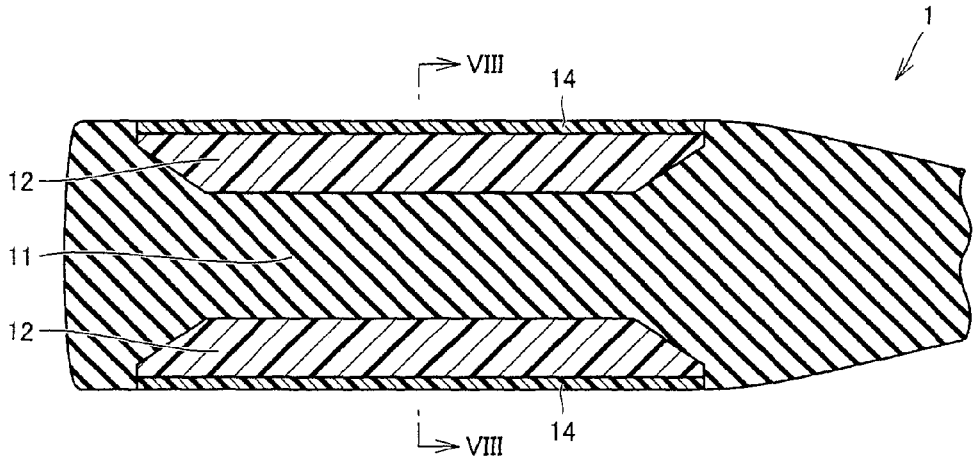
FIG. 7 is a partially fragmented schematic sectional view taken along the line segment VII-VII in FIG. 6.
Figure 8:
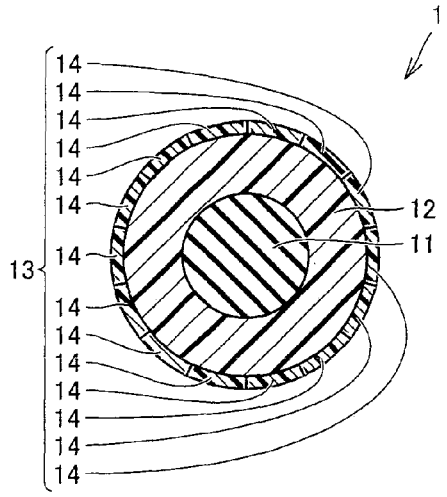
FIG. 8 is a schematic sectional view taken along the line segment VIII-VIII in FIG. 7.

While a bat 1 shown in FIGS. 6 to 8 basically has a structure similar to that of the bat shown in FIGS. 1 to 3, the shapes of outer shell member portions 14 constituting an outer shell member 13 are different. In other words, outer shell member portions 14 have oblong shapes extending along the extensional direction of the central axis of bat 1 in bat 1 shown in FIGS. 6 to 8. From a different point of view, outer shell member 13 is in a state divided into plurality of outer shell member portions 14 along the extensional direction of bat 1. Portions of outer shell member portions 14 in contact with an elastic body 12 are entirely or partially connected/fixed to elastic body 12 with a connecting member such as an adhesive. Also according to bat 1 having such a structure, effects similar to those of bat 1 shown in FIGS. 1 to 3 can be attained. As the fixing method for outer shell member portions 14 and the surface of elastic body 12, an arbitrary method other than the aforementioned method employing the fixing member such as an adhesive can be employed.

(Third Embodiment)

A third embodiment of the bat according to the present invention is described with reference to FIGS. 9 and 10.

Figure 9:
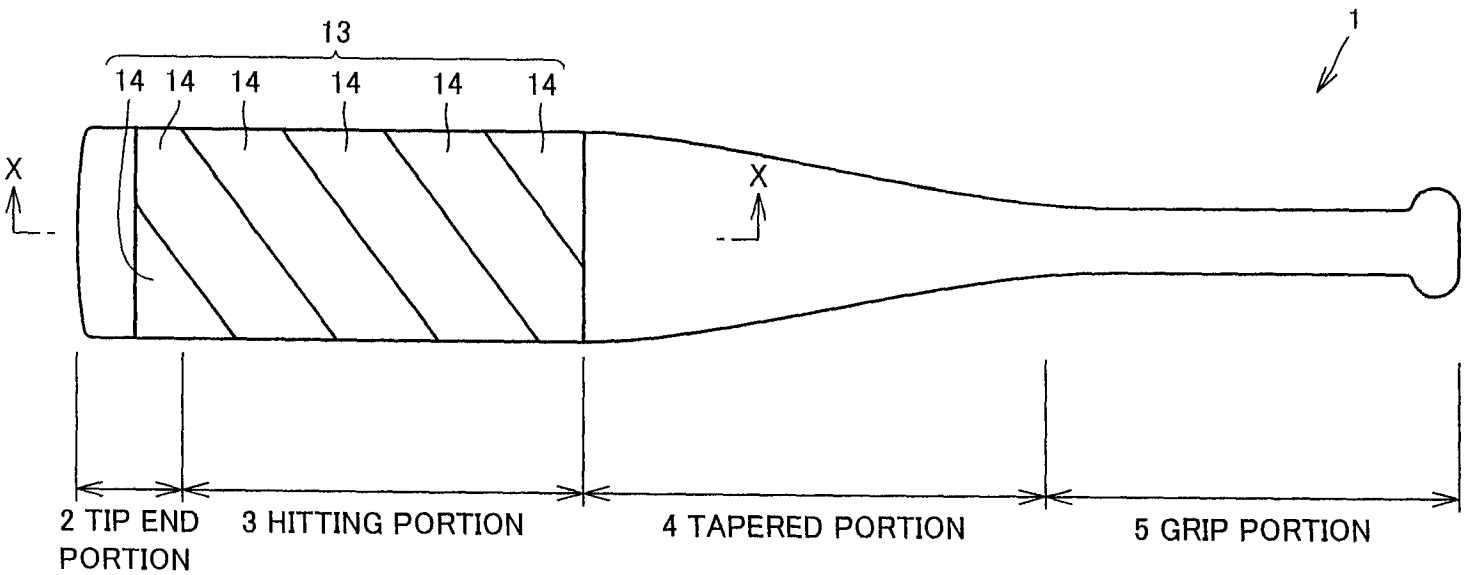
FIG. 9 is a schematic diagram showing a third embodiment of the bat according to the present invention.
Figure 10:
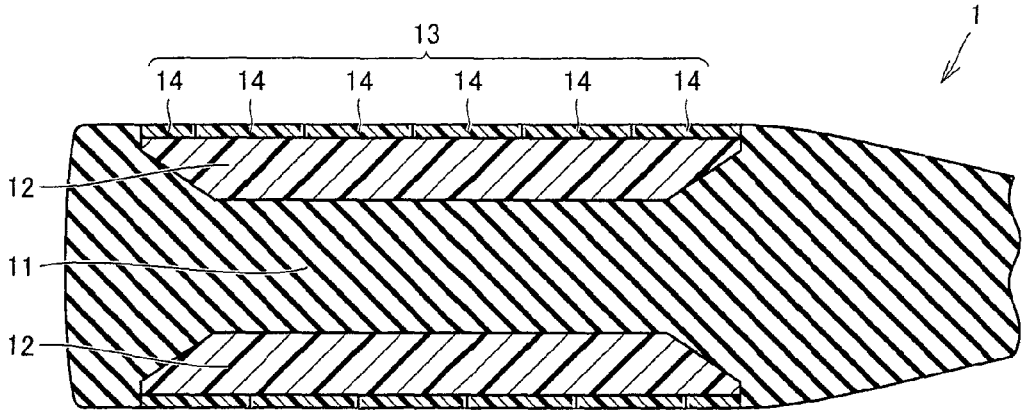
FIG. 10 is a partially fragmented schematic sectional view taken along the line segment X-X in FIG. 9.

While a bat 1 shown in FIGS. 9 and 10 basically has a structure similar to that of bat 1 shown in FIGS. 1 to 3, the shapes of outer shell member portions 14 constituting an outer shell member 13 are different. In other words, outer shell member 13 is so obliquely (spirally) divided with respect to the extensional direction of bat 1 (the direction along the central axis of bat 1) that outer shell member portions 14 are formed in bat 1 shown in FIGS. 9 and 10. In other words, outer shell member portions 14 have spirally extending outer shapes. Also according to bat 1 having such a shape, effects similar to those of bat 1 shown in FIGS. 1 to 3 can be attained. Further, such spiral outer shell member portions 14 are so employed that outer shell member portions 14 can be utilized as reinforcing members for bat 1 with respect to bending stress in both of the direction along the central axis of bat 1 and a direction perpendicular to the central axis.

The inner peripheral surfaces of outer shell member portions 14 opposed to an elastic body 12 are preferably entirely or partially connected/fixed to elastic body 12 with a bonding member or the like. As the connecting/fixing method for outer shell member portions 14 and elastic body 12, an arbitrary method (heat sealing or the like, for example) other than the aforementioned method employing the bonding member can be employed.

(Fourth Embodiment)

A fourth embodiment of the bat according to the present invention is described with reference to FIGS. 11 to 13.

Figure 11:
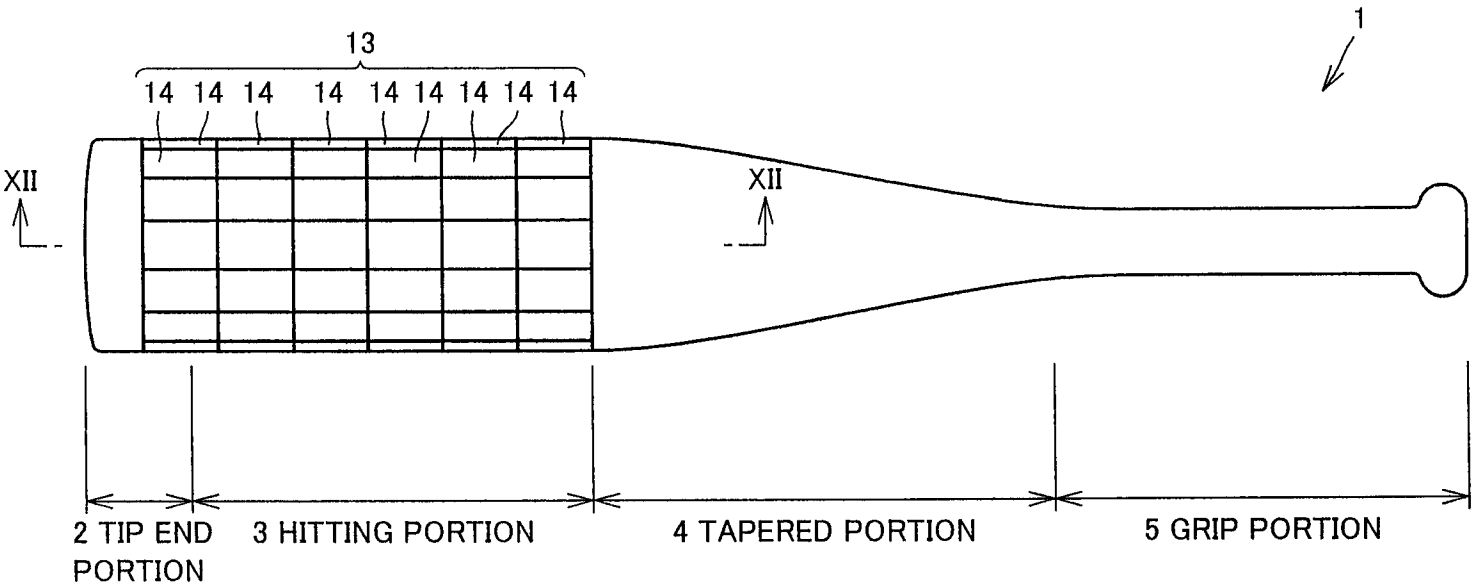
FIG. 11 is a schematic diagram showing a fourth embodiment of the bat according to the present invention.
Figure 12:
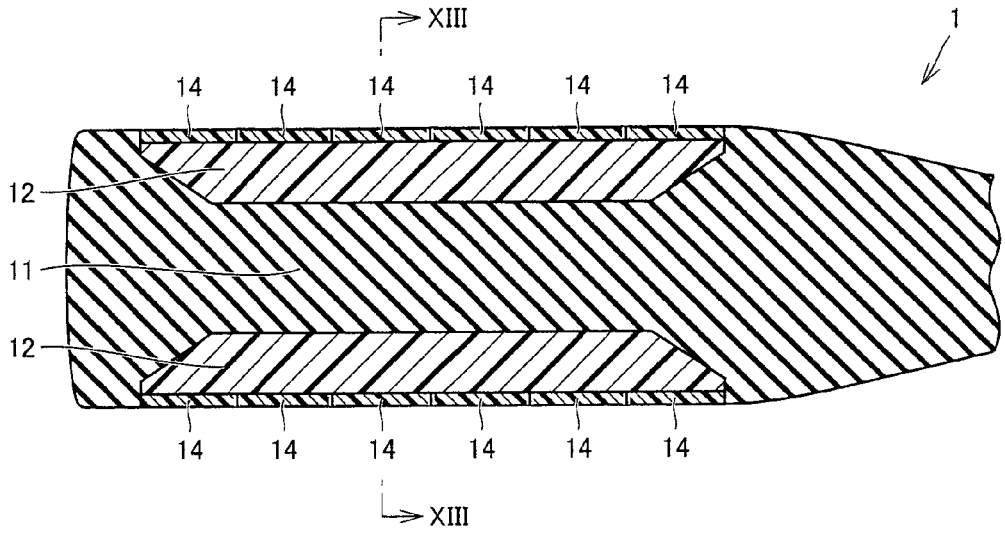
FIG. 12 is a schematic sectional view taken along the line segment XII-XII in FIG. 11.
Figure 13:
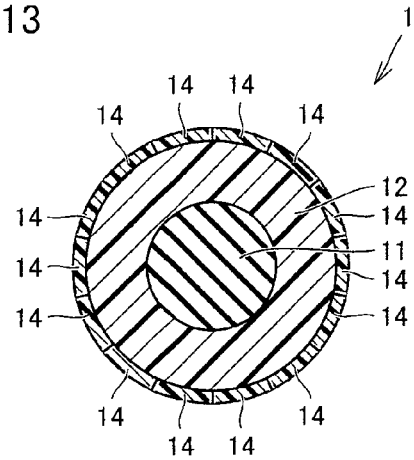
FIG. 13 is a schematic sectional view taken along the line segment XIII-XIII in FIG. 12.

While a bat 1 shown in FIGS. 11 to 13 basically has a structure similar to that of the bat shown in FIGS. 1 to 3, the shapes of outer shell member portions 14 are different. In other words, outer shell member portions 14 in the bat shown in FIGS. 11 to 13 are members obtained by dividing an outer shell member 13 in two directions, i.e., the extensional direction of the central axis of bat 1 and a direction perpendicular to the central axis, and the plane structures thereof are substantially quadrangular. Outer shell member portions 14 are connected/fixed to the surface of an elastic body 12 located on the inner peripheral side. Also according to bat 1 having such a structure, effects similar to those of bat 1 shown in FIGS. 1 to 3 can be attained. The sizes of outer shell member portions 14 are so properly selected that, when hitting a ball with bat 1, an impact resulting from this hitting can be reliably transmitted to elastic body 12. Consequently, deformation of the ball can be suppressed, and the carry of the ball can be further elongated through repulsive force of elastic body 12.

(Fifth Embodiment)

Figure 14:
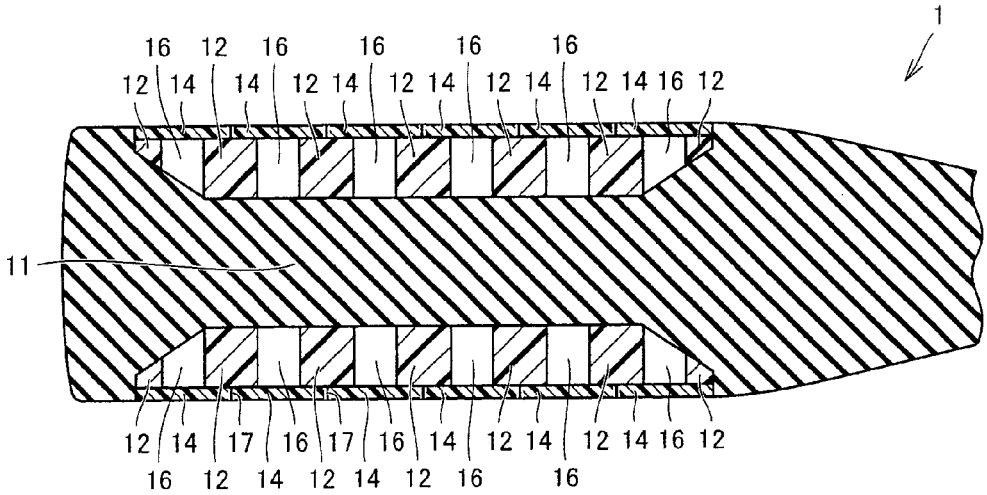
FIG. 14 is a partially fragmented schematic sectional view showing a fifth embodiment of the bat according to this invention.

A fifth embodiment of the bat according to the present invention is described with reference to FIG. 14. FIG. 14 corresponds to FIG. 3.

While a bat 1 basically has a structure similar to that of the bat shown in FIGS. 1 to 3, the shape of an elastic body 12 is different, as shown in FIG. 14. In other words, hollow portions 16 are formed under substantially central portions of outer shell member portions 14 in elastic body 12 of bat 1 shown in FIG. 14. While hollow portions 16 may have annular shapes extending in the circumferential direction of bat 1, for example, hollow portions 16 may be locally formed in the circumferential direction of the bat. Elastic body 12 is at least located under the boundaries of outer shell member portions 14 (portions where outer peripheral end portions of adjacent pairs of outer shell member portions 14 are opposed to each other). Consequently, the outer peripheral end portions of outer shell member portions 14 can be supported by elastic body 12.

Thus, effects similar to those of bat 1 shown in FIGS. 1 to 3 can be attained, while hollow portions 16 are so formed in elastic body 12 that the rigidity of elastic body 12 can be further lowered. Consequently, the quantity of deformation in a hitting portion 3 of bat 1 at a time of hitting a ball can be further enlarged, whereby energy loss following the deformation of the ball resulting from the hitting can be further reduced. Further, a batting sound can be bettered or the batting feeling can be improved by forming hollow portions 16.

From a different point of view, hollow portions 16 are so formed that a bending modulus of elasticity (force (load) necessary for causing bending deformation by a unit length) of outer shell member portions 14 is larger than a compression modulus of elasticity (force (load) necessary for compression by the unit length) of elastic body 12 in aforementioned bat 1, and hence impact force in collision with the ball is mainly used not for deformation of outer shell member portions 14 but for compressive deformation of elastic body 12. In a portion colliding with the ball, therefore, the load is more largely consumed not for deformation of outer shell member portions 14 but for deformation of elastic body 12 supporting outer shell member portions 14, and the central axis of outer shell member portion 14 moves to deviate from the central axes of other outer shell portion members 14 (i.e., the central axis of a core of the bat), whereby deformation of the ball can be suppressed. Further, bending deformation of outer shell member members 14 so hardly takes place that breakage of portions bonded to elastic body 12 and the main body of elastic body 12 can be prevented.

While hollow portions 16 of elastic body 12 are formed to reach the outer peripheral surface of a hitting portion core 11 from the inner peripheral surfaces of outer shell member portions 14 (i.e., to pass through elastic body 12 in the radial direction of 1 of the bat) in bat 1 shown in FIG. 14, hollow portions 16 may be formed in elastic body 12 (i.e., so that hollow portions 16 do not come into contact with outer shell member portions 14 and hitting portion core 11). Alternatively, hollow portions 16 may be so formed that only either hitting portion core 11 or outer shell member portions 14 are exposed in hollow portions 16. When forming hollow portions 16 so that only outer shell member portions 14 are exposed (elastic body 12 enters a state covering the surface of hitting portion core 11), for example, elastic body 12 can be easily formed by die molding, whereby increase in the manufacturing cost for bat 1 can be suppressed. While hollow portions 16 may be formed under all outer shell member portions 14 as shown in FIG. 14, hollow portions 16 may be formed only under partial outer shell member portions 14.

The specific gravity of elastic body 12 can be set to at least 0.15 and not more than 1.3, more preferably at least 0.25 and not more than 0.7. The aforementioned numerical range has been selected for the following reason: In other words, it becomes difficult to mold elastic body 12 if the specific gravity of elastic body 12 is smaller than 0.15, while it becomes difficult to set the gross mass and the barycentric position of the bat within practical ranges if the specific gravity exceeds 1.3. In consideration of moldability and repulsiveness of elastic body 12, further, the specific gravity is more preferably at least 0.25 and not more than 0.7.

The JIS C hardness of elastic body 12 can be set to at least 5 and not more than 85, more preferably at least 20 and not more than 80. The aforementioned numerical range has been selected for the following reason: In other words, it becomes difficult to mold elastic body 12 if the C hardness is less than 5, while such a defect results that the characteristics of an outer shell member 13 are damaged if the C hardness exceeds 85. In consideration of moldability and repulsiveness, further, the JIS C hardness of elastic body 12 is more preferably at least 25 and not more than 80. In this specification, the JIS C hardness denotes hardness measured according to the spring type C hardness testing method described in Appendix 2, JIS K 7312.

As the thickness of elastic body 12 in the radial direction of bat 1 as to a baseball bat whose maximum diameter is not more than Φ70 mm, a preferable range of this thickness can be considered every range of the JIS C hardness as follows: More specifically, the thickness of aforementioned elastic body 12 can be set to at least 8 mm and not more than 19.2 mm, more preferably at least 10 mm and not more than 15 mm, when the aforementioned JIS C hardness is at least 5 and not more than 20.

The aforementioned numerical range has been selected for the following reason: In other words, the moving ranges of outer shell member portions 14 are excessively reduced in hitting of a ball (i.e., an impact cannot be sufficiently absorbed by only deformation of elastic body 12 but elastic body 12 deforms up to a deformation limit in the hitting of the ball, and hence the impact in the hitting is directly transmitted to a hitting portion core 11 (outer shell member portions 14 bottom out)) if the thickness of elastic body 12 is less than 8 mm. Therefore, such a possibility arises that the effect of bat 1 according to the present invention cannot be exhibited to the maximum. As to the upper limit of the aforementioned thickness, the outer diameter of hitting portion core 11 must be at least about 30 mm at the minimum in consideration of the strength of bat 1. In consideration of the minimum thickness of outer shell member portions 14, the upper limit of the aforementioned thickness is preferably set to 19.2 mm. In order to render the repulsiveness and the moldability of the bat more preferable, the lower limit of the aforementioned thickness is more preferably set to 10 mm. In order to sufficiently ensure the strength of bat 1, the upper limit of the aforementioned thickness is more preferably set to 15 mm.

When the aforementioned JIS C hardness is in excess of 20 and not more than 50, the thickness of aforementioned elastic body 12 can be set to at least 6 mm and not more than 19.2 mm, more preferably at least 8 mm and not more than 15 mm. When the aforementioned JIS C hardness is in excess of 50 and not more than 85, the thickness of aforementioned elastic body 12 can be set to at least 4 mm and not more than 19.2 mm, more preferably at least 6 mm and not more than 15 mm. As to the numerical range of the aforementioned thickness, the hardness of elastic body 12 has become so higher (than that in the case where the range of the JIS C hardness is at least 5 and not more than 20) that it is possible to attain the effect of the present invention also when further reducing the thickness of elastic body 12, and hence the lower limit of the thickness is smaller (than that in the case where the aforementioned JIS C hardness is at least 5 and not more than 20), and the reason for the decision thereof is basically identical.

In a case of a softball bat whose maximum diameter is not more than Φ57 mm, the thickness of elastic body 12 in the radial direction of bat 1 is preferably set as follows: More specifically, when the aforementioned JIS C hardness is at least 5 and not more than 20, the thickness can be set to at least 8 mm and not more than 12.7 mm, more preferably at least 10 mm and not more than 12 mm. When the aforementioned JIS C hardness is in excess of 20 and not more than 50, the thickness of aforementioned elastic body 12 can be set to at least 6 mm and not more than 12.7 mm, more preferably at least 8 mm and not more than 12 mm. When the aforementioned JIS C hardness is in excess of 50 and not more than 85, the thickness of aforementioned elastic body 12 can be set to at least 4 mm and not more than 12.7 mm, more preferably at least 6 mm and not more than 12 mm. The reason for the decision of the thickness of elastic body 12 in the case of the aforementioned softball bat is also similar to that in the case of the aforementioned baseball bat, except for the point that the maximum diameters of the bats are different from each other.

The characteristics of aforementioned elastic body 12 are also applicable to elastic bodies 12 in other embodiments of the invention of this application.

The lengths of contact portions between elastic body 12 and outer shell member portions 14 on the boundaries between adjacent outer shell member portions 14 in the extensional direction of bat 1 are preferably at least 10 mm and not more than the lengths of outer shell member portions 14. Such a numerical range has been selected for the reason that, in a case of considering bonding between elastic body 12 and outer shell member portions 14, there is a possibility that the bondability becomes insufficient if the lengths of the contact portions are less than 10 mm. The numerical range of the lengths of the contact portions is also applicable to a case shown in FIG. 18 (i.e., a case where an outer shell member 13 is divided along the extensional direction of a bat 1).

(Sixth Embodiment)

Figure 15:
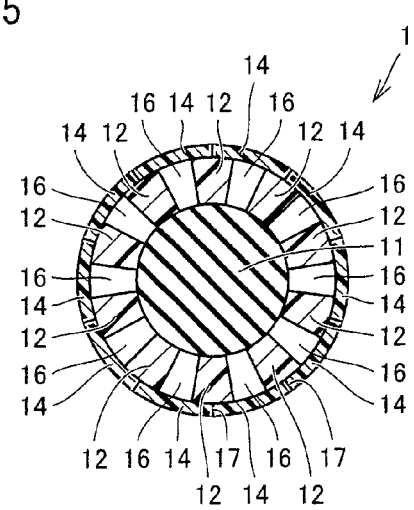
FIG. 15 is a schematic sectional view showing a sixth embodiment of the bat according to the present invention.

A sixth embodiment of the bat according to the present invention is described with reference to FIG. 15. FIG. 15 corresponds to FIG. 8.

Referring to FIG. 15, while a bat 1 basically has a structure similar to that of the bat shown in FIGS. 6 to 8, the structure of an elastic body 12 is different. In other words, hollow portions 16 are formed under central portions of outer shell member portions 14 extending along the direction where the central axis of bat 1 extends in elastic body 12, as shown in FIG. 15. Consequently, effects similar to those of the bat shown in FIG. 14 can be attained. While hollow portions 16 may be formed to extend in the extensional direction of the central axis of bat 1 under the central portions of outer shell member portions 14, the same may be intermittently (locally) formed in the extensional direction of the central axis. In other words, plurality of hollow portions 16 may be formed under one outer shell member portion 14. While hollow portions 16 of elastic body 12 are formed to reach the outer peripheral surface of a hitting portion core 11 from the inner peripheral surfaces of outer shell member portions 14 in bat 1 shown in FIG. 15, hollow portions 16 may be formed in elastic body 12, similarly to the case of bat 1 shown in FIG. 14. Alternatively, hollow portions 16 may be so formed that only either hitting portion core 11 or outer shell member portions 14 are exposed in hollow portions 16. While hollow portions 16 may be formed under all outer shell member portions 14 as shown in FIG. 15, hollow portions 16 may be formed under only partial outer shell member portions 14.

(Seventh Embodiment)

Figure 16:
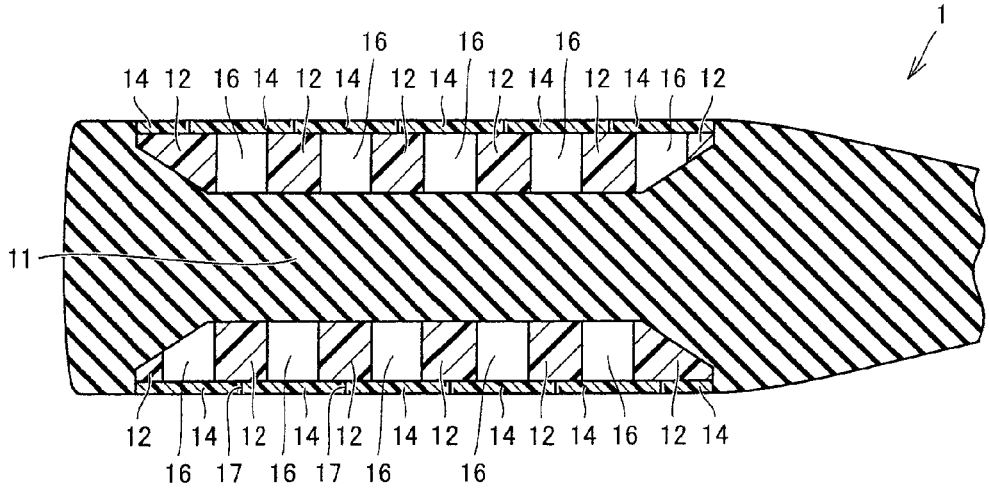
FIG. 16 is a partially fragmented schematic sectional view showing a seventh embodiment of the present invention.

A seventh embodiment of the bat according to the present invention is described with reference to FIG. 16. FIG. 16 corresponds to FIG. 10.

Referring to FIG. 16, while a bat 1 basically has a structure similar to that of the bat shown in FIGS. 9 and 10, the shape of an elastic body 12 is different. In other words, (spirally extending) hollow portions 16 are formed under central portions of spirally extending outer shell member portions 14 in the bat shown in FIG. 16. Elastic body 12 is formed to (spirally) extend along the boundaries between adjacent outer shell member portions 14. End portions of outer shell member portions 14 and elastic body 12 are connected/fixed to each other. Thus, outer shell member portions 14 can be reliably held by elastic body 12. Also according to bat 1 having such a structure, effects similar to those of the bat shown in FIG. 14 can be attained. In other words, hollow portions 16 are so formed that a bending modulus of elasticity (force (load) necessary for causing bending deformation by a unit length) of outer shell member portions 14 is larger than a compression modulus of elasticity (force (load) necessary for compression by the unit length) of elastic body 12 in aforementioned bat 1, and hence impact force in collision with a ball is mainly used not for deformation of outer shell member portions 14 but for compressive deformation of elastic body 12. In a portion colliding with the ball, therefore, (outer shell member portions 14 hardly deform but) only elastic body 12 supporting outer shell member portions 14 compressively deforms, and the central axis of outer shell member portion 14 so moves to deviate from the central axes of other outer shell portion members 14 (i.e., the central axis of a core of the bat) that deformation of the ball can be suppressed. Further, bending deformation of outer shell member members 14 so hardly takes place that breakage of portions bonded to elastic body 12 and the main body of elastic body 12 can be prevented.

While hollow portions 16 may be spirally formed to encircle the central axis of bat 1 under the central portions of outer shell member portions 14, the same may be intermittently (locally) formed in the extensional direction of outer shell member portions 14. In other words, plurality of hollow portions 16 may be formed under one outer shell member portion 14. While hollow portions 16 of elastic body 12 are formed to reach the outer peripheral surface of a hitting portion core 11 from the inner peripheral surfaces of outer shell member portions 14 in bat 1 shown in FIG. 16, hollow portions 16 may be formed in elastic body 12, similar to the case of bat 1 shown in FIG. 14. Alternatively, hollow portions 16 may be so formed that only either hitting portion core 11 or outer shell member portions 14 are exposed in hollow portions 16. While hollow portions 16 may be formed under all outer shell member portions 14 as shown in FIG. 16, hollow portions 16 may be formed only under partial ones of plurality of outer shell member portions 14.

The specific gravity of elastic body 12 can be set to at least 0.15 and not more than 1.3, more preferably at least 0.25 and not more than 0.7. The aforementioned numerical range has been selected for the following reason: In other words, it becomes difficult to mold elastic body 12 if the specific gravity of elastic body 12 is smaller than 0.15, while it becomes difficult to set the gross mass and the barycentric position of the bat within practical ranges if the specific gravity exceeds 1.3. In consideration of moldability and repulsiveness of elastic body 12, further, the specific gravity is more preferably at least 0.25 and not more than 0.7.

The JIS C hardness of elastic body 12 can be set to at least 5 and not more than 85, more preferably at least 20 and not more than 80. The aforementioned numerical range has been selected for the following reason: In other words, it becomes difficult to mold elastic body 12 if the C hardness is less than 5, while such a defect results that the characteristics of an outer shell member 13 are damaged if the C hardness exceeds 85. In consideration of the moldability and the repulsiveness, further, the JIS C hardness of elastic body 12 is more preferably at least 25 and not more than 80.

As the thickness of elastic body 12 in the radial direction of bat 1 as to a baseball bat whose maximum diameter is not more than Φ70 mm, the thickness of aforementioned elastic body 12 can be set to at least 8 mm and not more than 19.2 mm, more preferably at least 10 mm and not more than 15 mm when the aforementioned JIS C hardness is at least 5 and not more than 20, similarly to the case of the aforementioned fifth embodiment. When the aforementioned JIS C hardness is in excess of 20 and not more than 50, the thickness of aforementioned elastic body 12 can be set to at least 6 mm and not more than 19.2 mm, more preferably at least 8 mm and not more than 15 mm. When the aforementioned JIS C hardness is in excess of 50 and not more than 85, the thickness of aforementioned elastic body 12 can be set to at least 4 mm and not more than 19.2 mm, more preferably at least 6 mm and not more than 15 mm. As to the numerical range of the aforementioned thickness, the reason for the decision thereof is basically identical to that in the case of the fifth embodiment.

In a case of a softball bat whose maximum diameter is not more than Φ57 mm, the thickness of elastic body 12 in the radial direction of bat 1 is preferably set as follows: More specifically, when the aforementioned JIS C hardness is at least 5 and not more than 20, the thickness can be set to at least 8 mm and not more than 12.7 mm, more preferably at least 10 mm and not more than 12 mm. When the aforementioned JIS C hardness is in excess of 20 and not more than 50, the thickness of aforementioned elastic body 12 can be set to at least 6 mm and not more than 12.7 mm, more preferably at least 8 mm and not more than 12 mm. When the aforementioned JIS C hardness is in excess of 50 and not more than 85, the thickness of aforementioned elastic body 12 can be set to at least 4 mm and not more than 12.7 mm, more preferably at least 6 mm and not more than 12 mm. The reason for the decision of the thickness of elastic body 12 in the case of the aforementioned softball bat is also similar to that in the case of the aforementioned baseball bat, except for the point that the maximum diameters of the bats are different from each other.

The lengths of contact portions between elastic body 12 and outer shell member portions 14 on the boundaries between adjacent outer shell member portions 14 in the extensional direction of bat 1 are preferably at least 10 mm and less than the lengths of outer shell member portions 14. The reason why such a numerical range has been selected is similar to that in the case of the aforementioned fifth embodiment.

(Eighth Embodiment)

Figure 17:
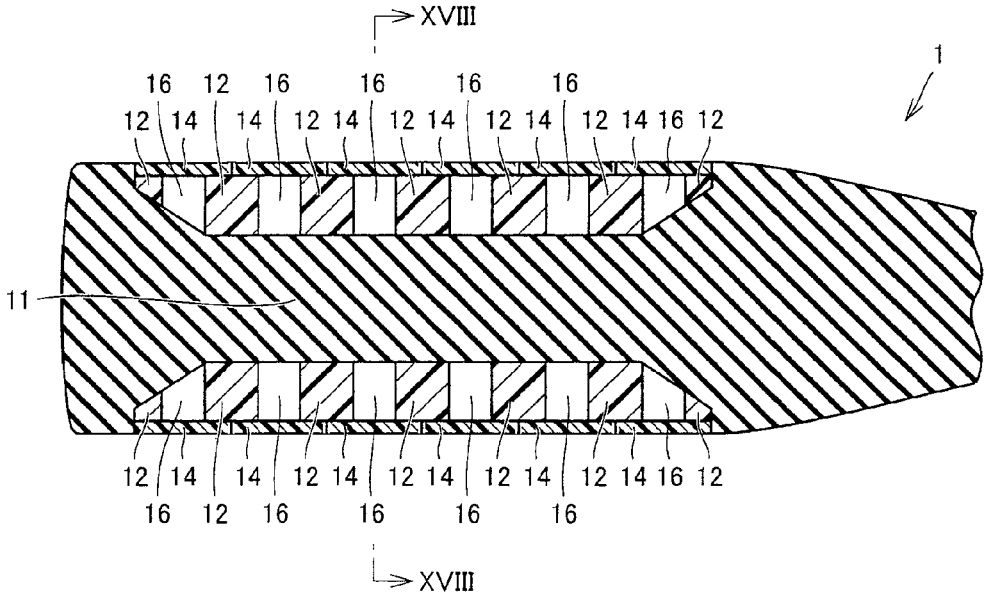
FIG. 17 is a partially fragmented schematic sectional view showing an eighth embodiment of the bat according to the present invention.
Figure 18:
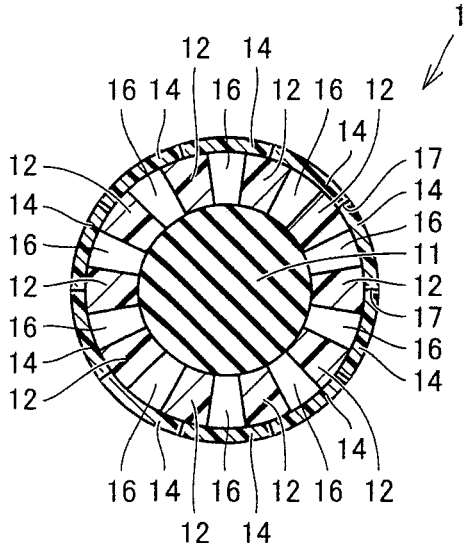
FIG. 18 is a schematic sectional view taken along the line segment XVIII-XVIII in FIG. 17.

An eighth embodiment of the bat according to the present invention is described with reference to FIGS. 17 and 18. FIGS. 17 and 18 correspond to FIGS. 12 and 13 respectively.

Referring to FIGS. 17 and 18, while a bat 1 according to the present invention basically has a structure similar to that of the bat shown in FIGS. 11 to 13, the shape of an elastic body 12 is different. In other words, hollow portions 16 are formed under central portions of outer shell member portions 14 whose plane shapes are substantially quadrangular in bat 1 shown in FIGS. 17 and 18. Elastic body 1 is formed in a latticelike manner along the boundaries between adjacent outer shell member portions 14. End portions of outer shell member portions 14 and elastic body 12 are connected/fixed to each other. Consequently, effects similar to those of the bat shown in the aforementioned sixth embodiment or the seventh embodiment of the present invention can be attained. In other words, hollow portions 16 are so formed that a bending modulus of elasticity (force (load) necessary for causing bending deformation by a unit length) of outer shell member portions 14 is larger than a compression modulus of elasticity (force (load) necessary for compression by the unit length) of elastic body 12 in aforementioned bat 1, and hence impact force in collision with a ball is mainly used not for deformation of outer shell member portions 14 but for compressive deformation of elastic body 12. In a portion colliding with the ball, therefore, (outer shell member portions 14 hardly deform but) only elastic body 12 supporting outer shell member portions 14 compressively deforms, and the positions of outer shell member portion 14 so move to deviate from the positions before the hitting of the ball that deformation of the ball can be suppressed. Further, bending deformation of outer shell member members 14 so hardly takes place that breakage of portions bonded to elastic body 12 and the main body of elastic body 12 can be prevented.

While hollow portions 16 of elastic body 12 are formed to reach the outer peripheral surface of a hitting portion core 11 from the inner peripheral surfaces of outer shell member portions 14 in bat 1 shown in FIGS. 17 and 18, hollow portions 16 may be formed in elastic body 12, similarly to the case of bat 1 shown in FIG. 14. Alternatively, hollow portions 16 may be so formed that only either hitting portion core 11 or outer shell member portions 14 are exposed in hollow portions 16. Further, while hollow portions 16 may be formed under all outer shell member portions 14 as shown in FIGS. 17 and 18, hollow portions 16 may be formed only under partial ones of plurality of outer shell member portions 14.

While all of hollow portions 16 in bats 1 shown in the aforementioned fifth to eighth embodiments have been substantially identical in size to each other, the sizes of hollow portions 16 may be locally varied in hitting portion 3 of bat 1.

The specific gravity of elastic body 12 can be set to at least 0.15 and not more than 1.3, more preferably at least 0.25 and not more than 0.7. The aforementioned numerical range has been selected for the following reason: In other words, it becomes difficult to mold elastic body 12 if the specific gravity of elastic body 12 is smaller than 0.15, while it becomes difficult to set the gross mass and the barycentric position of the bat within practical ranges if the specific gravity exceeds 1.3. In consideration of moldability and repulsiveness of elastic body 12, further, the specific gravity is more preferably at least 0.25 and not more than 0.7.

The JIS C hardness of elastic body 12 can be set to at least 5 and not more than 85, more preferably at least 20 and not more than 80. The aforementioned numerical range has been selected for the following reason: In other words, it becomes difficult to mold elastic body 12 if the C hardness is less than 5, while such a defect results that the characteristics of an outer shell member 13 are damaged if the C hardness exceeds 85. In consideration of the moldability and the repulsiveness, further, the JIS C hardness of elastic body 12 is more preferably at least 25 and not more than 80.

As the thickness of elastic body 12 in the radial direction of bat 1 as to a baseball bat whose maximum diameter is not more than Φ70 mm, the thickness of aforementioned elastic body 12 can be set to at least 8 mm and not more than 19.2 mm, more preferably at least 10 mm and not more than 15 mm when the aforementioned JIS C hardness is at least 5 and not more than 20, similarly to the case of the aforementioned fifth embodiment. When the aforementioned JIS C hardness is in excess of 20 and not more than 50, the thickness of aforementioned elastic body 12 can be set to at least 6 mm and not more than 19.2 mm, more preferably at least 8 mm and not more than 15 mm. When the aforementioned JIS C hardness is in excess of 50 and not more than 85, the thickness of aforementioned elastic body 12 can be set to at least 4 mm and not more than 19.2 mm, more preferably at least 6 mm and not more than 15 mm. As to the numerical range of the aforementioned thickness, the reason for the decision thereof is basically identical to that in the case of the fifth embodiment.

In a case of a softball bat whose maximum diameter is not more than Φ57 mm, the thickness of elastic body 12 in the radial direction of bat 1 is preferably set as follows: More specifically, when the aforementioned JIS C hardness is at least 5 and not more than 20, the thickness can be set to at least 8 mm and not more than 12.7 mm, more preferably at least 10 mm and not more than 12 mm. When the aforementioned JIS C hardness is in excess of 20 and not more than 50, the thickness of aforementioned elastic body 12 can be set to at least 6 mm and not more than 12.7 mm, more preferably at least 8 mm and not more than 12 mm. When the aforementioned JIS C hardness is in excess of 50 and not more than 85, the thickness of aforementioned elastic body 12 can be set to at least 4 mm and not more than 12.7 mm, more preferably at least 6 mm and not more than 12 mm. The reason for the decision of the thickness of elastic body 12 in the case of the aforementioned softball bat is also similar to that in the case of the aforementioned baseball bat, except for the point that the maximum diameters of the bats are different from each other.

The lengths of contact portions between elastic body 12 and outer shell member portions 14 on the boundaries between adjacent outer shell member portions 14 in the extensional direction of bat 1 are preferably at least 10 mm and less than the lengths of outer shell member portions 14. The reason why such a numerical range has been selected is similar to that in the case of the aforementioned fifth embodiment.

The lengths of contact portions between elastic body 12 and outer shell member portions 14 on the boundaries between adjacent outer shell member portions 14 shown in FIG. 18 in the circumferential direction of the side surface of bat 1 are also preferably at least 10 mm and less than the lengths of outer shell member portions 14. The reason why such a numerical range has been selected is also similar to that in the case of the aforementioned fifth embodiment.

(Ninth Embodiment)

A ninth embodiment of the bat according to the present invention is described with reference to FIGS. 19 and 20.

Figure 19:
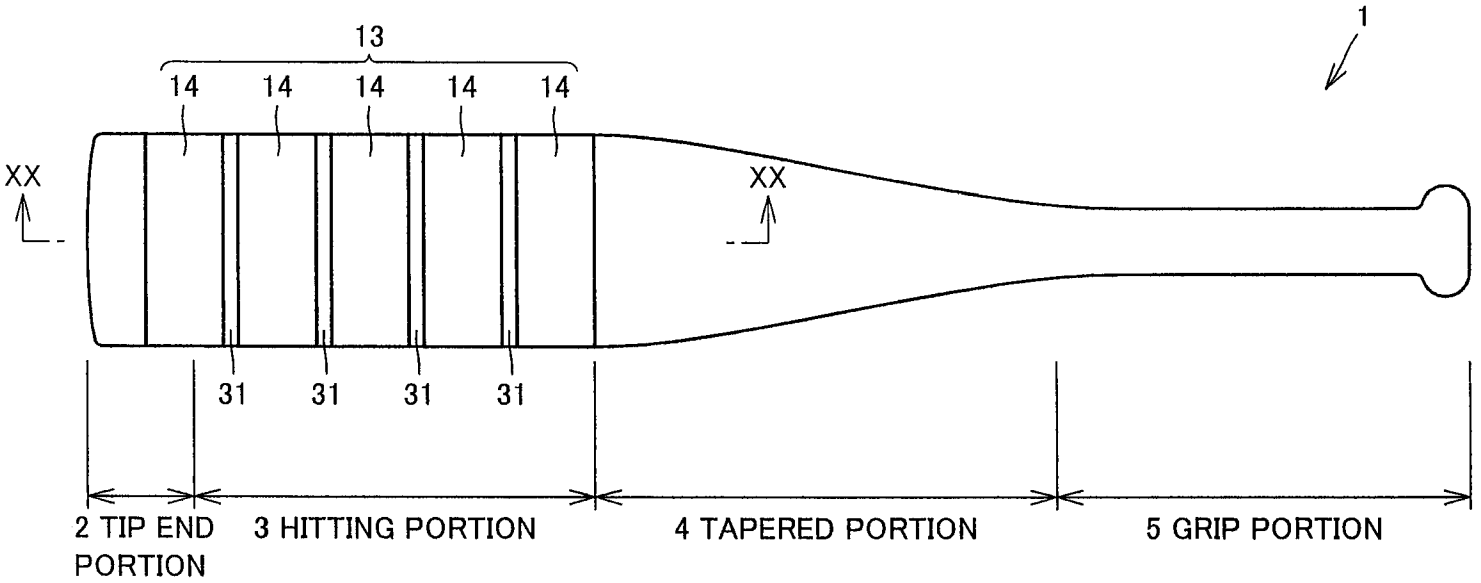
FIG. 19 is a partially fragmented schematic sectional view showing a ninth embodiment of the bat according to the present invention.
Figure 20:
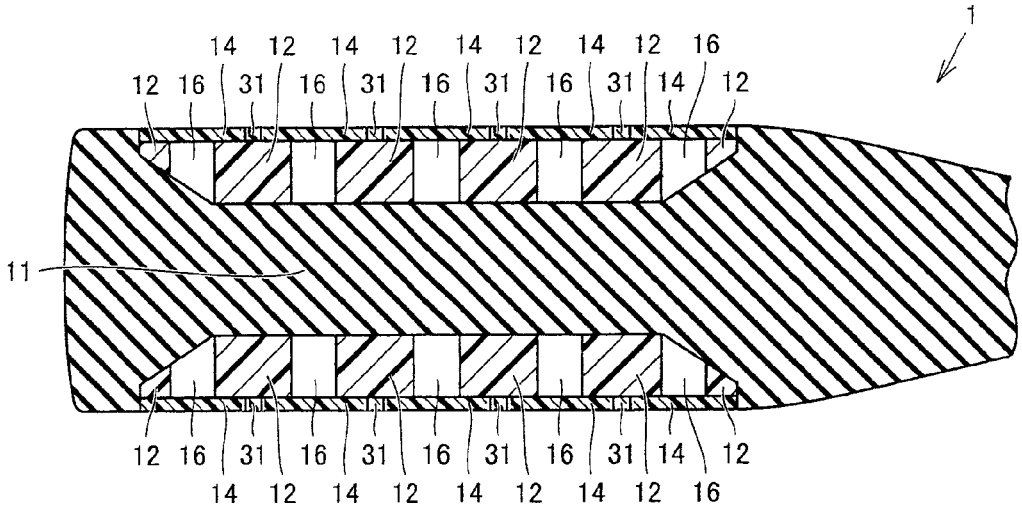
FIG. 20 is a partially fragmented schematic sectional view taken along the line segment XX-XX in FIG. 19.

While a bat 1 shown in FIGS. 19 and 20 basically has a structure similar to that of the bat shown in FIG. 14, a point that annular spacers 31 are arranged between outer shell member portions 14 is different. Such spacers 31 are so provided that occurrence of such a problem that outer shell member portions 14 directly come into contact with each other and the bat is broken in batting can be suppressed, in addition to the effect attained by the bat shown in FIG. 14. Similarly to bat 1 shown in FIG. 14, hollow portions 16 are so formed that a bending modulus of elasticity (force (load) necessary for causing bending deformation by a unit length) of outer shell member portions 14 is larger than a compression modulus of elasticity (force (load) necessary for compression by the unit length) of elastic body 12 in aforementioned bat 1, and hence impact force in collision with a ball is mainly used not for deformation of outer shell member portions 14 but for compressive deformation of an elastic body 12. In a portion colliding with the ball, therefore, (outer shell member portions 14 hardly deform but) only elastic body 12 supporting outer shell member portions 14 compressively deforms, and the central axis of outer shell member portion 14 so moves to deviate from the central axes of other outer shell portion members 14 (i.e., the central axis of a core of the bat) that deformation of the ball can be suppressed. Further, bending deformation of outer shell member members 14 so hardly takes place that breakage of portions bonded to elastic body 12 and the main body of elastic body 12 can be prevented.

While aforementioned annular spacers 31 may be employed as spacers 31, arbitrary shapes can be employed if direct contact between outer shell member portions 14 can be suppressed. For example, arcuate spacers 31 may be intermittently arranged on a plurality of portions of the circumference of bat 1. As the material for spacers 31, an arbitrary material can be employed so far as the same is a material whose hardness is lower than that of the material for outer shell member portions 14.

The specific gravity of elastic body 12 can be set to at least 0.15 and not more than 1.3, more preferably at least 0.25 and not more than 0.7. The aforementioned numerical range has been selected for the following reason: In other words, it becomes difficult to mold elastic body 12 if the specific gravity of elastic body 12 is smaller than 0.15, while it becomes difficult to set the gross mass and the barycentric position of the bat within practical ranges if the specific gravity exceeds 1.3. In consideration of moldability and repulsiveness of elastic body 12, further, the specific gravity is more preferably at least 0.25 and not more than 0.7.

The JIS C hardness of elastic body 12 can be set to at least 5 and not more than 85, more preferably at least 20 and not more than 80. The aforementioned numerical range has been selected for the following reason: In other words, it becomes difficult to mold elastic body 12 if the C hardness is less than 5, while such a defect results that the characteristics of an outer shell member 13 are damaged if the C hardness exceeds 85. In consideration of the moldability and the repulsiveness, further, the JIS C hardness of elastic body 12 is more preferably at least 25 and not more than 80.

As the thickness of elastic body 12 in the radial direction of bat 1 as to a baseball bat whose maximum diameter is not more than Φ70 mm, the thickness of aforementioned elastic body 12 can be set to at least 8 mm and not more than 19.2 mm, more preferably at least 10 mm and not more than 15 mm when the aforementioned JIS C hardness is at least 5 and not more than 20, similarly to the case of the aforementioned fifth embodiment. When the aforementioned JIS C hardness is in excess of 20 and not more than 50, the thickness of aforementioned elastic body 12 can be set to at least 6 mm and not more than 19.2 mm, more preferably at least 8 mm and not more than 15 mm. When the aforementioned JIS C hardness is in excess of 50 and not more than 85, the thickness of aforementioned elastic body 12 can be set to at least 4 mm and not more than 19.2 mm, more preferably at least 6 mm and not more than 15 mm. As to the numerical range of the aforementioned thickness, the reason for the decision thereof is basically identical to that in the case of the fifth embodiment.

In a case of a softball bat whose maximum diameter is not more than Φ57 mm, the thickness of elastic body 12 in the radial direction of bat 1 is preferably set as follows: More specifically, when the aforementioned JIS C hardness is at least 5 and not more than 20, the thickness can be set to at least 8 mm and not more than 12.7 mm, more preferably at least 10 mm and not more than 12 mm. When the aforementioned JIS C hardness is in excess of 20 and not more than 50, the thickness of aforementioned elastic body 12 can be set to at least 6 mm and not more than 12.7 mm, more preferably at least 8 mm and not more than 12 mm. When the aforementioned JIS C hardness is in excess of 50 and not more than 85, the thickness of aforementioned elastic body 12 can be set to at least 4 mm and not more than 12.7 mm, more preferably at least 6 mm and not more than 12 mm. The reason for the decision of the thickness of elastic body 12 in the case of the aforementioned softball bat is also similar to that in the case of the aforementioned baseball bat, except for the point that the maximum diameters of the bats are different from each other.

The lengths of contact portions between elastic body 12 and outer shell member portions 14 on the boundaries between adjacent outer shell member portions 14 in the extensional direction of bat 1 are preferably at least 10 mm and less than the lengths of outer shell member portions 14. The reason why such a numerical range has been selected is similar to that in the case of the aforementioned fifth embodiment.

(Tenth Embodiment)

A tenth embodiment of the bat according to the present invention is described with reference to FIGS. 21 and 22.

Figure 21:
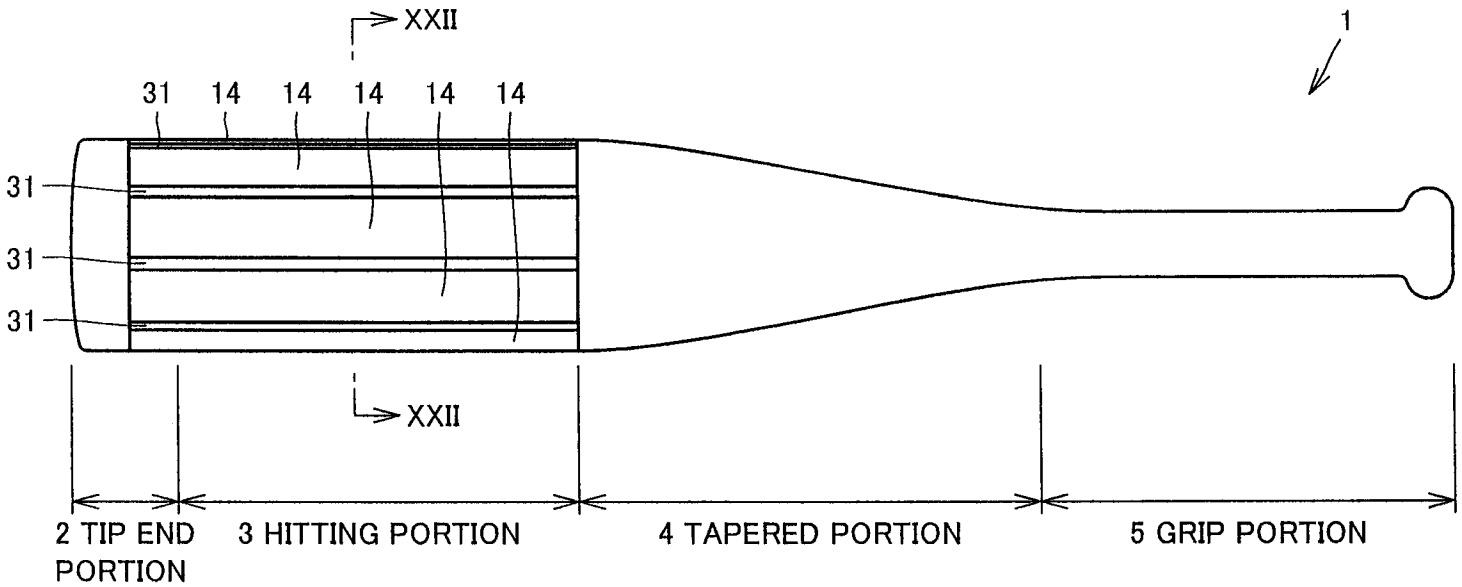
FIG. 21 is a schematic diagram showing a tenth embodiment of the bat according to the present invention.
Figure 22:
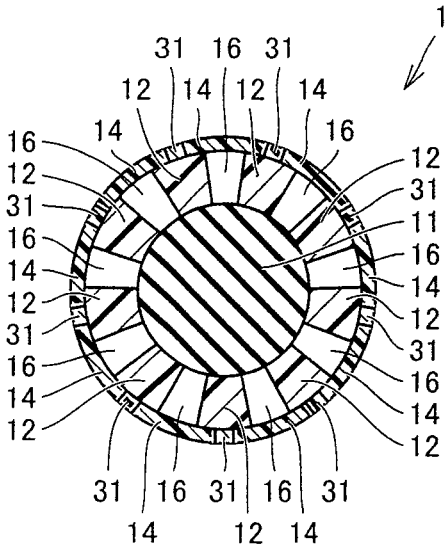
FIG. 22 is a schematic sectional view taken along the line segment XXII-XXII in FIG. 21.

While a bat 1 shown in FIGS. 21 and 22 basically has a structure similar to that of bat 1 shown in FIG. 15, a point that spacers 31 are arranged between outer shell member portions 14 is different. Spacers 31 are arranged to extend along the direction where the central axis of bat 1 extends. Such spacers 31 are so arranged that a possibility that adjacent outer shell member portions 14 directly come into contact and break can be reduced, in addition to the effect attained by the bat shown in FIG. 15.

While aforementioned linear spacers 31 may be employed as spacers 31, arbitrary shapes can be employed if direct contact between outer shell member portions 14 can be suppressed. For example, one or a plurality of linear spacers 31 shorter than the length of a hitting portion 3 may be arranged in clearances between outer shell member portions 14 at intervals in the direction along the central axis of bat 1. As the material for spacers 31, an arbitrary material can be employed so far as the same is a material whose hardness is lower than that of the material for outer shell member portions 14, similarly to the case of bat 1 shown in FIGS. 19 and 20.

(Eleventh Embodiment)

An eleventh embodiment of the bat according to the present invention is described with reference to FIGS. 23 and 24.

Figure 23:
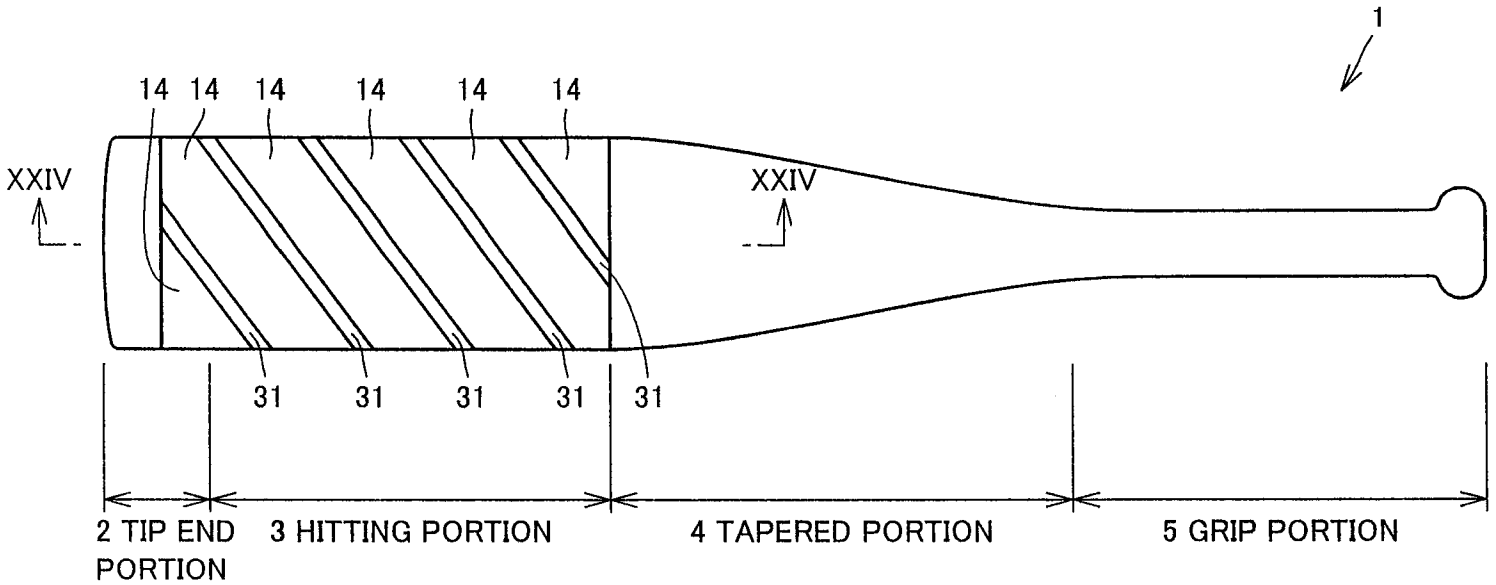
FIG. 23 is a schematic diagram showing an eleventh embodiment of the bat according to the present invention.
Figure 24:
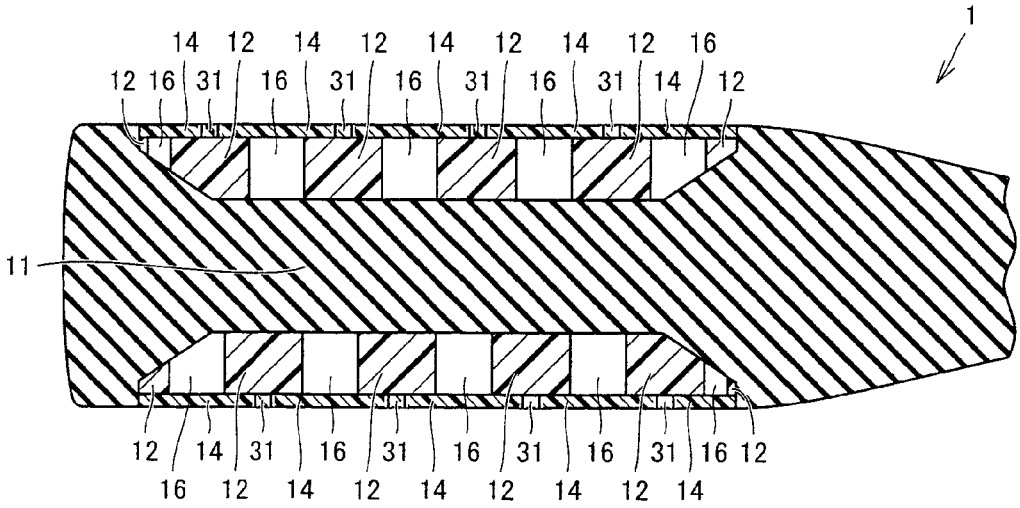
FIG. 24 is a partially fragmented schematic sectional view taken along the line segment XXIV-XXIV in FIG. 23.

While the bat shown in FIGS. 23 and 24 basically has a structure similar to that of the bat shown in FIG. 16, a point that spacers 31 are arranged between adjacent outer shell member portions 14 is different. Spacers 31 are arranged to spirally extend along outer shell member portions 14. With such a bat 1, a possibility that outer shell member portions 14 directly come into contact with each other and break can be reduced by spacers 31, in addition to the effect attained by the bat shown in FIG. 16.

While aforementioned spiral spacers 31 may be employed as spacers 31, arbitrary shapes can be employed if direct contact between outer shell member portions 14 can be suppressed. For example, one or a plurality of curved spacers 31 shorter than the lengths of the boundaries between adjacent outer shell member portions 14 may be arranged in clearances between outer shell member portions 14 at intervals in a direction along the boundaries. As the material for spacers 31, an arbitrary material can be employed so far as the same is a material whose hardness is lower than that of the material for outer shell member portions 41, similarly to the case of bat 1 shown in FIGS. 19 and 20.

(Twelfth Embodiment)

A twelfth embodiment of the bat according to the present invention is described with reference to FIG. 25.

Figure 25:
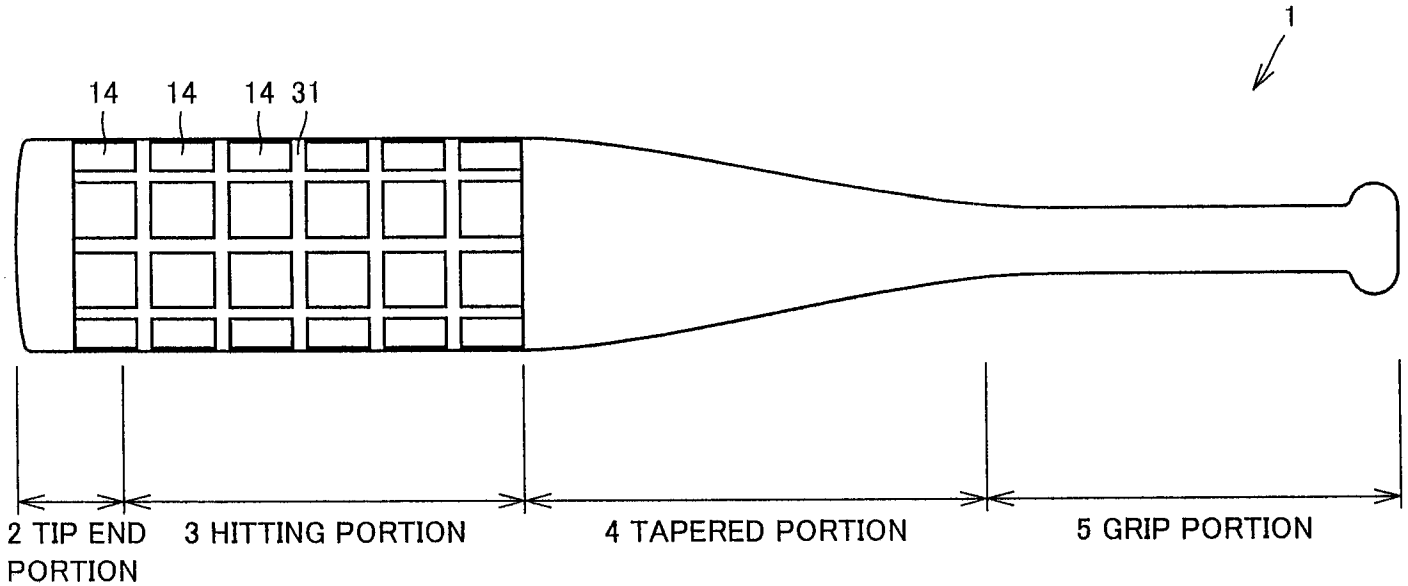
FIG. 25 is a schematic diagram showing a twelfth embodiment of the bat according to the present invention.

While a bat 1 shown in FIG. 25 basically has a structure similar to that of the bat shown in FIGS. 17 and 18, a point that spacers 31 are arranged between outer shell member portions 14 is different. Consequently, a possibility that adjacent outer shell member portions 14 directly come into contact with each other can be reduced, in addition to the effect attained by the bat shown in FIGS. 17 and 18.

While latticelike spacers 31 shown in FIG. 25 may be employed as spacers 31, arbitrary shapes can be employed so far as direct contact between outer shell member portions 14 can be suppressed. For example, one or a plurality of linear spacers 31 shorter than the lengths of the boundaries between adjacent outer shell member portions 14 may be arranged in clearances between outer shell member portions 14 at intervals in a direction along the boundaries. As the material for spacers 31, an arbitrary material can be employed so far as the same is a material whose hardness is lower than that of the material for outer shell member portions 14, similar to the case of bat 1 shown in FIGS. 19 and 20.

While the cases where hollow portions 16 are formed as elastic bodies 12 are shown in the aforementioned ninth to twelfth embodiments, solid elastic bodies 12 shown in the first to fourth embodiments may be employed as the elastic bodies.

(Thirteenth Embodiment)

A thirteenth embodiment of the bat according to the present invention is described with reference to FIG. 26.

Figure 26:
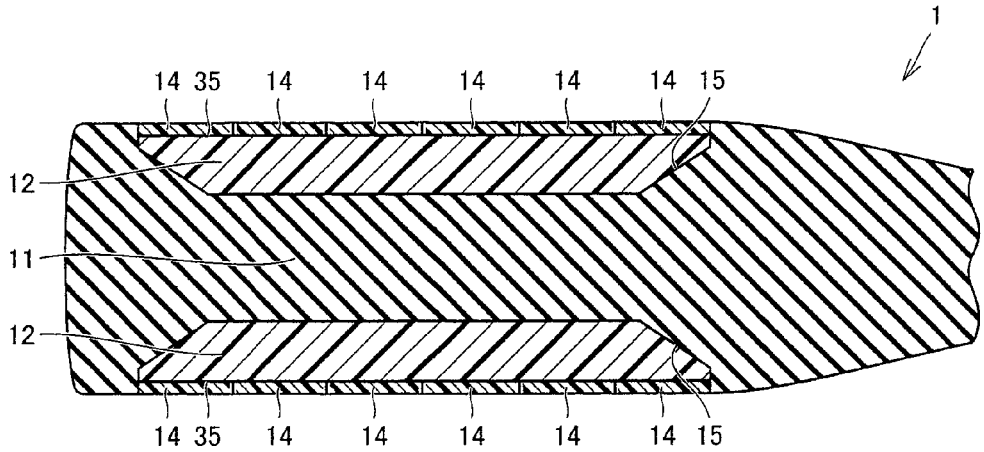
FIG. 26 is a partially fragmented schematic sectional view showing a thirteenth embodiment of the bat according to the present invention.

While the bat shown in FIG. 26 basically has a structure similar to that of the bat shown in FIGS. 1 to 3, a point that the inner peripheral surfaces of outer shell member portions 14 and the outer peripheral surface of an elastic body 12 are not fixed to each other is different. In other words, outer shell member portions 14 are relatively movable with respect to elastic body 12 independently of each other in the bat shown in FIG. 26. Also according to such structure, effects similar to those of the bat shown in FIGS. 1 to 3 can be attained. Further, only outer shell member portion 14 with which a ball has collided so rotates that the batting position can be specified, whereby whether or not the batter has hit the ball on the meat of bat 1 can be easily determined when employing the aforementioned bat according to the present invention for a batting practice.

Outer shell member portions 14 are arranged on positions where the inner peripheral surfaces of outer shell member portions 14 are closer to the center of bat 1 than an end portion on a sidewall of a recess 15 formed in a hitting portion core 11. From a different point of view, a surface 35 of elastic body 12 is arranged on a position closer to the center of bat 1 than the upper end of the sidewall of recess 15.

While FIG. 26 has been described with reference to bat 1 employing cylindrical outer shell member portions 14 in the first embodiment of the present invention shown in FIGS. 1 to 3, the aforementioned structure (the structure that outer shell member portions 14 are relatively movable with respect to elastic body 12 independently of each other) may be employed in the bat shown in the third, fifth, seventh, ninth or eleventh embodiment. In bat 1 shown in the second, fourth, sixth, eighth, tenth or twelfth embodiment, partial outer shell member portions 14 (partial outer peripheral portions, for example) may be connected/fixed to elastic body 12 so that the remaining portions (portions not connected/fixed to elastic body 12) of outer shell member portions 14 are deformable independently of elastic body 12 (relatively with respect to elastic body 12).

(Fourteenth Embodiment)

Figure 27:
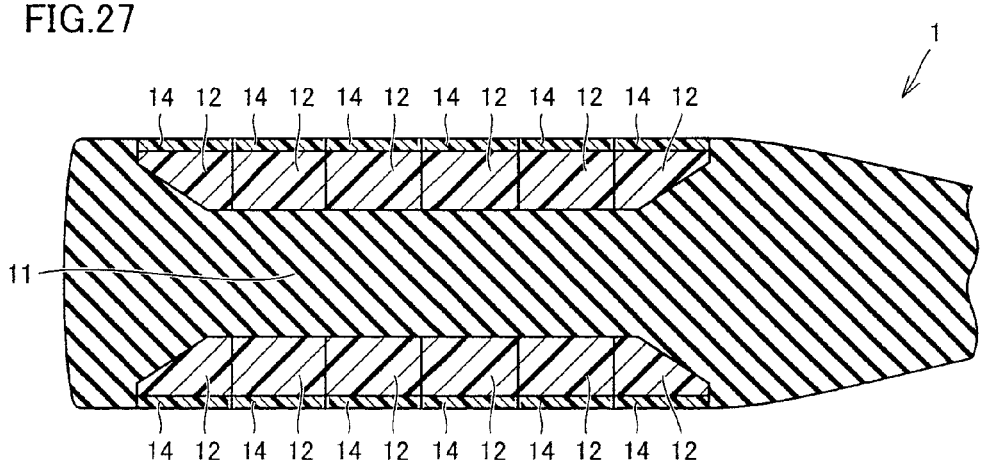
FIG. 27 is a partially fragmented schematic sectional view showing a fourteenth embodiment of the bat according to the present invention.

A fourteenth embodiment of the bat according to the present invention is described with reference to FIG. 27. FIG. 27 corresponds to FIG. 3.

While the bat shown in FIG. 27 basically has a structure similar to that of the bat shown in FIGS. 1 to 3, a point that an elastic body 12 is divided into a plurality of members in response to the widths of outer shell member portions 14 is different. Thus, effects similar to those of the bat shown in FIGS. 1 to 3 can be attained, while plurality of elastic body members 12 are independently deformable respectively, whereby repulsiveness of the bat can be further improved. The inner peripheral surfaces of outer shell member portions 14 and the outer peripheral surface of elastic body 12 may be fixed to each other, or outer shell member portions 14 may be freely relatively movable (or deformable) with respect to elastic body 12.

While FIG. 27 has been described with reference to bat 1 employing cylindrical outer shell member portions 14 in the first embodiment of the present invention shown in FIGS. 1 to 3, the aforementioned structure (the structure that elastic body 12 is divided into the plurality of members in response to the widths of outer shell member portions 14) may be employed in the bats shown in the second to twelfth embodiments.

(Fifteenth Embodiment)

Figure 28:
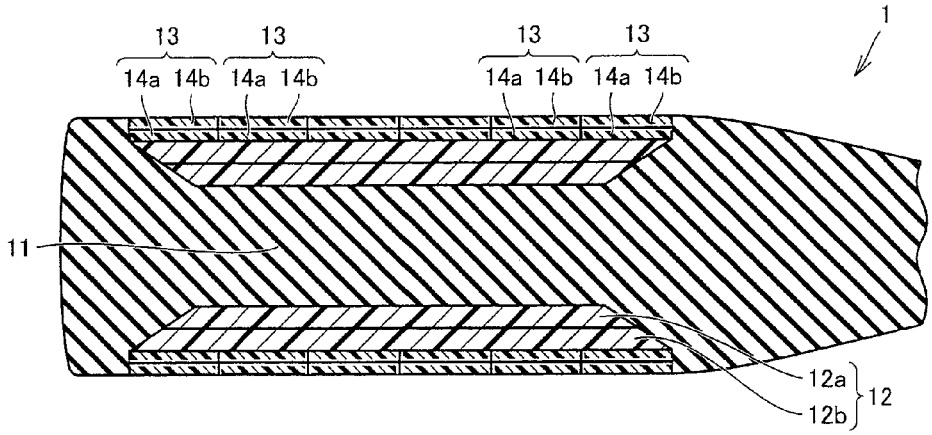
FIG. 28 is a partially fragmented schematic sectional view showing a fifteenth embodiment of the bat according to the present invention.

A fifteenth embodiment of the bat according to the present invention is described with reference to FIG. 28. FIG. 28 corresponds to FIG. 3.

While a bat 1 shown in FIG. 28 basically has a structure similar to that of the bat shown in FIGS. 1 to 3, the structures of an elastic body and an outer shell member 13 are different. In other words, an elastic body 12 has a multilayer structure in the bat shown in FIG. 28. More specifically, elastic body 12 is constituted of an elastic body 12*a* on the inner peripheral side and an elastic body 12*b* on the outer peripheral side. The number of the layers constituting the multilayer structure of elastic body 12 may be set to at least three. Elastic body 12*a* on the inner peripheral side and elastic body 12*b* on the outer peripheral side constituting elastic body 12 may be made of materials having characteristics different from each other. In other words, the plurality of layers may have characteristics different from each other (different materials, or different densities, for example). Elastic bodies 12*a* and 12*b* may be fixed to each other, or may be relatively movable with respect to each other.

Each outer shell member portion 14 also has a multilayer structure. More specifically, outer shell member portion 14 is constituted of two layers, i.e., an outer shell member portion 14*a* on the inner peripheral side and an outer shell member portion 14*b* on the outer peripheral side in the bat shown in FIG. 28. The number of the layers constituting outer shell member portion 14 may be set to at least three. As to the materials for outer shell member portions 14*a* and 14*b* of the respective layers constituting outer shell member portion 14, materials different from each other may be employed. Outer shell member portions 14*a* and 14*b* may be fixed to each other, or may be relatively movable with respect to each other.

Elastic bodies 12*a* and 12*b* may also be fixed to each other, or may be relatively movable with respect to each other.

Also according to the bat having such a structure, effects similar to those of the bat shown in FIGS. 1 to 3 can be attained. Further, elastic body 12 and outer shell member portion 14 are brought into the multilayer structures respectively, whereby the degree of freedom in design for varying the materials with the respective layers constituting the multilayer structures can be increased.

Only either elastic body 12 or outer shell member portion 14 may be brought into the multilayer structure. Further, the aforementioned structure of bringing elastic body 12 and/or outer shell member portion 14 into the multilayer structure may be applied to the bat according to any of the already described first to fourteenth embodiments of the present invention.

(Sixteenth Embodiment)

A sixteenth embodiment of the bat according to the present invention is described with reference to FIGS. 29 and 30.

Figure 29:
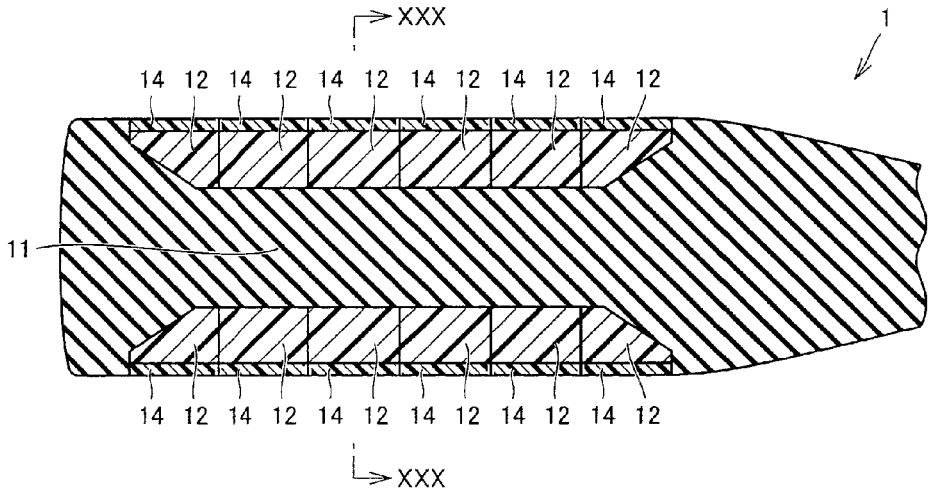
FIG. 29 is a partially fragmented schematic sectional view showing a sixteenth embodiment of the bat according to the present invention.
Figure 30:
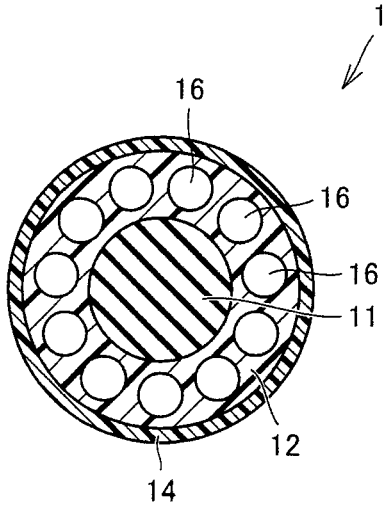
FIG. 30 is a schematic sectional view taken along the line segment XXX-XXX in FIG. 29.

While the bat shown in FIGS. 29 and 30 basically has a structure similar to that of the bat shown in FIG. 27, the structure of an elastic body 12 is different. More specifically, elastic body 12 is provided with hollow portions 16 in the bat shown in FIGS. 29 and 30. While hollow portions 16 may have circular shapes as viewed from a direction where the central axis of the bat extends as shown in FIG. 30, for example, other shapes may be employed. According to such a structure, hollow portions 16 are so formed that elastic body 12 is easily deformable, whereby the material for elastic body 12 can be prepared from a material having higher hardness (i.e., higher strength).

Such elastic body 12 prepared by forming hollow portions 16 in hard resin may be applied to bat 1 described with reference to any of the first to fifteenth embodiments.

(Seventeenth Embodiment)

A seventeenth embodiment of the bat according to the present invention is described with reference to FIG. 31.

Figure 31:
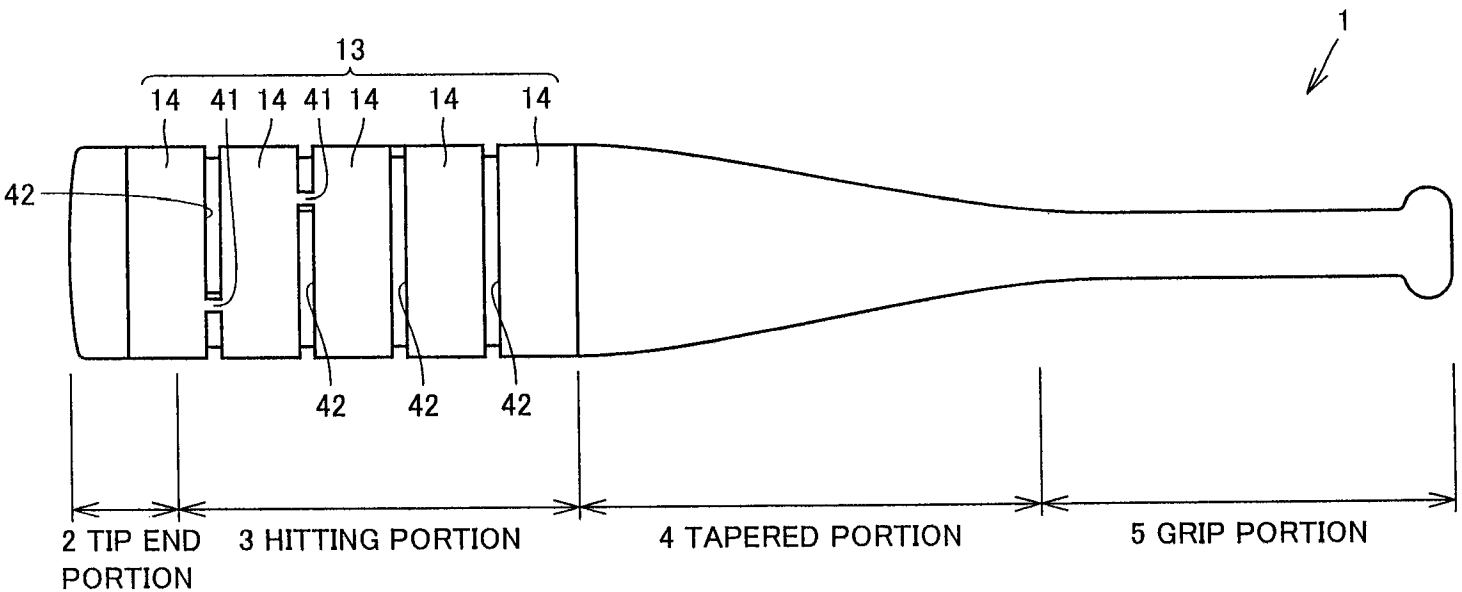
FIG. 31 is a schematic diagram showing a seventeenth embodiment of the bat according to the present invention.

While a bat 1 shown in FIG. 31 basically has a structure similar to that the bat shown in FIGS. 1 to 3, the structure of an outer shell member 13 is different. In other words, outer shell member 13 is constituted of outer shell member portions 14 partitioned by slits 42 in bat 1 shown in FIG. 31. Adjacent outer shell member portions 14 are connected to each other on connected portions 41. In other words, slits 42 are formed to extend while leaving connected portions 41 in the circumferential direction of bat 1. Also according to bat 1 having such a structure, effects similar to those of bat 1 shown in FIGS. 1 to 3 can be attained. In other words, outer shell member portions 14 partitioned by such large slits 42 are deformable independently of each other. When hitting a ball with bat 1, therefore, outer shell member portion 14 with which the ball has collided is easily deformable. Consequently, the carry of the ball can be elongated by suppressing deformation of the ball in the hitting and reducing energy loss, similarly to bat 1 shown in FIGS. 1 to 3.

(Eighteenth Embodiment)

An eighteenth embodiment of the bat according to the present invention is described with reference to FIG. 32.

Figure 32:
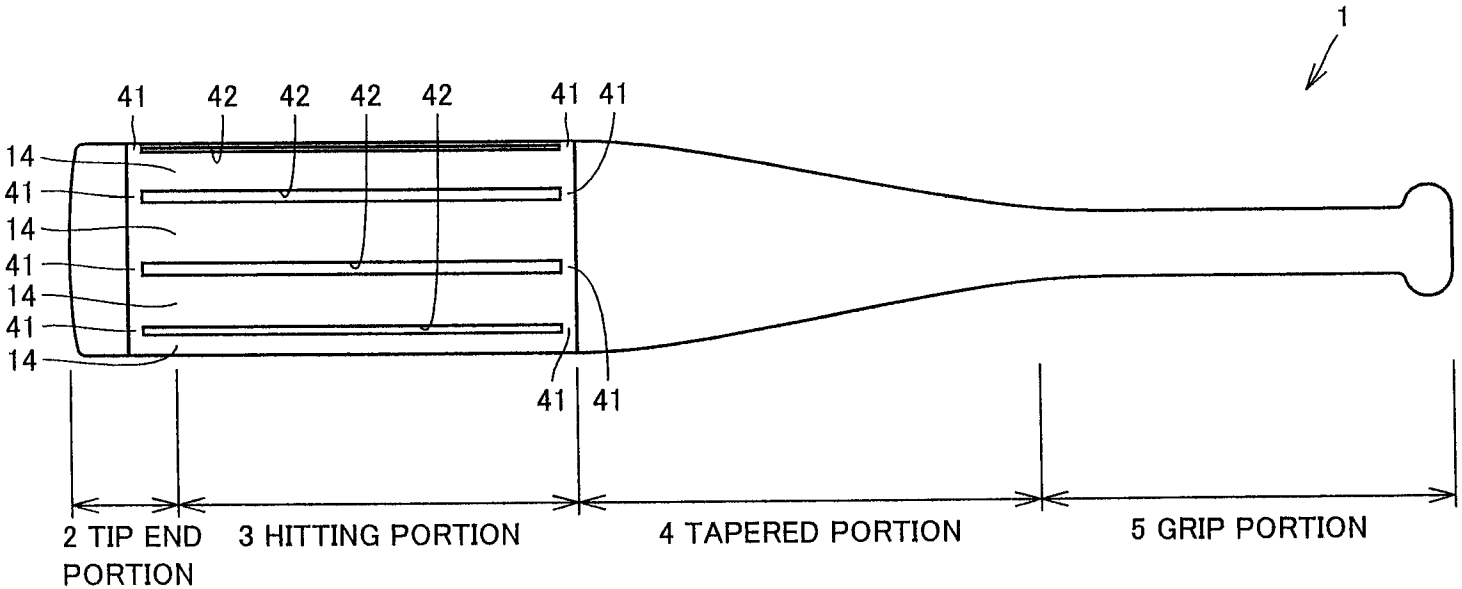
FIG. 32 is a schematic diagram showing an eighteenth embodiment of the bat according to the present invention.

While a bat 1 shown in FIG. 32 basically has a structure similar to that of the bat shown in FIGS. 6 to 8, outer shell member portions 14 constituting an outer shell member 13 are connected with each other on connected portions 41 located on both end portions of a hitting portion 3 on the side of a tip end portion 2 and on the side of a tapered portion 4. From a different point of view, a plurality of slits 42 extending in the direction where the central axis of bat 1 extends are formed in outer shell member 13, and outer shell member portions 14 are partitioned by the slits. The lengths of slits 42 are smaller than the length of outer shell member 13 in the direction along the central axis of bat 1. Therefore, it follows that slits 42 are not formed but connected portions 41 are arranged on end portions of slits 42 on the side of a grip portion 5 of bat 1 and end portions on the side of tip end portion 2. Also according to bat 1 having such a structure, effects similar to those of the bat shown in FIG. 6 can be attained.

(Nineteenth Embodiment)

A nineteenth embodiment of the bat according to the present invention is described with reference to FIG. 33.

Figure 33:
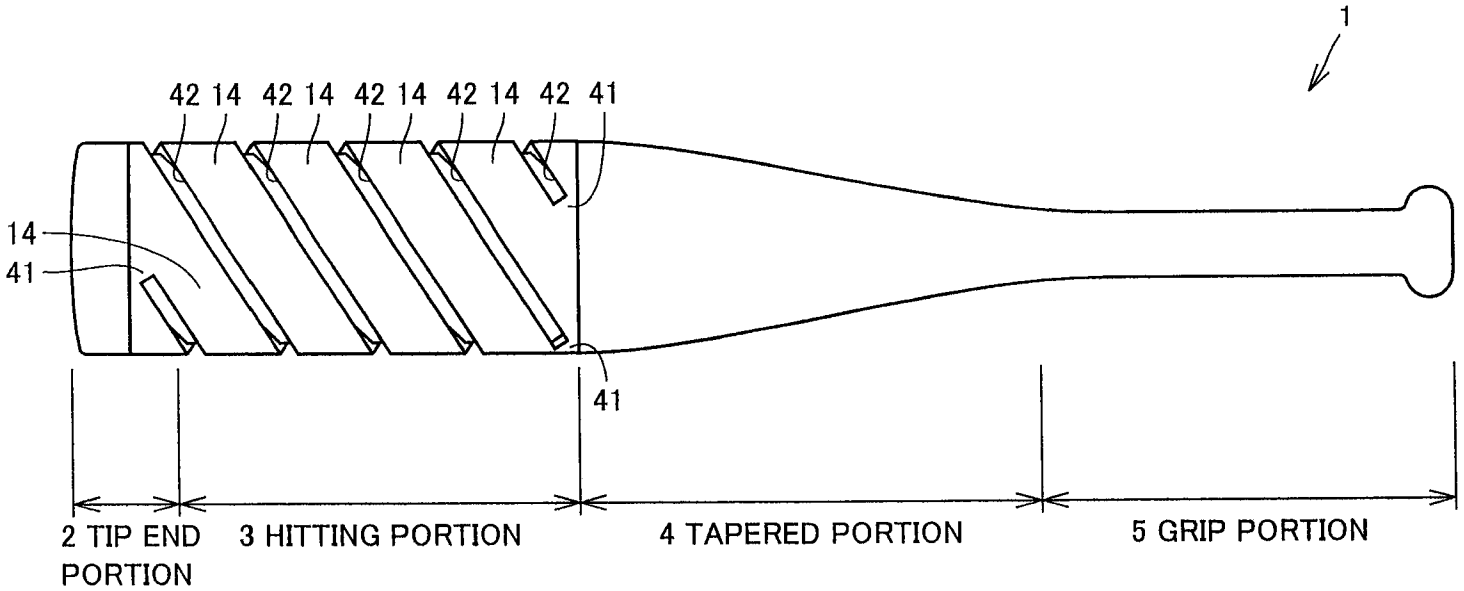
FIG. 33 is a schematic diagram showing a nineteenth embodiment of the bat according to the present invention.

Referring to FIG. 33, while a bat 1 basically has a structure similar to that of the bat shown in FIG. 9, a point that outer shell member portions 14 in an outer shell member 13 are partitioned by a spirally extending slit 42 is different. Connected portions 41 which are portions where slit 42 is not formed are arranged on both end portions of slit 42 (both end portions of a hitting portion 3 on the side of a tip end portion 2 and on the side of a tapered portion 4). Consequently, adjacent outer shell member portions 14 are connected with each other on connected portions 41. Also in bat 1 having such a structure, effects similar to those of the bat shown in FIG. 9 can be attained.

(Twentieth Embodiment)

A twentieth embodiment of the bat according to the present invention is described with reference to FIG. 34.

Figure 34:
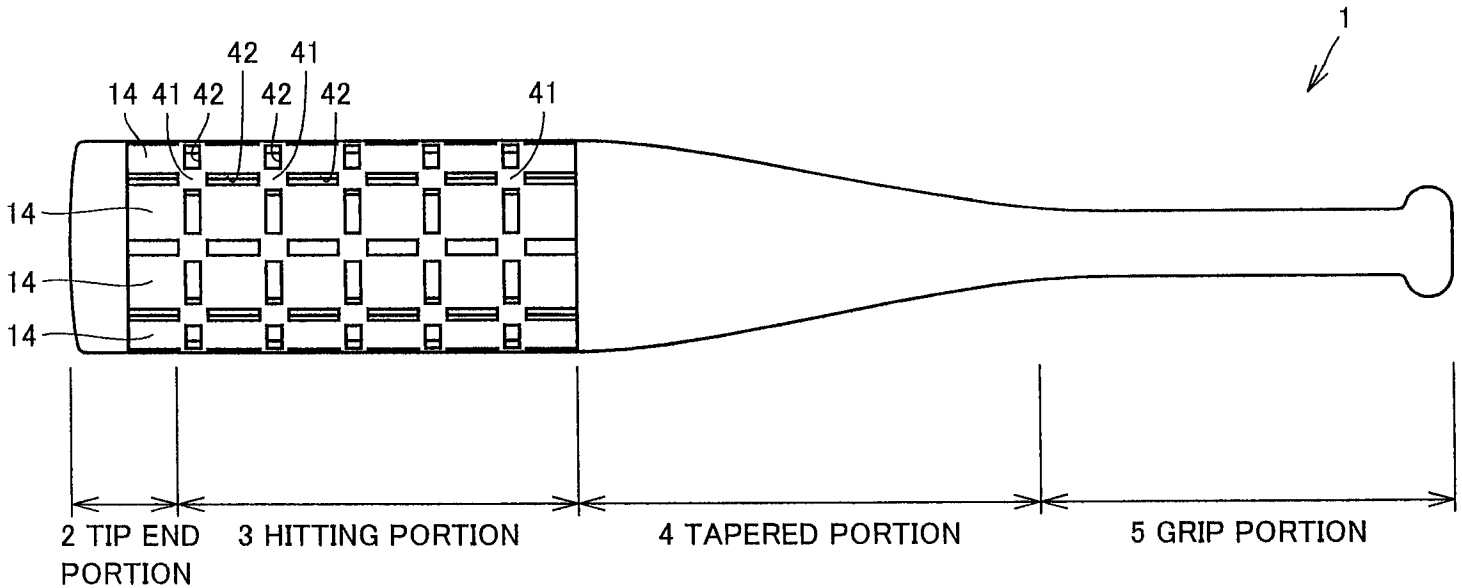
FIG. 34 is a schematic diagram showing a twentieth embodiment of the bat according to the present invention.

While a bat 1 shown in FIG. 34 basically has a structure similar to that of the bat shown in FIGS. 11 to 13, a point that outer shell member portions 14 constituting an outer shell member 13 are partitioned from each other by linear slits 42 is different. Adjacent outer shell member portions 14 are connected with each other on connected portions 41 which are portions not provided with slits 42. Consequently, outer shell member portions 14 are deformable independently of each other to some extent in outer shell member 13 while outer shell member 13 is one member as a whole. Also according to such bat 1, effects similar to those of the bat shown in FIGS. 11 to 13 can be attained.

Outer shell members 13 in bats 1 shown in the aforementioned seventeenth to twentieth embodiments may be applied to bats 1 shown in the fifth to sixteenth embodiments.

(Twenty-First Embodiment)

A twenty-first embodiment of the bat according to the present invention is described with reference to FIGS. 35 and 36.

Figure 35:
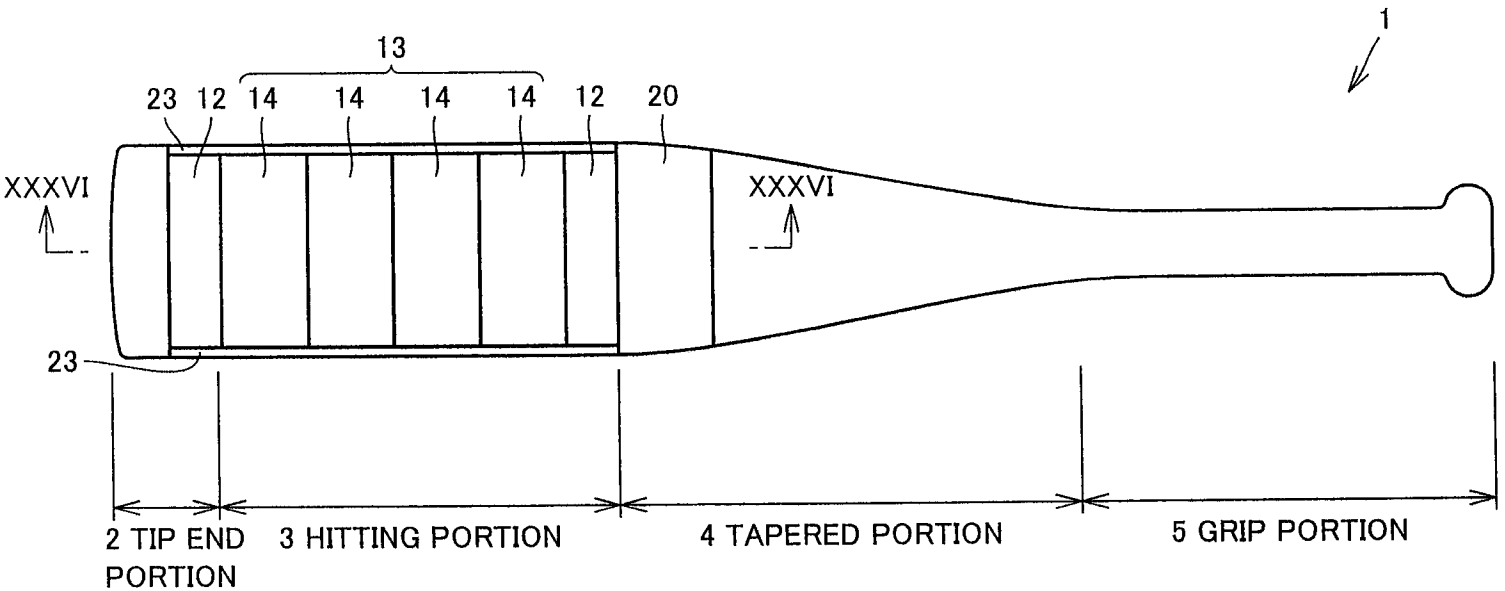
FIG. 35 is a schematic diagram showing a twenty-first embodiment of the bat according to the present invention.
Figure 36:
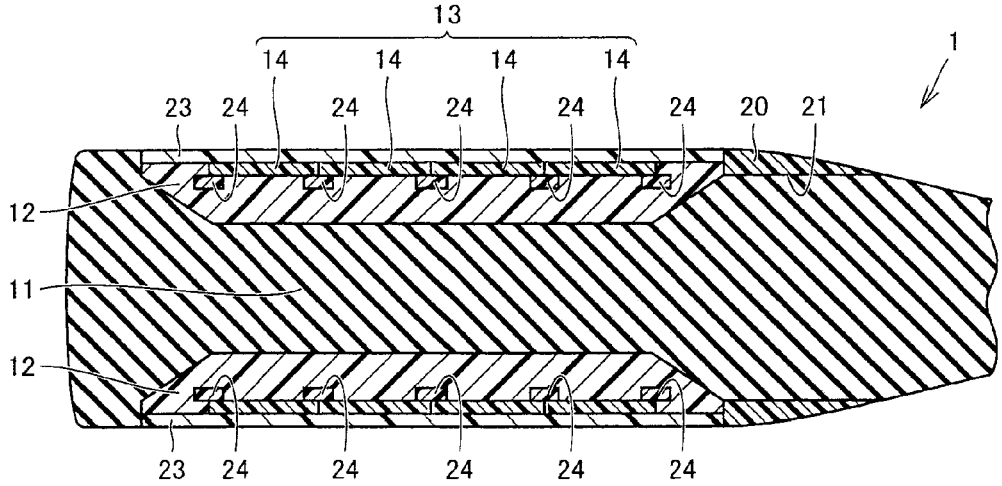
FIG. 36 is a partially fragmented schematic sectional view taken along the line segment XXXVI-XXXVI in FIG. 35.

While a bat 1 shown in FIGS. 35 and 36 basically has a structure similar to that of the bat shown in FIGS. 4 and 5, a point that the same includes a cover member 23 covering the outer peripheral side of an outer shell member 13 and reinforcing members 24 located on the boundaries between adjacent outer shell member portions 14 and arranged between outer shell member 13 and an elastic body 12 is different from bat 1 shown in FIGS. 4 and 5. Outer shell member 13 is shorter than the length of elastic body 12 in the extensional direction of bat 1 (the direction where the central axis of bat 1 extends). From a different point of view, cover member 23 is in contact with the outer peripheral surface of outer shell member 13, and also in contact with the surface of elastic body 12 in a region adjacent to outer shell member 13.

Also according to such bat 1, effects similar to those of the bat shown in FIGS. 4 and 5 can be attained. As understood from FIG. 36, outer shell member 13 is embedded in elastic body 12, and the outer peripheral surface of outer shell member 13 and the outer peripheral surface of elastic body 12 on the position adjacent to outer shell member 13 are substantially flush with each other. Outer shell member 13 is thus embedded in elastic body 12, whereby outer shell member 13 is arranged in a recess formed in elastic body 12. Therefore, the position of outer shell member 13 can be reliably fixed with respect to elastic body 12.

Cover member 23 and elastic body 12 may be connected/fixed to each other on contact portions thereof (regions adjacent to outer shell member 13). Cover member 23 and outer shell member 13 may also be connected/fixed to each other. As the fixing method for cover member 23 and elastic body 12 and the fixing method for cover member 23 and outer shell member 13, an arbitrary method can be employed. For example, a heat seal method or a method of providing bonding layers of an adhesive or the like on the connected portions can be employed. Such cover member 23 is so arranged that the durability of a hitting portion 3 can be improved.

Further, reinforcing members 24 are arranged under the boundaries (on the inner peripheral sides of the boundaries) between adjacent outer shell member portions 14 in outer shell member 13 and further under the outer peripheral end portion of outer shell member 13 (end portions of outer shell member portions 14), whereby occurrence of such a problem that the end portions of outer shell member portions 14 inroad into the surface of elastic body 12 and elastic body 12 breaks when outer shell member portions 14 deform can be suppressed. As reinforcing members 24, a material whose hardness is higher than that of elastic body 12 can be employed. While reinforcing members 24 have annular shapes along the side surface of bat 1, a plurality of reinforcing members may be arranged on the circumference at prescribed intervals along the aforementioned boundaries. While reinforcing members 24 are annular as described above, the same may partially lack (cee plane shapes).

Figure 37:
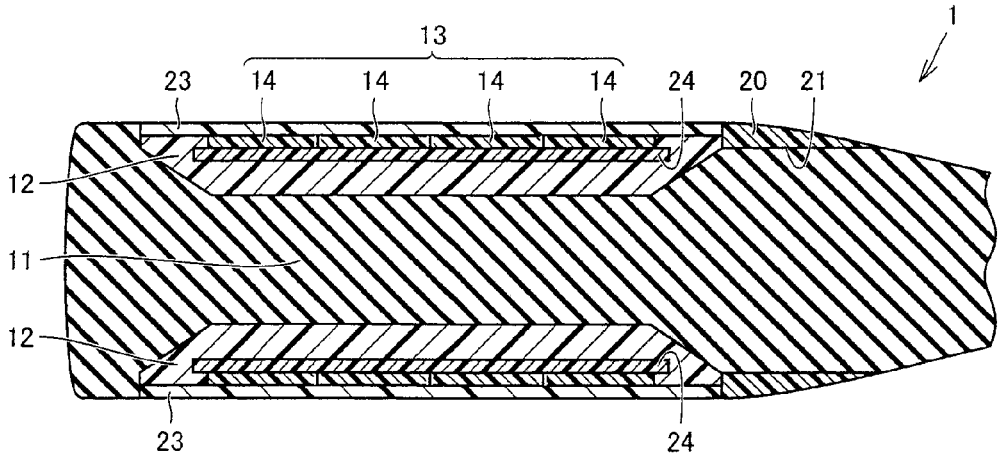
FIG. 37 is a partially fragmented schematic sectional view showing a modification of the bat shown in FIGS. 35 and 36.

A modification of the bat shown in FIGS. 35 and 36 is now described with reference to FIG. 37. While a bat 1 shown in FIG. 37 basically has a structure similar to that of bat 1 shown in FIGS. 35 and 36, the structure of a reinforcing member 24 is different from bat 1 shown in FIGS. 35 and 36. More specifically, reinforcing member 24 is arranged to cover the overall inner peripheral surface of an outer shell member 13 in bat 1 shown in FIG. 37. In the extensional direction of bat 1, further, end portions of reinforcing member 24 are positioned outward beyond end portions of outer shell member 13. From a different point of view, the length of reinforcing member 24 is larger than the length of outer shell member 13 in the extensional direction of bat 1. Also according to such a structure, effects similar to those of bat 1 shown in FIGS. 35 and 36 can be attained. Further, reinforcing member 24 is one member, whereby it is not necessary to carry out a step of arranging a plurality of reinforcing members 24 on decided positions in manufacturing steps for bat 1. Therefore, the manufacturing steps for bat 1 can be simplified as compared with bat 1 shown in FIGS. 35 and 36.

As the material for outer shell member portions 14, a metallic material, an FRP (fiber reinforced plastic) material, wood or a resin material may be employed. More preferably, an FRP material or a resin material (thermoplastic polyurethane resin, ether-based polyurethane resin, ester-based polyurethane resin, olefin-based resin, polyamide resin, ionomer resin, styrene-based resin, thermoplastic polyethylene, nylon, polyester, polycarbonate, polypropylene, ABS (acrylonitrile butadiene styrene) or vinyl chloride, for example) is used. Sufficient strength can be obtained with such a material, while the material has a low possibility of deforming in heat treatment or the like in manufacturing of the bat and is excellent in shape stability.

In a case of employing a metallic material, an FRP material or wood as the material for outer shell member portions 14, for example, the thicknesses (thicknesses in the radial direction of bat 1) of outer shell member portions 14 are preferably set as follows: In other words, in a case of baseball bat 1 whose maximum diameter is not more than Φ70 mm, the thicknesses of outer shell member portions 14 can be set to at least 0.8 mm and not more than 16 mm, more preferably at least 1.2 mm and not more than 13 mm. This is because occurrence of such a problem is apprehended that outer shell member portions 14 break in hitting of a ball if the thicknesses of outer shell member portions 14 are less than 0.8 mm. When outer shell member portions 14 are made of a metallic material, a possibility that outer shell member portions 14 deform due to the heat treatment in the manufacturing steps for bat 1 is also considerable if the thicknesses are less than 0.8 mm. As to the upper limit of the aforementioned thicknesses of outer shell member portions 14, the outer diameter of a hitting portion core 11 must be about 30 mm at the minimum in consideration of the strength of bat 1. In consideration of the minimum thickness of elastic body 12, the upper limit of the thicknesses of aforementioned outer shell member portions 14 is preferably set to 16 mm. In view of rendering the repulsiveness and the strength of the bat more preferable, the lower limit of the aforementioned thicknesses is more preferably set to 1.2 mm. In consideration of moldability or the like of bat 1, the upper limit of the aforementioned thicknesses is more preferably set to 13 mm.

In a case of a softball bat whose maximum diameter is not more than Φ57 mm, the thicknesses of outer shell member portions 14 can be set to at least 0.8 mm and not more than 9.5 mm, more preferably at least 1.2 mm and not more than 8 mm. The reason for the decision of the thicknesses of outer shell member portions 14 in the case of the aforementioned softball bat is also similar to that in the case of the aforementioned baseball bat, except for the point that the maximum diameters of the bats are different from each other.

In a case of employing a resin material as the material for outer shell member portions 14, the thicknesses of outer shell member portions 14 are preferably set as follows: In other words, the thicknesses of outer shell member portions 14 can be set to at least 1.5 mm and not more than 16 mm, more preferably at least 2.0 mm and not more than 14 mm in the base of baseball bat 1 whose maximum diameter is not more than Φ70 mm. The reason for deciding the aforementioned numerical range is as follows: In other words, when setting the thicknesses to less than 1 5 mm as to the lower limit of the thicknesses of outer shell member portions 14 made of such a resin material, the rigidity of outer shell member portions 14 themselves lowers (softens). Therefore, there is a possibility of exerting a bad influence on the repulsiveness of bat 1 or the batting feeling. As to the upper limit of the aforementioned thicknesses of outer shell member portions 14, the outer diameter of hitting portion core 11 must be about 30 mm at the minimum in consideration of the strength of bat 1. In consideration of the minimum thickness of elastic body 12 and the mass balance of the bat, the upper limit of the thicknesses of aforementioned outer shell member portions 14 is preferably set to 16 mm. In view of rendering the repulsiveness and the strength of the bat more preferable, the lower limit of the aforementioned thicknesses is more preferably set to 2.0 mm. In consideration of moldability or the like of bat 1, the upper limit of the aforementioned thicknesses is more preferably set to 14 mm.

In the case of the softball bat whose maximum diameter is not more than Φ57 mm, the thicknesses of outer shell member portions 14 can be set to at least 1.5 mm and not more than 9.5 mm, more preferably at least 2.0 mm and not more than 7.5 mm. The reason for the decision of the thickness of elastic body 12 in the case of the aforementioned softball bat is also similar to that in the case of the aforementioned baseball bat, except for the point that the maximum diameters of the bats are different from each other.

As to outer shell member portions 14 made of an arbitrary material, the widths of outer shell member portions 14 in the extensional direction of bat 1 can be set to at least 1 mm and not more than 90 mm, more preferably at least 10 mm and not more than 70 mm. The aforementioned numerical range has been selected for the following reason: In other words, movement (movement in the radial direction of bat 1) of outer shell member portions 14 in the hitting of the ball is simplified as the aforementioned widths of outer shell member portions 14 are reduced, and this is preferable in consideration of the performance of bat 1. If the widths of outer shell member portions 14 are reduced, however, a harmful influence in manufacturing of bat 1 arises (for example, production or an assembling operation of an outer shell member 13 is complicated). As to outer shell member portions 14, therefore, the lower limit is preferably set to 1 mm in order to prevent a harmful influence in the manufacturing. Also in a case of considering an operation of performing R chamfering (chamfering of about R0.5, for example) on end portions of outer shell member 14, the aforementioned lower limit of the widths of outer shell member portions 14 is preferably selected. If the widths of outer shell member portions 14 exceed 90 mm, on the other hand, outer shell member portions 14 hardly move in the radial direction of bat 1 in the hitting of the bat. Consequently, there is a possibility that the characteristics of bat 1 are not sufficiently exhibited. In consideration of manufacturability of bat 1 and further improvement of the characteristics, the widths of outer shell member portions 14 are more preferably set to at least 10 mm and not more than 70 mm.

The width of outer shell member 13 in the extensional direction of bat 1 may be set to at least 120 mm and not more than 350 mm, more preferably at least 150 mm and not more than 300 mm. The aforementioned numerical range has been selected for the following reason: In other words, in a case of considering deformation of a softball, a general size-A softball, for example, generally has a diameter of 72 mm, while the same so deforms upon hitting that the width exceeds 110 mm. Therefore, the width of outer shell member 13 as a hitting portion must have the aforementioned width of at least 120 mm. When setting the width of outer shell member 13 to exceed 350 mm, on the other hand, it becomes difficult to set the gross mass and the barycentric position of the bat in practical ranges.

As the materials for cover member 23 and reinforcing member 24, synthetic resin sheets or synthetic resin tubes can be employed, for example. In consideration of workability and bondability, the synthetic resin sheets or the synthetic resin tubes are preferably sheets or tubes of thermoplastic polyurethane or polyvinyl chloride having thicknesses of at least 0.1 mm and not more than 1.0 mm.

The aforementioned numerical range has been selected since the strength of aforementioned cover member 23 or reinforcing member 24 is insufficient and does not serve as a factor improving durability if the thicknesses are less than 0.1 mm. Further, this is because the hardness of the sheets or the tubes themselves comes into question thereby causing a defect such as that damaging the characteristics of outer shell member 13 if the thicknesses exceed 1.0 mm.

As the material for the aforementioned sheets or the tubes, a material having JIS A hardness of at least 80 and not more than 100 and tensile strength of at least 350 kg/cm$^2$ and not more than 500 kg/cm$^2$ is preferably used. In a case where the JIS A hardness of the aforementioned material is less than 80, the strength of the sheets or the tubes themselves is insufficient, and does not serve as a factor improving durability. If the JIS A hardness of the aforementioned material exceeds 100, such a defect is caused that the sheets or the tubes themselves bear hardness to damage the characteristics of outer shell member 13. The same also applies to tensile strength.

The specific gravity of elastic body 12 can be set to at least 0.15 and not more than 1.3, more preferably at least 0.2 and not more than 0.7. The aforementioned numerical range has been selected for the following reason: In other words, it becomes difficult to mold elastic body 12 if the specific gravity of elastic body 12 is smaller than 0.15, while it becomes difficult to set the gross mass and the barycentric position of the bat within practical ranges if the specific gravity exceeds 1.3. In consideration of moldability and repulsiveness of elastic body 12, further, the specific gravity is more preferably at least 0.25 and not more than 0.7.

The JIS C hardness of elastic body 12 can be set to at least 5 and not more than 85, more preferably at least 20 and not more than 80. The aforementioned numerical range has been selected for the following reason: In other words, it becomes difficult to mold elastic body 12 if the C hardness is less than 5, while such a defect results that the characteristics of an outer shell member 13 are damaged if the C hardness exceeds 85. In consideration of the moldability and the repulsiveness, further, the JIS C hardness of elastic body 12 is more preferably at least 25 and not more than 80.

As the thickness of elastic body 12 in the radial direction of bat 1 as to the baseball bat whose maximum diameter is not more than Φ70 mm, the thickness of aforementioned elastic body 12 can be set to at least 8 mm and not more than 19.2 mm, more preferably at least 10 mm and not more than 15 mm, when the aforementioned JIS C hardness is at least 5 and not more than 20. When the aforementioned JIS C hardness is in excess of 20 and not more than 50, the thickness of aforementioned elastic body 12 can be set to at least 6 mm and not more than 19.2 mm, more preferably at least 8 mm and not more than 15 mm. When the aforementioned JIS C hardness is in excess of 50 and not more than 85, the thickness of aforementioned elastic body 12 can be set to at least 4 mm and not more than 19.2 mm, more preferably at least 6 mm and not more than 15 mm.

In the case of the softball bat whose maximum diameter is not more than Φ57 mm, the thickness of elastic body 12 in the radial direction of bat 1 is preferably set as follows: More specifically, when the aforementioned JIS C hardness is at least 5 and not more than 20, the thickness can be set to at least 8 mm and not more than 12.7 mm, more preferably at least 10 mm and not more than 12 mm. When the aforementioned JIS C hardness is in excess of 20 and not more than 50, the thickness of aforementioned elastic body 12 can be set to at least 6 mm and not more than 12.7 mm, more preferably at least 8 mm and not more than 12 mm. When the aforementioned JIS C hardness is in excess of 50 and not more than 85, the thickness of aforementioned elastic body 12 can be set to at least 4 mm and not more than 12.7 mm, more preferably at least 6 mm and not more than 12 mm. The characteristics of aforementioned elastic body 12 are also applicable to elastic bodies 12 in other embodiments of the present invention.

(Twenty-Second Embodiment)

A twenty-second embodiment of the present invention is described with reference to FIG. 38.

Figure 38:
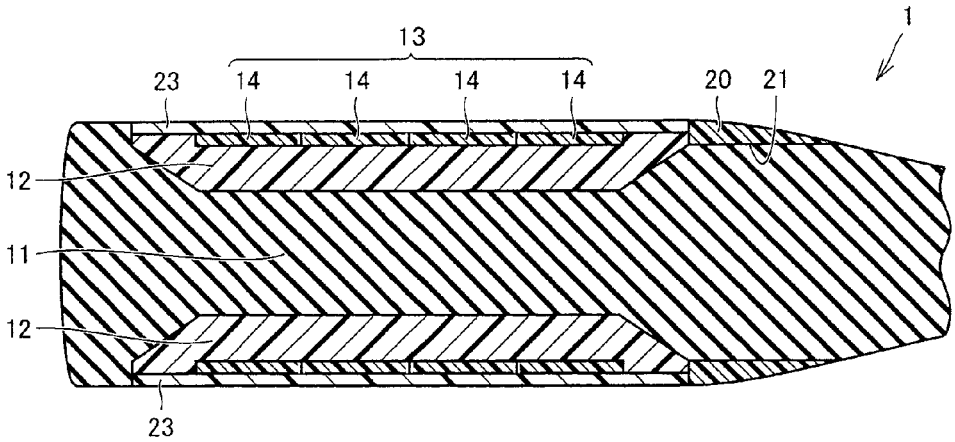
FIG. 38 is a partially fragmented schematic sectional view showing a twenty-second embodiment of the bat according to the present invention.

While a bat 1 shown in FIG. 38 basically has a structure similar to that of bat 1 shown in FIGS. 35 and 36, a point that reinforcing members 24 shown in FIG. 36 are not arranged is different from bat 1 shown in FIGS. 35 and 36. In bat 1 shown in FIG. 38, the inner peripheral surface of an outer shell member 13 is in contact with the outer peripheral surface of an elastic body 12 (the bottom surface of a recess formed in the outer peripheral side surface of elastic body 12). Also according to such a structure, effects similar to those of the bat shown in FIGS. 4 and 5 can be attained, similarly to bat 1 shown in FIGS. 35 and 36. Similarly to bat 1 shown in FIGS. 35 and 36, further, an effect resulting from arrangement of a cover member 23 and an effect resulting from outer shell member 13 arranged to be embedded in elastic body 12 can be attained. In addition, it is also possible to attain effects similar to those of bat 1 shown in FIGS. 35 and 36 by a countermeasure of properly selecting the material for elastic body 12 or performing chamfering (R chamfering or C chamfering, for example) on end portions of outer shell member portions 14.

(Twenty-Third Embodiment)

A twenty-third embodiment of the present invention is described with reference to FIG. 39.

Figure 39:
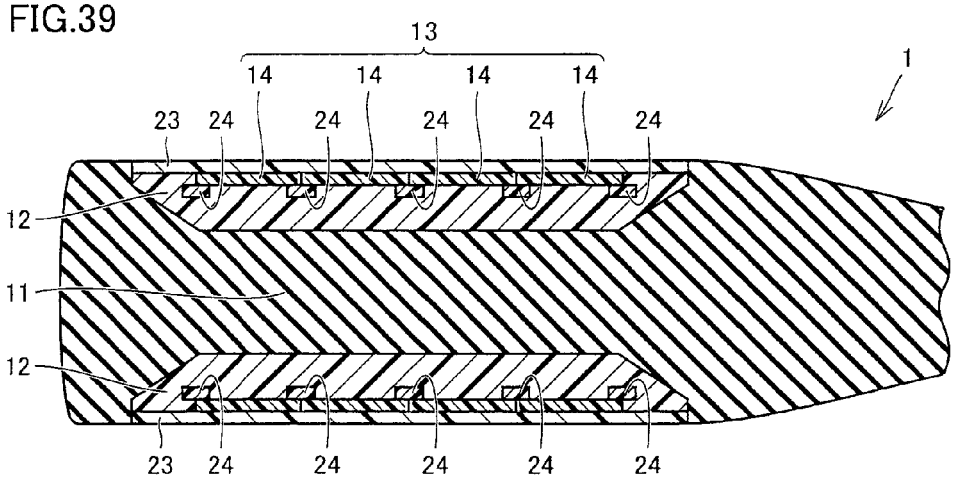
FIG. 39 is a partially fragmented schematic sectional view showing a twenty-third embodiment of the bat according to the present invention.

While a bat 1 shown in FIG. 39 basically has a structure similar to that of bat 1 shown in FIGS. 35 and 36, a point that a fixed member 20 shown in FIGS. 35 and 36 is not arranged is different from bat 1 shown in FIGS. 35 and 36. Also according to such a structure, effects other than the effect resulting from arrangement of fixed member 20 can be attained within the effects of bat 1 shown in FIGS. 35 and 36. Fixed member 20 (see FIG. 35) is not arranged in this manner, so that the number of components of bat 1 can be reduced and the manufacturing cost for bat 1 can be lowered.

(Twenty-Fourth Embodiment)

A twenty-fourth embodiment of the present invention is described with reference to FIG. 40.

Figure 40:
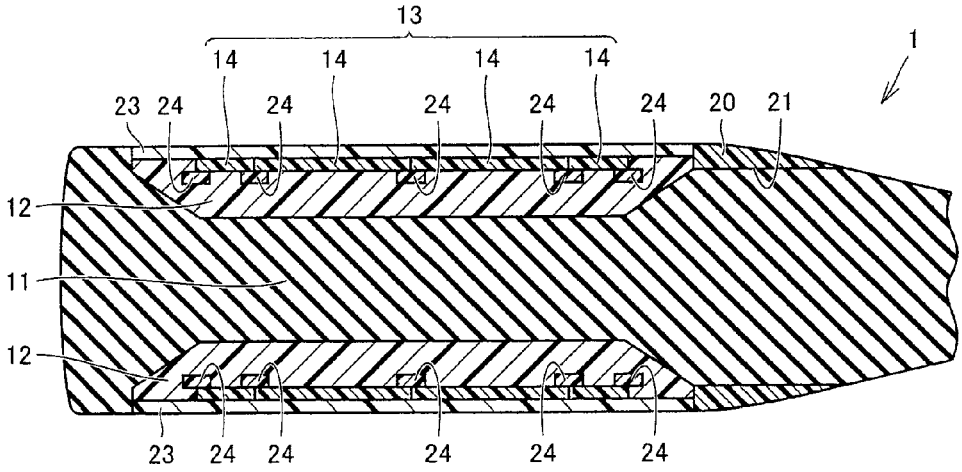
FIG. 40 is a partially fragmented schematic sectional view showing a twenty-fourth embodiment of the bat according to the present invention.

While a bat 1 shown in FIG. 40 basically has a structure similar to that of bat 1 shown in FIGS. 35 and 36, a point that the sizes of outer shell member portions 14 are not entirely identical to each other but an outer shell member 13 is constituted of outer shell member portions 14 having different sizes is different from bat 1 shown in FIGS. 35 and 36. Also according to such a structure, effects similar to those of bat 1 shown in FIGS. 35 and 36 can be attained. As shown in FIG. 40, the size (more specifically, the width in the extensional direction of bat 1) of outer shell member portion 14 located on a central portion of a hitting portion is rendered larger than the sizes of outer shell member portions 14 located on end portions of the hitting portion, whereby the number of boundaries between outer shell member portions 14 at the center of the hitting portion can be reduced. In hitting of a ball, therefore, it is possible to reduce a possibility that the end portions of outer shell member portions 14 inroad into an elastic body 12 on the boundaries and elastic body 12 breaks. When the size of outer shell member portion 14 located on the central portion of the hitting portion is rendered smaller than the sizes of outer shell member portions 14 located on the end portions of the hitting portion contrarily to the structure shown in FIG. 40, on the other hand, an impact in batting can be rendered easily transmittable to elastic body 12 on the central portion of the hitting portion (i.e., a region having the highest possibility of coming into contact with the ball in the hitting of the ball), whereby deformation of the ball in the batting can be more effectively suppressed. Consequently, energy loss resulting from deformation of the ball in the hitting can be reduced, and repulsiveness of bat 1 can be improved.

(Twenty-Fifth Embodiment)

A twenty-fifth embodiment of the bat according to the present invention is described with reference to FIG. 41.

Figure 41:
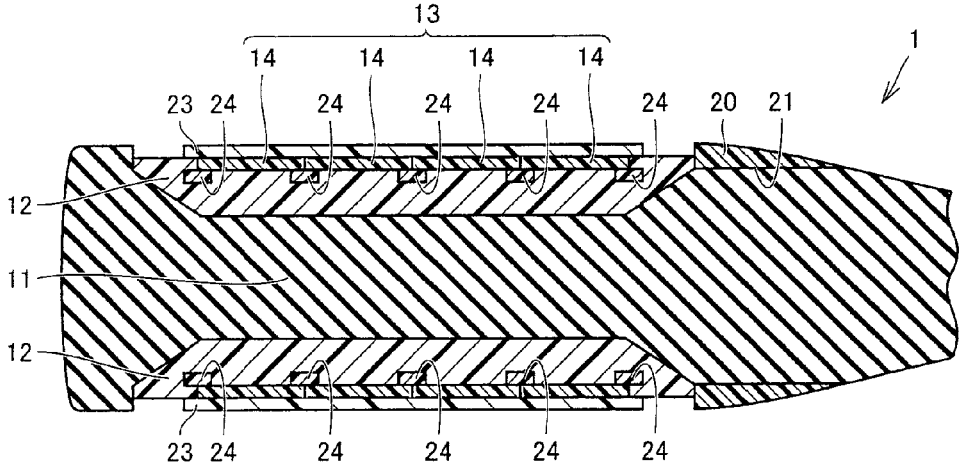
FIG. 41 is a partially fragmented schematic sectional view showing a twenty-fifth embodiment of the bat according to the present invention.

While a bat 1 shown in FIG. 41 basically has a structure similar to that of bat 1 shown in FIGS. 35 and 36, the structure of a cover member 23 is different from bat 1 shown in FIGS. 35 and 36. More specifically, while cover member 23 is arranged to cover the outer peripheral surface of an outer shell member 13 in bat 1 shown in FIG. 41, the surface of an elastic body 12 is exposed on the outside of end portions of cover member 23 in the extensional direction of bat 1. Also according to such a structure, outer shell member 13 can be protected with cover member 23, whereby effects similar to those of bat 1 shown in FIGS. 35 and 36 can be attained. Cover member 23 and elastic body 12 may be fixed to each other on contact portions thereof (regions where cover member 23 and elastic body 12 are in contact with each other on the outside of both end portions of outer shell member 13). Cover member 23 and outer shell member 13 may be fixed to each other, or cover member 23 and outer shell member 13 may not be fixed to each other (elastically deformable independently of each other).

(Twenty-Sixth Embodiment)

A twenty-sixth embodiment of the bat according to the present invention is described with reference to FIG. 42.

Figure 42:
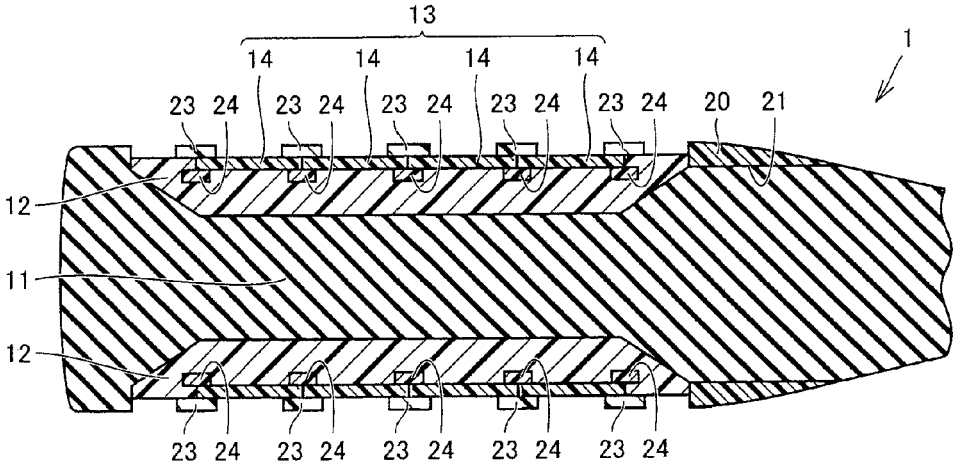
FIG. 42 is a partially fragmented schematic sectional view showing a twenty-sixth embodiment of the bat according to the present invention.

While a bat 1 shown in FIG. 42 basically has a structure similar to that of bat 1 shown in FIGS. 35 and 36, the structure of cover members 23 is different from bat 1 shown in FIGS. 35 and 36. More specifically, cover members 23 are plurally arranged on regions located on boundaries between adjacent outer shell member portions 14 and regions located on both end portions of an outer shell member 13 at intervals from each other in bat 1 shown in FIG. 42. From a different point of view, end portions of outer shell member portions 14 are held between cover members 23 and reinforcing members 24 in bat 1 shown in FIG. 42. Also according to such a structure, the end portions of outer shell member portions 14 (the aforementioned boundaries and both end portions of outer shell member 13) can be protected with cover members 23.

In each of aforementioned bats 1 shown in FIGS. 37 to 39, 41 and 42, outer shell member 13 may be constituted of outer shell member portions 14 of a plurality of types of sizes as shown in FIG. 40. In each of bats 1 shown in FIGS. 37 to 40, cover member(s) 23 of the structure shown in FIG. 41 or 42 may be applied.

(Twenty-Seventh Embodiment)

A twenty-seventh embodiment of the bat according to the present invention is described with reference to FIGS. 43 to 45.

Figure 43:
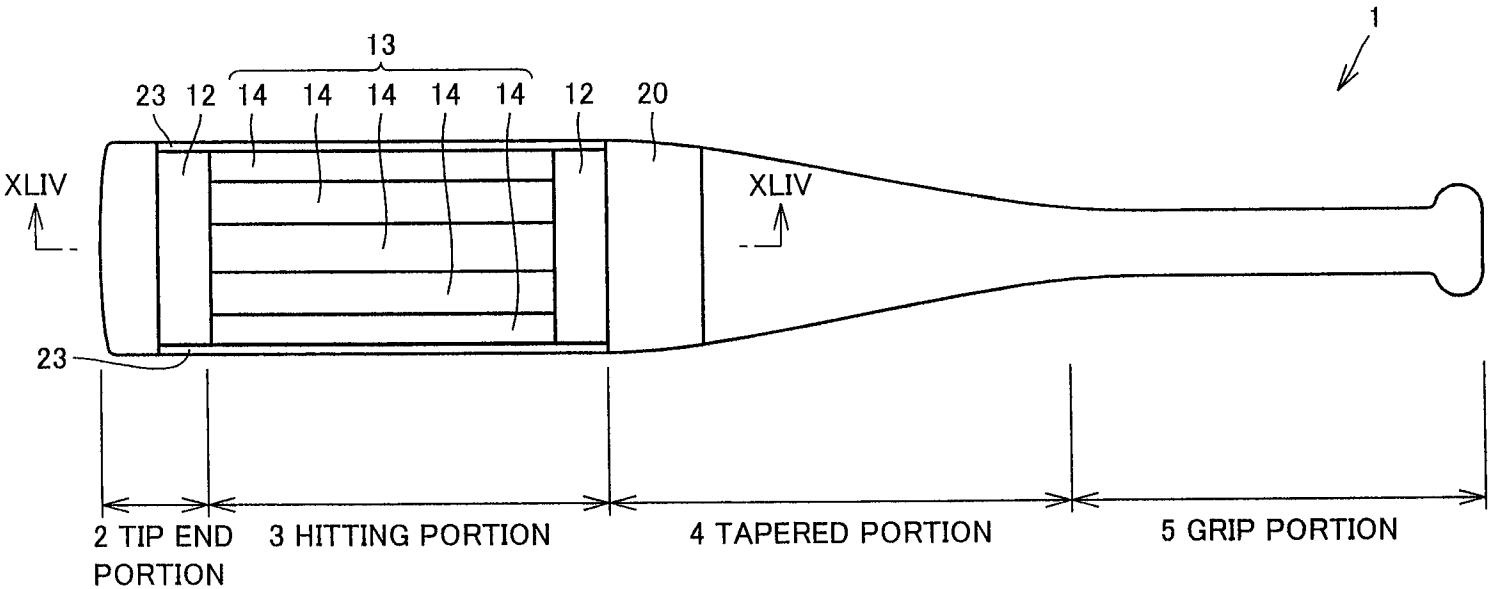
FIG. 43 is a schematic diagram showing a twenty-seventh embodiment of the bat according to the present invention.
Figure 44:
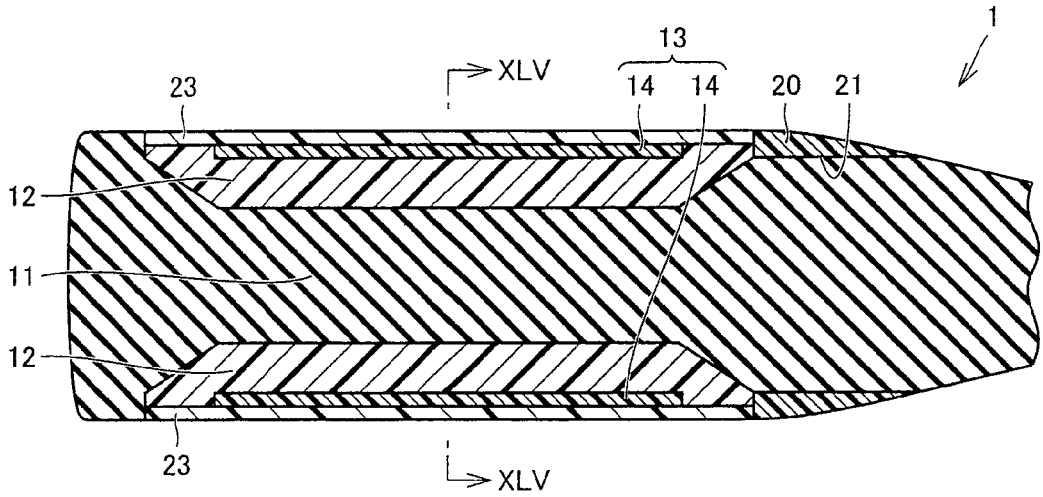
FIG. 44 is a partially fragmented schematic sectional view taken along the line segment XLIV-XLIV in FIG. 43.
Figure 45:
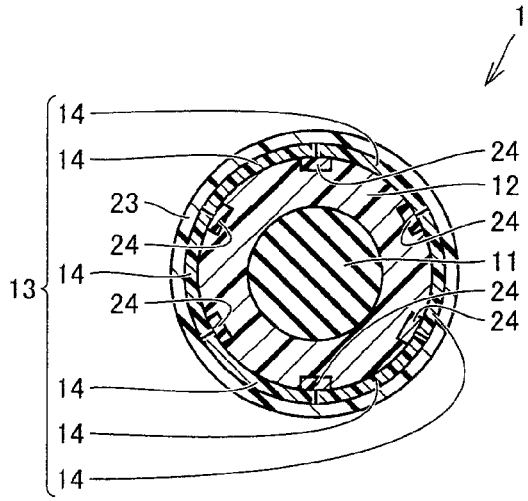
FIG. 45 is a schematic sectional view taken along the line segment XLV-XLV in FIG. 44.

While a bat 1 shown in FIGS. 43 to 45 basically has a structure similar to that of bat 1 shown in FIGS. 35 and 36, the shapes of outer shell member portions 14 constituting an outer shell member 13 are different. In other words, outer shell member portions 14 have oblong shapes extending along the extensional direction of the central axis of bat 1 in bat 1 as shown in FIGS. 43 and 44, similarly to bat 1 shown in FIGS. 6 to 8. From a different point of view, outer shell member 13 is in such a state that plurality of outer shell member portions 14 extending along the extensional direction of bat 1 line up along the outer periphery of bat 1. Portions of outer shell member portions 14 in contact with an elastic body 12 are entirely or partially connected/fixed to elastic body 12 with a connecting member such as an adhesive respectively. Further, portions of outer shell member portions 14 in contact with a cover member 23 are also entirely or partially fixed to cover member 23 with a connecting member such as an adhesive. Also according to bat 1 having such a structure, effects similar to those of bat 1 shown in FIGS. 35 and 36 can be attained. As the fixing method for outer shell member portions 14 and the surface of elastic body 12 and the fixing method for outer shell member portions 14 and cover member 23, an arbitrary method (a method of welding outer shell member portions 14 and elastic body 12 to each other, for example) other than the aforementioned method employing the fixing member such as an adhesive can be employed.

As understood from FIG. 45, reinforcing members 24 are arranged on the inner peripheral sides of boundaries between adjacent outer shell member portions 14 (boundaries extending along the extensional direction of bat 1). Reinforcing members 24 have zonal shapes extending in the extensional direction of bat 1 along the aforementioned boundaries. Plurality of reinforcing members 24 may be arranged at prescribed intervals along the aforementioned boundaries.

As understood from FIGS. 43 and 44, the width of outer shell member 31 is narrower than the width of elastic body 12 in the extensional direction of bat 1. Therefore, elastic body 12 and cover member 23 are in contact with each other on the outside of end portions of outer shell member 13 in the extensional direction of bat 1. Cover member 23 and outer shell member 13 may be fixed to each other on the outside of the end portions of aforementioned outer shell member 13. Cover member 23 and outer shell member 13 may be fixed to each other, or may be elastically deformable independently of each other. Further, outer shell member 13 and elastic body 12 may be fixed to each other, or may be elastically deformable independently of each other.

(Twenty-Eighth Embodiment)

A twenty-eighth embodiment of the bat according to the present invention is described with reference to FIG. 46.

Figure 46:
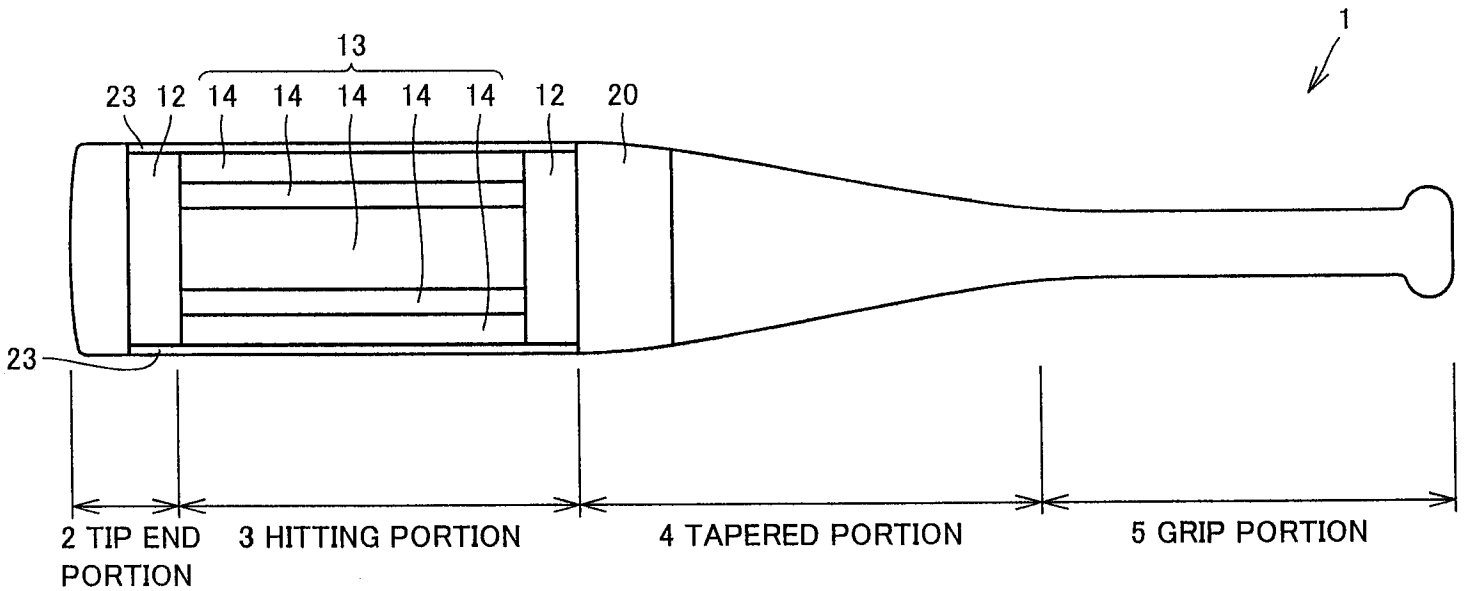
FIG. 46 is a schematic diagram showing a twenty-eighth embodiment of the bat according to the present invention.

While a bat 1 shown in FIG. 46 basically has a structure similar to that of bat 1 shown in FIGS. 43 to 45, a point that the sizes of outer shell member portions 14 are not entirely identical to each other but an outer shell member 13 is constituted of outer shell member portions 14 having different sizes is different from bat 1 shown in FIGS. 43 to 45. In bat 1 shown in FIG. 46, outer shell member portions 14 having large widths and outer shell member portions 14 having narrow widths are alternately arranged in the circumferential direction along the side surface of bat 1. Also according to such a structure, effects similar to the effects according to bat 1 shown in FIGS. 43 to 45 can be attained. As to outer shell member portions 14, those of two types of sizes (widths) may be employed as shown in FIG. 46, while outer shell member portions 14 of a plurality of types of sizes including at least three types may be employed.

(Twenty-Ninth Embodiment)

A twenty-ninth embodiment of the bat according to the present invention is described with reference to FIG. 47.

Figure 47:
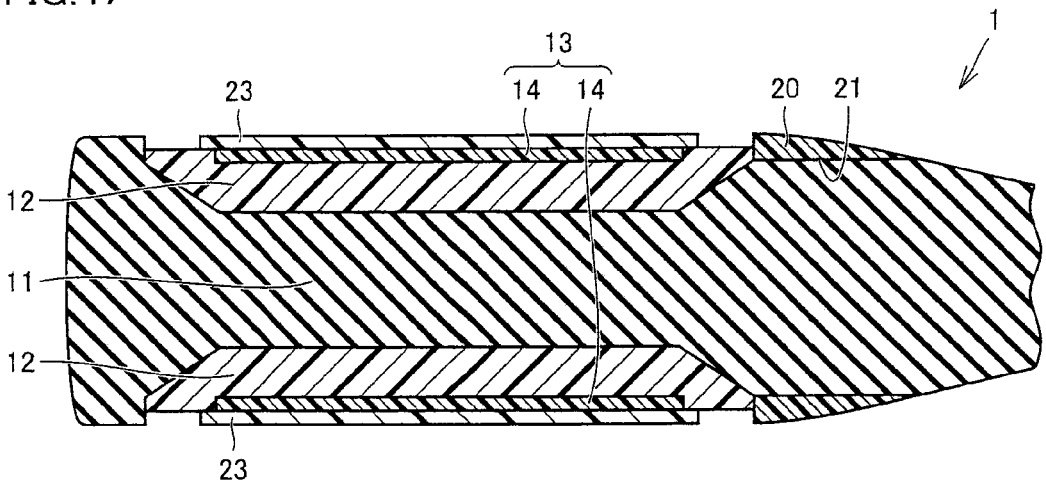
FIG. 47 is a partially fragmented schematic sectional view showing a twenty-ninth embodiment of the bat according to the present invention.

While a bat 1 shown in FIG. 47 basically has a structure similar to that of bat 1 shown in FIGS. 43 to 45, the structure of a cover member 23 is different from bat 1 shown in FIGS. 43 to 45. More specifically, while cover member 23 is arranged to cover the outer peripheral surface of an outer shell member 13 in bat 1 shown in FIG. 47, the surface of an elastic body 12 is exposed on the outside of end portions of cover member 23 in the extensional direction of bat 1. Also according to such a structure, outer shell member 13 can be protected with cover member 23, whereby effects similar to those of bat 1 shown in FIGS. 43 to 45 can be attained. Similarly to bat 1 shown in FIG. 41, cover member 23 and elastic body 12 may be fixed to each other on contact portions thereof (regions where cover member 23 and elastic body 12 are in contact with each other on the outside of both end portions of outer shell member 13). Further, cover member 23 and outer shell member 13 may be fixed to each other, or cover member 23 and outer shell member 13 may not be fixed to each other (elastically deformable independently of each other).

(Thirtieth Embodiment)

A thirtieth embodiment of the present invention is described with reference to FIG. 48.

Figure 48:
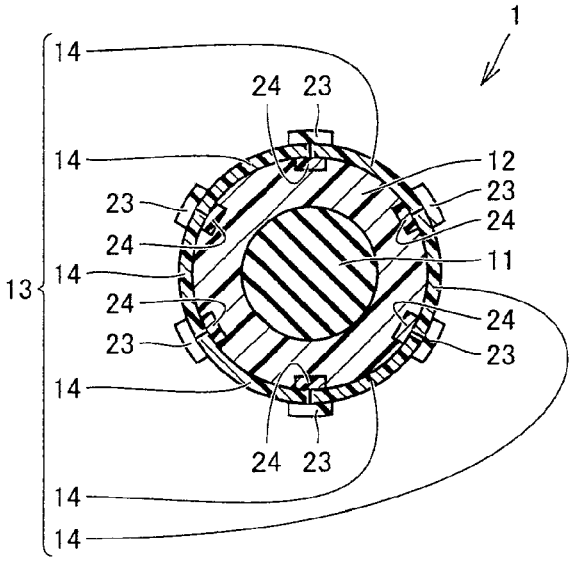
FIG. 48 is a schematic sectional view showing a thirtieth embodiment of the bat according to the present invention.

While a bat 1 shown in FIG. 48 basically has a structure similar to that of bat 1 shown in FIGS. 43 to 45, the structure of cover members 23 is different from bat 1 shown in FIGS. 43 to 45. More specifically, cover members 23 are plurally arranged on regions located on boundaries between adjacent outer shell member portions 14 at intervals from each other in bat 1 shown in FIG. 48. Respective cover members 23 have oblong shapes extending along the aforementioned boundaries. From a different point of view, end portions of outer shell member portions 14 are held between cover members 23 and reinforcing members 24 in bat 1 shown in FIG. 48. Also according to such a structure, the end portions of outer shell member portions 14 can be protected with cover members 23.

In each of aforementioned bats 1 shown in FIGS. 43 to 45, 47 and 48, outer shell member 13 may be constituted of outer shell member portions 14 of a plurality of types of sizes as shown in FIG. 46. In bat 1 shown in FIGS. 43 to 46, cover member(s) 23 of the structure shown in FIG. 47 or 48 may be applied.

(Thirty-First Embodiment)

A thirty-first embodiment of the bat according to the present invention is described with reference to FIGS. 49 and 50.

Figure 49:
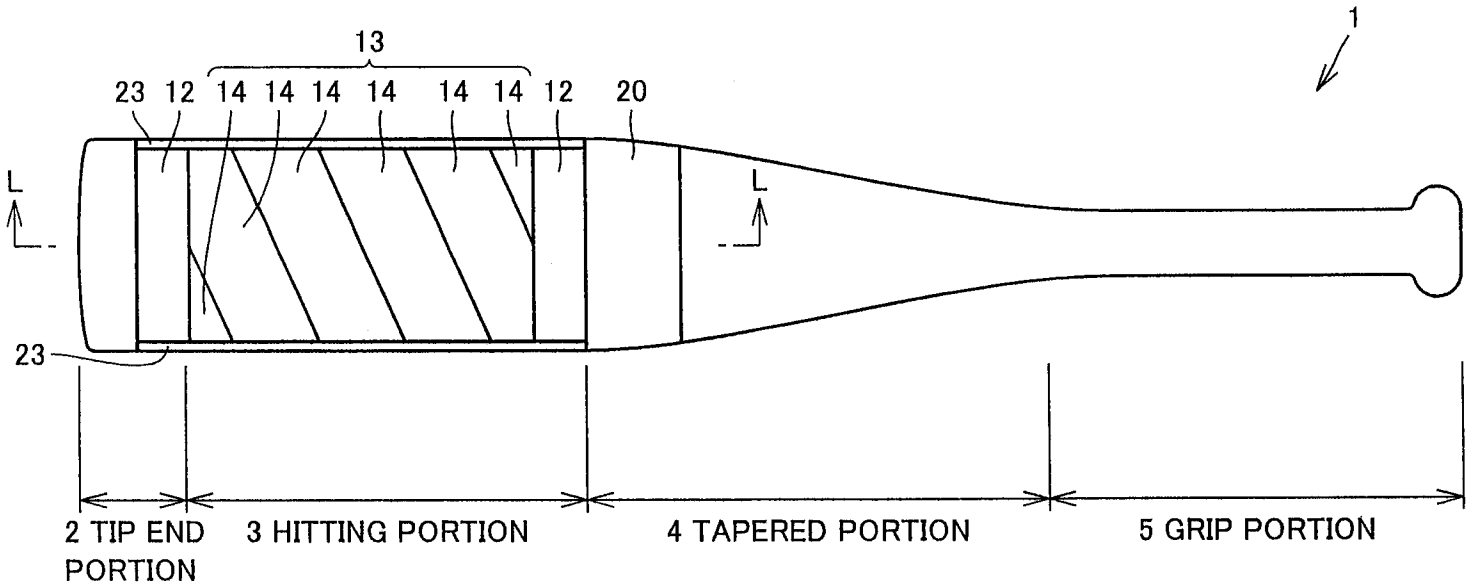
FIG. 49 is a schematic diagram showing a thirty-first embodiment of the bat according to the present invention.
Figure 50:
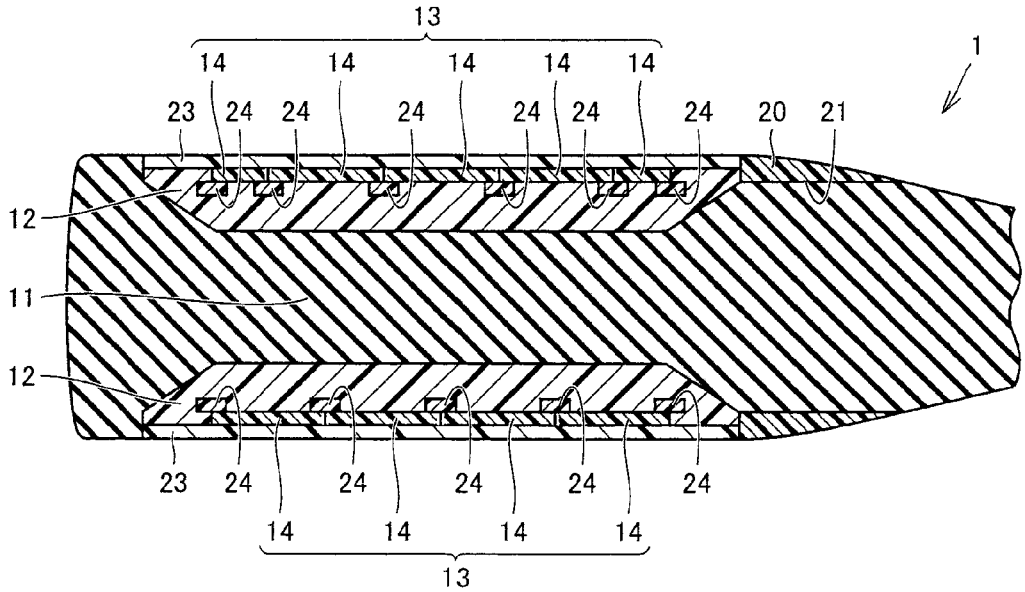
FIG. 50 is a partially fragmented schematic sectional view taken along the line segment L-L in FIG. 49.

While a bat 1 shown in FIGS. 49 and 50 basically has a structure similar to that of bat 1 shown in FIGS. 35 and 36, the shapes of outer shell member portions 14 constituting an outer shell member 13 are different. In other words, outer shell member portions 14 are formed by obliquely (spirally) dividing outer shell member 13 with respect to the extensional direction of bat 1 in bat 1 shown in FIGS. 49 and 45, similarly to bat 1 shown in FIGS. 9 and 10. In other words, outer shell member portions 14 have spirally extending outer shapes. Also according to bat 1 having such a shape, effects similar to those of the bat shown in FIGS. 35 and 36 can be attained. Further, such spiral outer shell member portions 14 are so employed that outer shell member portions 14 can be utilized as reinforcing members for bat 1 with respect to bending stress in both of a direction along the central axis of bat 1 and a direction perpendicular to the central axis.

Portions of outer shell member portions 14 in contact with an elastic body 12 are entirely or partially connected/fixed to elastic body 12 with a connecting member such as an adhesive. Portions of outer shell member portions 14 in contact with a cover member 23 are also entirely or partially fixed to cover member 23 with a connecting member such as an adhesive. As the fixing method for outer shell member portions 14 and the surface of elastic body 12 and the fixing method for outer shell member portions 14 and cover member 23, an arbitrary method (a method of welding outer shell member portions 14 and elastic body 12 to each other, for example) other than the aforementioned method employing the fixing member such as an adhesive can be employed.

As understood from FIG. 50, reinforcing members 24 are arranged on the inner peripheral sides of boundaries between adjacent outer shell member portions 14 (boundaries extending in a direction inclined with respect to the extensional direction of bat 1). Reinforcing members 24 have spiral zonal shapes extending in the direction inclined with respect to the extensional direction of bat 1 along the aforementioned boundaries. Plurality of reinforcing members 24 may be arranged at prescribed intervals along the aforementioned boundaries.

As understood from FIG. 50, the width of outer shell member 13 is narrower than the width of elastic body 12 in the extensional direction of bat 1. Therefore, elastic body 12 and cover member 23 are in contact with each other on the outside of end portions of outer shell member 13 in the extensional direction of bat 1. Cover member 23 and elastic body 12 may be fixed to each other on the outside of the end portions of aforementioned outer shell member 13. Cover member 23 and outer shell member 13 may be fixed to each other, or may be elastically deformable independently of each other. Further, outer shell member 13 and elastic body 12 may be fixed to each other, or may be elastically deformable independently of each other.

(Thirty-Second Embodiment)

A thirty-second embodiment of the bat according to the present invention is described with reference to FIG. 51.

Figure 51:
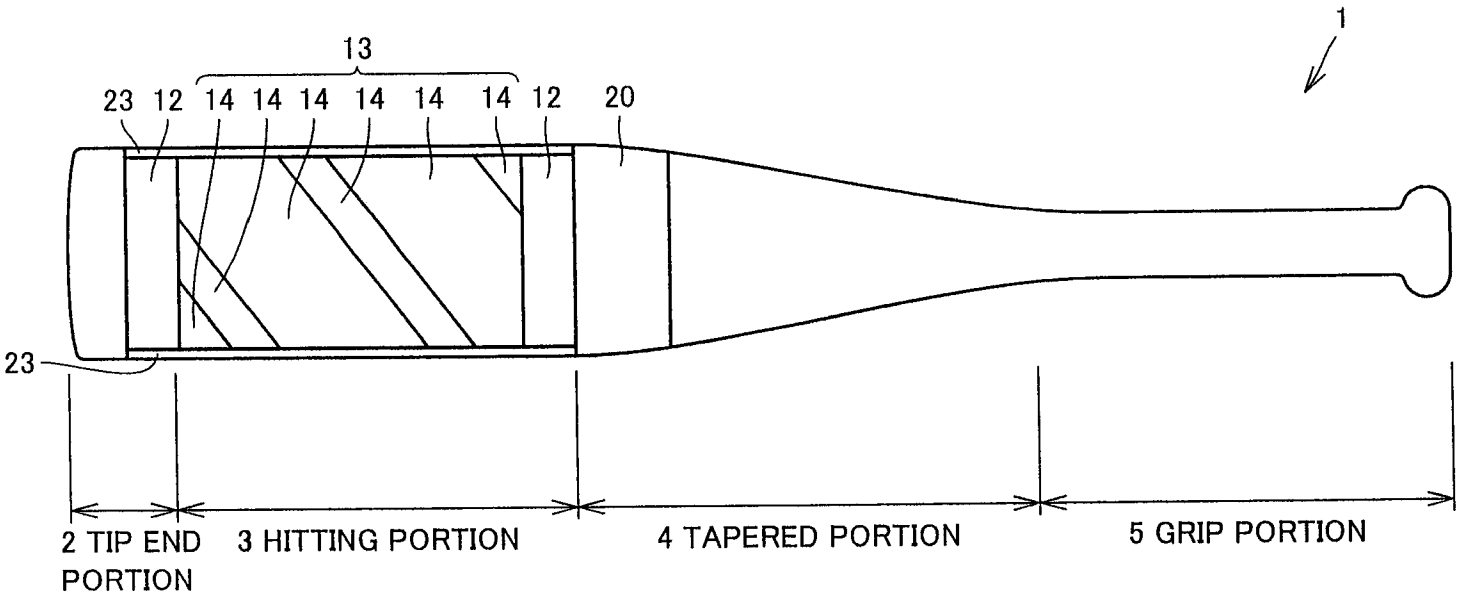
FIG. 51 is a schematic diagram showing a thirty-second embodiment of the bat according to the present invention.

While a bat 1 shown in FIG. 51 basically has a structure similar to that of bat 1 shown in FIGS. 49 and 50, a point that the sizes of outer shell member portions 14 are not entirely identical to each other but an outer shell member 13 is constituted of outer shell member portions 14 having different sizes is different from bat 1 shown in FIGS. 49 and 50. In bat 1 shown in FIG. 51, outer shell member portions 14 having large widths and outer shell member portions 14 having narrow widths are alternately (spirally) arranged in the circumferential direction along the side surface of bat 1. Also according to such a structure, effects similar to the effects according to bat 1 shown in FIGS. 49 and 50 can be attained. As to outer shell member portions 14, those of two types of sizes (widths) may be employed as shown in FIG. 51, while outer shell member portions 14 of a plurality of types of sizes including at least three types may be employed.

(Thirty-Third Embodiment)

A thirty-third embodiment of the bat according to the present invention is described with reference to FIG. 52.

Figure 52:
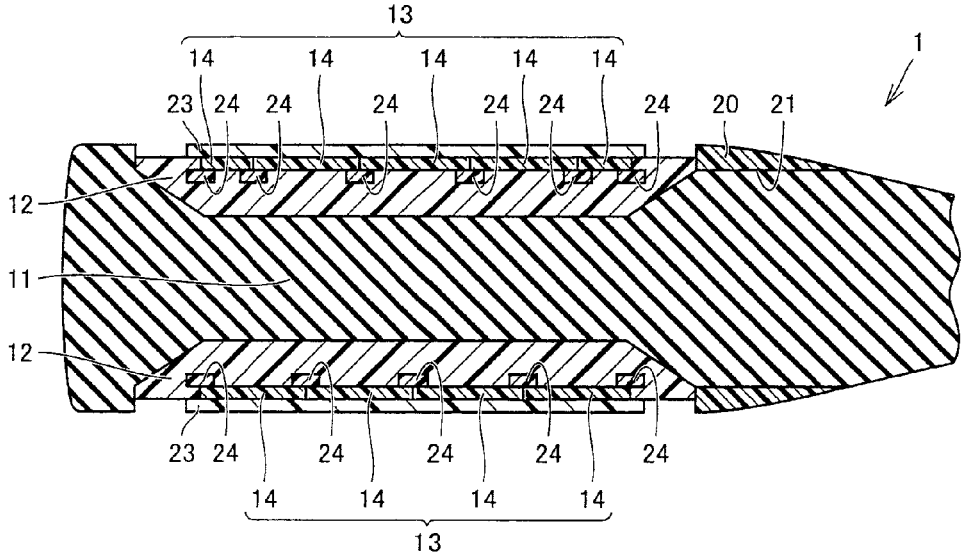
FIG. 52 is a partially fragmented schematic sectional view showing a thirty-third embodiment of the bat according to the present invention.

While a bat 1 shown in FIG. 52 basically has a structure similar to that of bat 1 shown in FIGS. 49 and 50, the structure of a cover member 23 is different from bat 1 shown in FIGS. 49 and 50. More specifically, while cover member 23 is arranged to cover the outer peripheral surface of an outer shell member 13 in bat 1 shown in FIG. 52, the surface of an elastic body 12 is exposed on the outside of end portions of cover member 23 in the extensional direction of bat 1. Also according to such a structure, outer shell member 13 can be protected with cover member 23, whereby effects similar to those of bat 1 shown in FIGS. 49 and 50 can be attained. Similarly to bat 1 shown in FIG. 41, cover member 23 and elastic body 12 may be fixed to each other on contact portions thereof (regions where cover member 23 and elastic body 12 are in contact with each other on the outside of both end portions of outer shell member 13). Further, cover member 23 and outer shell member 13 may be fixed to each other, or cover member 23 and outer shell member 13 may not be fixed to each other (elastically deformable independently of each other).

(Thirty-Fourth Embodiment)

A thirty-fourth embodiment of the bat according to the present invention is described with reference to FIG. 53.

Figure 53:
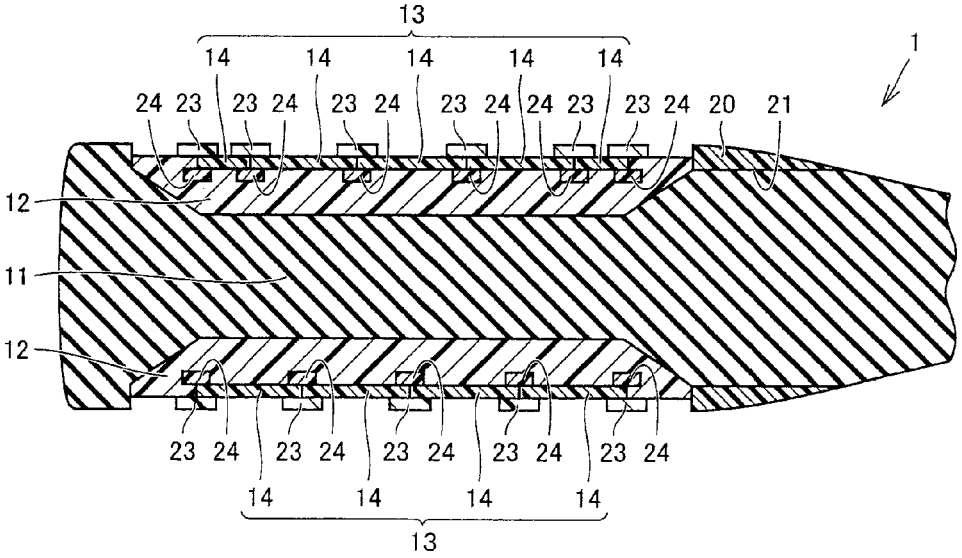
FIG. 53 is a partially fragmented schematic sectional view showing a thirty-fourth embodiment of the bat according to the present invention.

While a bat 1 shown in FIG. 53 basically has a structure similar to that of bat 1 shown in FIGS. 49 and 50, the structure of cover members 23 is different from bat 1 shown in FIGS. 49 and 50. More specifically, cover members 23 are plurally arranged on regions located on boundaries between adjacent outer shell member portions 14 and regions located on both end portions of outer shell member 13 at intervals from each other in bat 1 shown in FIG. 53. From a different point of view, end portions of outer shell member portions 14 are held between cover members 23 and reinforcing members 24 in bat 1 shown in FIG. 53. Also according to such a structure, the end portions of outer shell member portions 14 (the aforementioned boundaries and both end portions of outer shell member 13) can be protected with cover members 23.

In each of aforementioned bats 1 shown in FIGS. 49, 50, 52 and 53, outer shell member 13 may be constituted of outer shell member portions 14 of a plurality of types of sizes as shown in FIG. 51. In each of bats 1 shown in FIGS. 49 to 51, cover member(s) 23 of the structure shown in FIG. 52 or 53 may be applied.

(Thirty-Fifth Embodiment)

The fourth embodiment of the bat according to the present invention is described with reference to FIG. 54.

Figure 54:
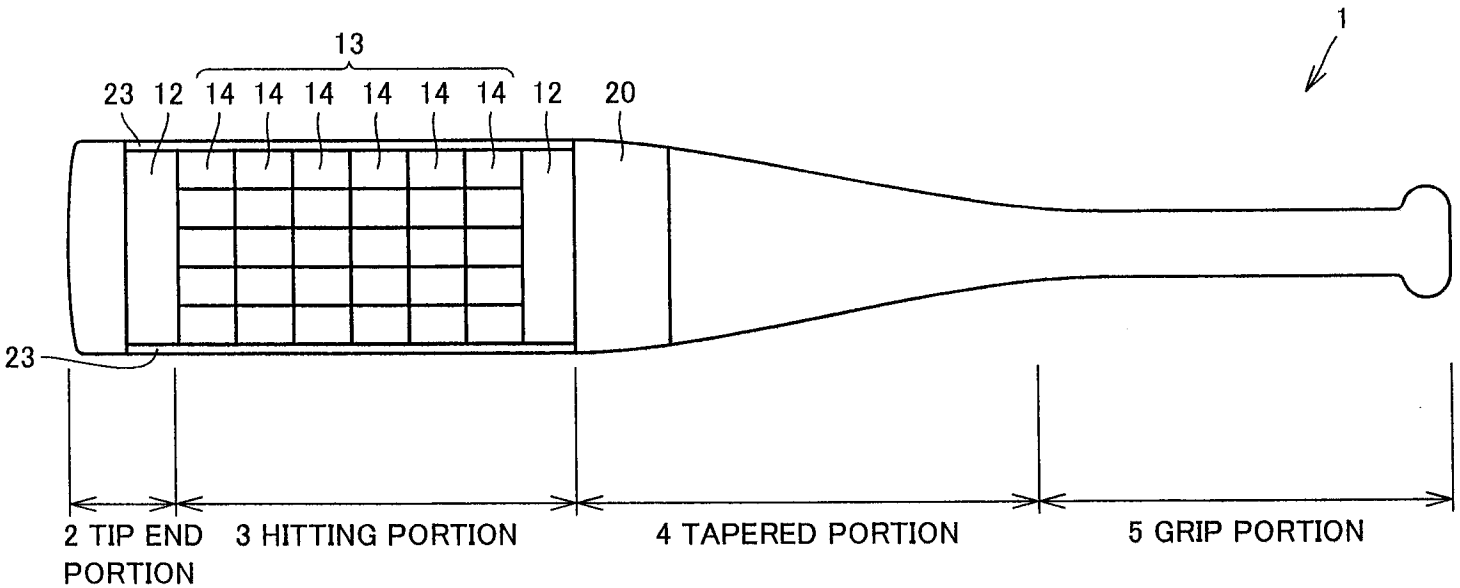
FIG. 54 is a partially fragmented schematic sectional view showing a thirty-fifth embodiment of the bat according to the present invention.

While a bat 1 shown in FIG. 54 basically has a structure similar to that of bat 1 shown in FIGS. 35 and 36, the shapes of outer shell member portions 14 are different. In other words, outer shell member portions 14 in the bat shown in FIG. 54 are members obtained by dividing an outer shell member 13 in two directions, i.e., the extensional direction of the central axis of bat 1 and a direction perpendicular to the central axis and the plane structures thereof are substantially quadrangular, similarly to bat 1 shown in FIGS. 11 to 13. Outer shell member portions 14 may be connected/fixed to the surface of an elastic body 12 located on the inner peripheral side. Alternatively, outer shell member portions 14 may be fixed to a cover member 23. Also according to bat 1 having such a structure, effects similar to those of bat 1 shown in FIGS. 35 and 36 can be attained. Further, the sizes of outer shell member portions 14 are so properly selected that, when hitting a ball with bat 1, an impact resulting from the hitting can be reliably transmitted to elastic body 12. Consequently, deformation of the ball can be suppressed, and the carry of the ball can be further elongated through repulsive force of elastic body 12.

While not directly shown in FIG. 54, reinforcing members 24 are arranged on the inner peripheral sides of the boundaries between adjacent outer shell member portions 14, similarly to bat 1 shown in FIG. 36. Reinforcing members 24 may be zonally formed along the aforementioned boundaries, or may be plurally arranged at prescribed intervals along the boundaries.

(Thirty-Sixth Embodiment)

The twenty-fourth embodiment of the bat according to the present invention is described with reference to FIG. 55.

Figure 55:
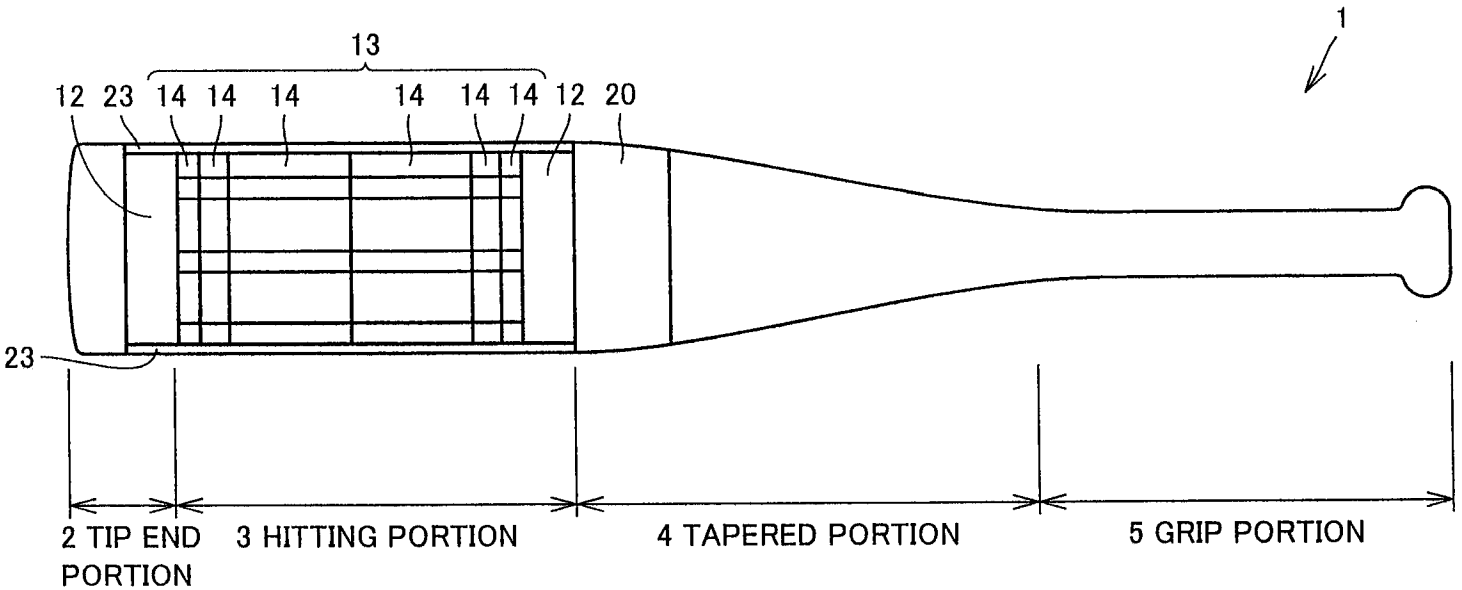
FIG. 55 is a partially fragmented schematic sectional view showing a thirty-sixth embodiment of the bat according to the present invention.

While a bat 1 shown in FIG. 55 basically has a structure similar to that of bat 1 shown in FIG. 54, a point that the sizes of outer shell member portions 14 are not entirely identical to each other but an outer shell member 13 is constituted of outer shell member portions 14 having different sizes is different from bat 1 shown in FIG. 54. Also according to such a structure, effects similar to the effects according to bat 1 shown in FIG. 54 can be attained. Further, the number of boundaries between outer shell member portions 14 at the center of a hitting portion can be reduced by rendering the area of outer shell member portion 14 located on a central portion of the hitting portion larger than the areas of outer shell member portions 14 located on end portions of the hitting portion, as shown in FIG. 40. In hitting of a ball, therefore, it is possible to reduce a possibility that end portions of outer shell member portions 14 inroad into an elastic body 12 on the boundaries and elastic body 12 breaks. When the area of outer shell member portion 14 located on the central portion of the hitting portion is rendered smaller than the areas of outer shell member portions 14 located on the end portions of the hitting portion contrarily to the structure shown in FIG. 55, on the other hand, an impact in batting can be rendered more easily transmittable to elastic body 12 on the central portion of the hitting portion (i.e., a region having the highest possibility of coming into contact with the ball in the hitting of the ball), whereby deformation of the ball in the batting can be more effectively suppressed. Consequently, energy loss resulting from deformation of the ball in the hitting can be reduced, and repulsiveness of bat 1 can be improved.

As aforementioned reinforcing members 24, TPU sheets (thermoplastic polyurethane sheets) can be employed as already described. As reinforcing members 24, a structure having extensional portions extending from the inner peripheral sides up to clearances between end surfaces of adjacent outer shell member portions 14 may be employed in place of the structure arranged on the inner peripheral sides of the boundaries between outer shell member portions 14. Further, the extensional portions may include outer peripheral side flange portions extending toward outer peripheral sides of the end portions of aforementioned outer shell member portions 14 as reinforcing members 24.

In each of the aforementioned embodiments, elastic body 12 may extend onto the outer peripheral surfaces of the end portions of outer shell member portions 14. In bat 1 shown in FIG. 36, for example, elastic body 12 may partially extend onto the outer peripheral surfaces of the end portions of outer shell member portions 14 in the extensional direction of bat 1. In this case, elastic body 12 partially grasps the end portions of outer shell member portions 14, whereby connection strength between outer shell member portions 14 and elastic body 12 can be increased. Further, elastic body 12 may partially extend to connected portions of adjacent pairs of outer shell member portions 14 in the extensional direction of bat 1. In addition, elastic body 12 may further partially extend onto the outer peripheral surfaces of the end portions of outer shell member portions 14 from the connected portions. Also in this case, the connection strength between outer shell member portions 14 and elastic body 12 can be increased.

While there are parts partially overlapping with the aforementioned embodiments, the characteristic structures of the present invention are now listed.

Bat 1 which is the baseball or softball bat according to the present invention is a baseball or softball bat including hitting portion 3, tapered portion 4 and grip portion 5, and hitting portion 3 offers hitting portion core 11 as a core, elastic body 12 and outer shell member 13. Elastic body 12 is arranged on the outer periphery of hitting portion core 11. Outer shell member 13 is arranged on the outer periphery of elastic body 12. Outer shell member 13 includes outer shell member portions 14 which are a plurality of portions elastically deformable independently of each other.

Thus, outer shell member 13 is constituted of plurality of outer shell member portions 14 elastically deformable independently of each other, whereby an impact from a ball is transmitted to outer shell member portion 14 of outer shell member 13 with which the ball has come into contact in batting, while the impact is not directly transmitted to other outer shell member portions 14 adjacent to outer shell member portion 14. Therefore, outer shell member portion 14 with which the ball has come into contact and elastic body 12 located under this portion can be easily elastically deformed. Consequently, energy loss is reduced by suppressing deformation of the ball in the batting, and the repulsiveness of bat 1 can be improved as a result.

When outer shell member 13 is an integral pipelike member as in the prior art, it follows that the overall pipelike member dispersively receives an impact load applied to the portion with which the ball has come into contact. Therefore, it becomes necessary to remarkably lower the rigidity of the pipelike member (to remarkably reduce the thickness of the pipelike member, for example) in order to implement sufficient deformation of the pipelike member to a degree capable of suppressing deformation of the ball. When outer shell member 13 is constituted of plurality of outer shell member portions 14 as in bat 1 according to the present invention, on the other hand, it follows that individual outer shell member portion 14 with which the ball has come into contact receives the impact load from the ball in batting, whereby it becomes possible to increase the rigidity of plurality of outer shell member portions 14 constituting outer shell member 13 to some extent (to reduce the thicknesses of plurality of outer shell member portions 14 to a degree capable of ensuring sufficient durability, for example). Therefore, the repulsiveness can be improved while maintaining durability of bat 1.

In aforementioned bat 1, plurality of outer shell member portions 14 may be members separated from/independent of each other, as shown in each of the first to sixteenth embodiments. In this case, only outer shell member portion 14 with which the ball has come into contact in the batting can be easily elastically deformed in outer shell member 13. Therefore, deformation of the ball in hitting is so suppressed as to reduce the energy loss, and the repulsiveness of the bat can be improved as a result.

Further, outer sell member 13 is constituted of plurality of separated/independent outer shell member portions 14, whereby it is possible to vary the material, the characteristics etc. with plurality of outer shell member portions 14. Therefore, the degree of freedom in design of bat 1 can be increased.

In aforementioned bat 1, portions opposed to each other (boundaries) may be connected with each other in plurality of outer shell member portions 14. In this case, the boundaries between the plurality of outer shell member portions are so partially connected with each other that (preferably the whole of) mutually connected groups of plurality of outer shell member portions 14 can be handled as one member as outer shell member 13. In manufacturing of bat 1, therefore, handling of outer shell member 13 is rendered easier than a case where plurality of outer shell member portions 14 are completely independent different members. Further, outer shell member 13 consisting of plurality of outer shell member portions 14 can be easily formed by preparing a pipelike material for forming outer shell member 13 and forming plurality of slits 41 partitioning plurality of outer shell member portions 14 in the material, for example.

Aforementioned bat 1 may further include spacers 31 arranged between plurality of outer shell member portions 14. In this case, occurrence of such a problem that plurality of outer shell member portions 14 so deform and move in batting that adjacent outer shell member portions 14 in plurality of outer shell member portions 14 directly come into contact with each other and break can be suppressed.

In aforementioned bat 1, outer shell member 13 and elastic body 12 may be fixed to each other. In this case, the impact from the ball in the batting can be reliably transmitted from outer shell member 13 to elastic body 12. Therefore, elastic body 12 so deforms as to suppress deformation of the ball, and the effect of reducing energy loss and improving the repulsiveness of bat 1 can be reliably attained as a result.

In aforementioned bat 1, outer shell member 13 may be so set that the relative position can be changed with respect to elastic body 12 (may be independently deformable (movable) from a different point of view). In this case, it becomes possible to prepare a bat component in which elastic body 12 is arranged around hitting portion core 11 in hitting portion 3 of bat 1 and to arrange plurality of outer shell member portions 14 for forming outer shell member 13 on the outer periphery of elastic body 12 of this bat component after, or, when plurality of outer shell member portions 14 are partially broken, to exchange only broken outer shell member portions 14.

In aforementioned bat 1, the boundaries between plurality of outer shell member portions 14 may be inclinatorily provided with respect to the central axis of hitting portion 3 (the central axis of bat 1) as in bat 1 shown in each of the third, seventh and eleventh embodiments. In this case, it follows that plurality of outer shell member portions 14 constituting outer shell member 13 are arranged while extending to obliquely intersect with the central axis of hitting portion 3. In any of cases where stress bending bat 1 is applied in the direction perpendicular to the central axis of hitting portion 3 and the direction along the central axis, therefore, outer shell member 13 can be utilized as a reinforcing member for bat 1. Therefore, the strength of bat 1 can be improved.

In aforementioned bat 1, elastic body 12 may be divided into elastic bodies 12 as a plurality of elastic body portions, as in bat 1 shown in the fourteenth embodiment. In this case, it follows that the elastic body portion located under outer shell member portion 14 with which a ball has come into contact in batting mainly deforms, and hence, when the material of elastic body 12 is rendered identical, deformation of the elastic body portion can be rendered larger than a case where elastic body 12 is formed as an integral member in the whole of hitting portion 3. Therefore, the repulsiveness of bat 1 can be improved as a result without changing the material for elastic body 12.

In aforementioned bat 1, hollow portions 16 may be formed in elastic body 12. In this case, elastic body 12 can be rendered more easily deformable without changing the material for elastic body 12. Therefore, the repulsiveness of bat 1 can be further improved.

Aforementioned bat 1 may further include fixed member 20 arranged on the side of tapered portion 4 as viewed from outer shell member 13 for regulating movement of outer shell member 13 toward the side of tapered portion 4, as shown in FIG. 4. In this case, outer shell member 13 can be reliably prevented from moving toward the side of tapered portion 4 with fixed member 20. When the outer diameter of the end portion of hitting portion 3 on the side of tapered portion 4 is rendered smaller than the inner diameter of outer shell member 13 in the bat body including hitting portion core 11, outer shell member 13 can be set on the bat body from the side of tapered portion 4 afterward. Then, fixed member 20 is set on the bat body, whereby outer shell member 13 can be easily fixed. When fixed member 20 is formed to be detachable from the bat body, an operation of exchanging outer shell member 13 from the bat body can be easily performed. When outer shell member 13 is rendered detachable from the bat body, further, elastic body 12 constituting the bat body can be exposed, whereby operations of exchanging and repairing elastic body 12 can be easily performed. The bat body denotes a component of the bat including at least hitting portion core 11 and elastic body 12, and indicates a component capable of constituting bat 1 by adding outer shell member 13 or outer shell member 13 and fixed member 20.

Aforementioned bat 1 may further include cover member 23 covering outer shell member 13. In this case, cover member 23 can protect outer shell member 13 and can prevent infiltration of water or sand from the end portions outer shell member 13, whereby the durability of bat 1 can be improved.

Aforementioned bat 1 may further include reinforcing members 24 arranged between outer shell member 13 and elastic body 12 on the inner peripheral sides of the boundaries between plurality of outer shell member portions 14. In this case, such a possibility can be reduced that the end portions of outer shell member portions 14 sink into elastic body 12 and elastic body 12 breaks when outer shell member portions 14 elastically deform.

An arbitrary material can be employed as the material constituting aforementioned outer shell member portions 14. For example, a metal (aluminum, iron, titanium, magnesium, stainless steel or the like, for example), fiber-reinforced plastic (FRP), wood or resin (TPU (thermoplastic polyurethane resin), nylon, polyester, polycarbonate, polypropylene, ABS resin or vinyl chloride, for example) can be employed as the material constituting outer shell member portions 14. While simple solid bodies (platelike bodies) may be employed as the structure of outer shell member portions 14, another structure (a honeycomb structure, for example) may alternatively be employed.

As elastic body 12, an elastic body containing rubber, resin or the like as a matrix is preferably employed. Crosslinked crosslinked rubber such as butadiene rubber (BR), styrene-butadiene rubber (SBR), chloroprene rubber (CR), isoprene rubber (IR), ethylene-propylene rubber (EPR), ethylene-propylene-diene three-component copolymer (EPDM) rubber, silicon rubber (SiR) or natural rubber (NR) can be listed as the rubber. Polyurethane-based resin such as ether-based polyurethane resin or ester-based polyurethane resin, styrene-based resin such as polystyrene resin, styrene-butadiene-styrene (SBS) resin or styrene-isoprene-styrene (SIS) resin, olefin-based resin such as polyethylene resin or polypropylene resin, polyester-based resin, polyamide-based resin or ionomer resin can be listed as the resin. A polyurethane-based elastomer such as an ether-based polyurethane elastomer or an ester-based polyurethane elastomer, a styrene-based elastomer such as a polystyrene elastomer, a styrene-butadiene-styrene (SBS) elastomer or a styrene-isoprene-styrene (SIS) elastomer, an olefin-based elastomer such as a polyethylene elastomer or a polypropylene elastomer, a polyester-based elastomer or a polyamide-based elastomer can be listed as an elastomer.

As the material for hitting portion core 11, an arbitrary material such as a metal (aluminum or stainless steel, for example), FRP or wood can be employed.

The present invention is so applied to a baseball or softball bat applying an elastic body to a hitting portion that particularly remarkable effects are attained.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A baseball or softball bat comprising:

a grip portion;

a tapered portion;

and a hitting portion comprising:

a core;

an elastic body arranged on the outer periphery of said core;

a substantially cylindrical outer shell member arranged on the outer periphery of said elastic body, wherein the outer shell member includes a plurality of elastic portions elastically deformable independently of each other, wherein a radial thickness of the elastic body is greater than a radial thickness of the plurality of the elastic portions and a reinforcing member is arranged between said outer shell member and said elastic body on the inner peripheral side of a boundary between said plurality of portions;

wherein the elastic body is at least 4 mm thick and at least 10 mm long in the extensional direction; and wherein the grip portion, the tapered portion, and the core are of unitary construction.

2. The baseball or softball bat according to claim 1, wherein said plurality of portions are members separated from/independent of each other.

3. The baseball or softball bat according to claim 1, wherein portions opposed to each other are partially connected with each other in said plurality of portions.

4. The baseball or softball bat according to claim 1, further comprising a spacer arranged between said plurality of portions.

5. The baseball or softball bat according to claim 1, wherein said outer shell member and said elastic body are fixed to each other.

6. The baseball or softball bat according to claim 1, wherein said outer shell member is so set that the relative position is changeable with respect to said elastic body.

7. The baseball or softball bat according to claim 1, wherein a boundary between said plurality of portions is inclinatorily provided with respect to the central axis of said hitting portion.

8. The baseball or softball bat according to claim 1, wherein said elastic body is divided into a plurality of elastic body portions.

9. The baseball or softball bat according to claim 1, wherein said elastic body is provided with a hollow portion.

10. The baseball or softball bat according to claim 1, further comprising a fixed member arranged on the side of said tapered portion as viewed from said outer shell member for regulating movement of said outer shell member toward the side of said tapered portion.

11. The baseball or softball bat according to claim 1, further comprising a cover member covering said outer shell member.

12. A baseball or softball bat including a hitting portion, a tapered portion and a grip portion, wherein said hitting portion comprises:

a core;

an elastic body arranged on the outer periphery of said core;

an outer shell member arranged on the outer periphery of said elastic body, wherein said outer shell member includes a plurality of elastic portions elastically deformable independently of each other; and a reinforcing member arranged between said outer shell member and said elastic body on the inner peripheral side of a boundary between said plurality of portions.

13. The baseball or softball bat according to claim 12, wherein said plurality of portions are members separated from/independent of each other.

14. The baseball or softball bat according to claim 12, wherein portions opposed to each other are partially connected with each other in said plurality of portions.

15. The baseball or softball bat according to claim 12, further comprising a spacer arranged between said plurality of portions.

16. The baseball or softball bat according to claim 12, wherein said outer shell member and said elastic body are fixed to each other.

17. The baseball or softball bat according to claim 12, wherein said outer shell member is so set that the relative position is changeable with respect to said elastic body.

18. The baseball or softball bat according to claim 12, wherein a boundary between said plurality of portions is inclinatorily provided with respect to the central axis of said hitting portion.

19. The baseball or softball bat according to claim 12, wherein said elastic body is divided into a plurality of elastic body portions.

* * * * *